US006904001B1

(12) United States Patent
Rast

(10) Patent No.: US 6,904,001 B1
(45) Date of Patent: Jun. 7, 2005

(54) APPARATUS AND METHODS OF PROVIDING ENHANCED CONTROL FOR CONSUMERS

(76) Inventor: Rodger H. Rast, Rastar Corporation, 11292 Coloma Rd., Suite L, Gold River, CA (US) 95670

( * ) Notice: Subject to any disclaimer, the term of this patent is extended or adjusted under 35 U.S.C. 154(b) by 370 days.

(21) Appl. No.: 10/039,709

(22) Filed: Jan. 4, 2002

Related U.S. Application Data

(60) Provisional application No. 60/302,897, filed on Jul. 2, 2001, provisional application No. 60/301,193, filed on Jun. 26, 2001, provisional application No. 60/260,106, filed on Jan. 6, 2001, and provisional application No. 60/259,955, filed on Jan. 5, 2001.

(51) Int. Cl.[7] ..... G04B 25/00
(52) U.S. Cl. ..... 368/71; 368/107
(58) Field of Search ..... 368/10, 41–43, 368/71, 107, 110–113

(56) References Cited

U.S. PATENT DOCUMENTS 4,451,158 A * 5/1984 Selwyn et al. ..... 368/63
5,854,774 A * 12/1998 Timme ..... 368/10
5,990,782 A * 11/1999 Lee ..... 340/309.7
6,144,619 A * 11/2000 Reisman ..... 368/10
6,167,000 A * 12/2000 Chow ..... 368/107

* cited by examiner

*Primary Examiner*—David Martin
*Assistant Examiner*—Thanh S. Phan
(74) *Attorney, Agent, or Firm*—Rodger H. Rast

(57) ABSTRACT

Apparatus and method are described for controlling aspects of a users life to provide additional safety, efficiency, and comfort. A clock is described allowing a user to readily track the time spent according to a plurality of tasks, and switch between tasks with a single action. A tweezers is described which provides user feedback on the interposition of objects within the head and which can optionally be configured to provide automatic tweezing. A belt buckle is described which contains an expanding element for use with non-stretchy belt material, such as forms of leather. A necktie is described which increases user safety by including one or more tension release joints to allow the tie easily break apart and separate from the neck of the wearer in response to a sufficient tension force.

10 Claims, 31 Drawing Sheets

APPARATUS AND METHODS OF PROVIDING ENHANCED CONTROL FOR CONSUMERS

CROSS-REFERENCE TO RELATED APPLICATIONS

Provisional Application Ser. No. 60/302,897 filed on Jul. 2, 2001; Ser. No. 60/301,193 filed on Jun. 26, 2001; Ser. No. 60/260,106 filed on Jan. 6, 2001; Ser. No. 60/259,955 filed on Jan. 5, 2001; which are incorporated herein by reference.

STATEMENT OF FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to control devices for consumers and more particularly to a multitasking clock, an audio feedback set of tweezers, a compliant dress belt, and a safety-enhanced necktie.

2. Description of the Background Art

Consumers are constantly seeking new ways of controlling aspects of their lives, such as their time and their appearance. The number of products in this control category continues to rise, and the need for continuous improvement provides a competitive edge for manufacturers. Following are control apparatus and methods which enhance consumer control and safety.

Time has become the most precious of business commodities and businesspeople are becoming as zealous about tracking the use of time, both personally and within a business environment, as they have been at tracking expenses. However, persons that are required, or desire, to track the time accorded an assortment of tasks are left to record these on paper, or through computer time tracking programs, the times at which they start and stop various tasks. This is true even though a large variety of clocks exist for various manner of time display. Such as for displaying the time of day in one or multiple time zones, tide clocks, stop watches, and an assortment of additional clock types. These clocks typically display one or more offsets of a single time, for instance tide and time zone clocks, or are configured for the accurate timing of a single elapsed time as in a stop watch. Other timing devices include egg timers that can help in achieving the perfectly cooked egg, time punch clocks which can track a check in and out time, chess clocks for setting an upper limit on game time, and a variety of additional clock devices.

In situations in which a user desires to track time, such as for billing purposes, a many people struggle with the frustration, intense overhead, and proclivity for error associated with the use of computer billing programs. Users that are able to continue working on the same ongoing task for long periods of time without interruption may find the use of billing programs adequate. However, in many dynamic environments, the selection of ongoing tasks may change readily, and often the user is subject to frequent interruptions, such as telephones, the time for which, in many cases, also should be accounted for. In these instances, the shortcomings of computer based billing programs lead to frustration, wasted overhead time, and billing errors. When tracking hours within a billing application, the user must switch to the billing application (or load it if not resident), find and stop billing for the current task, create a new task (or find the correct billing category), start the new task. It will be appreciated by anyone having utilized billing packages that the time required to traverse screens to change billing categories is a source of frustration. The overhead involved with switching tasks often prevents a user from properly recording the time spent on various tasks. In addition, the requirement to keep an application resident, especially a large one such as an accounting or billing package, ties up system resources and can create another source of problems. Often users attempt to roughly reconstruct the amount of time they have already spent on a new task, adding it to one category and attempting to subtract it from another, which increases the overhead, frustration, and inaccuracies. In addition, when the user is performing actual work on their computer, as opposed to worrying about their time, they may forget which task is being timed as it is not readily apparent. Furthermore, there are many categories of time expenditure which could be beneficially tracked by an individual that do not show up on a billing system, for example, time spent in meetings, various overhead, breaks and other non-productive time. Salespeople, for example, may be able to improve their commissions, and company profits, by allocating specific amounts of time to each of various duties, and many sales seminars tout the advantages of this form of time tracking. Time tracking can allow individuals in many professions and vocations to better meet their goals, if it can be performed with negligible overhead and task switching frustration.

As can be seen, therefore, the development of a simple clock that is capable of tracking the time accorded a series of tasks can simplify the time tracking process and overcome deficiencies in previously known techniques.

The removal of small projections, such as hairs, splinters, and so forth is still often performed with the use of some form of tweezers, precision needle-nose pliers, or hemi stat. Tweezing devices come in an assortment of styles, and sizes for a variety of applications, primarily cosmetic, but to a lesser extent medical. Tweezers provide a head which is capable of grasping an item generally too small to be removed by a pair of fingers. Typically the tweezing head provides a pair of opposed hard surfaces between which the item to be "tweezed" is first interposed, then grasped, then plucked. Often the items being grasped are very small, or located in a position, such that the person using the device is unable to control the interposing of the item between the head of the tweezers. For example, the removal of small hairs from the brow, the ear, or the nose. In addition, items such as splinters are often extremely small and may also be located in areas that are not amenable to easy viewing. The user is often required to just close the tweezers in the area and pull, hoping to remove the offensive splinter, hair, or other small projective item. Operating a tweezers in this manner is not only inefficient, with the user plucking at phantom projections, but often the skin, or other surface may be get inadvertently interposed between the head and when quickly clamped and pulled this can lead not only to a painful result, but it can break the skin causing a small wound.

As can be seen, therefore, the development of a tweezing device that would provide feedback to the user which would be indicative of the size and nature of items interposed between the head, could simplify the tweezing process making it more efficient, faster, safer, and more accurate.

The tweezing device in accordance with the present invention satisfies that need, as well as others, and overcomes deficiencies in previously known techniques.

The more popular and traditional garment belts are typically manufactured with a belt made of a form of leather, such as cowhide, deerskin, lizard skin, ostrich, and so forth. The belt is typically retained about the waist of the wearer and the ends of the belt material are fastened together with a belt buckle. One end of the belt material is fastened to one side of the buckle and the opposing end is referred to as the "tip" of the belt. A row of holes is generally positioned near the tip for engaging the belt buckle to adjust the size of the belt. These holes are typically spaced about three-quarter inch (¾") to one inch (1") apart which are used to engage the hasp of the belt buckle to provide retention.

FIG. 35 illustrates the forces on opposing sides of a belt buckle 1600. A traditional belt buckle has a frame 1612 comprising a proximal end 1614, a distal end 1616, a top section 1618, a bottom section 1620, and a hasp member 1622 which is rotatably attached at a distal end 1624 to the distal end 1614 of buckle frame 1612. Hasp member 1622 has a proximal end 1626 which is unattached and typically shaped to engage/contact the proximal end 1614 of buckle frame 1612 through holes in the belt material. It will be appreciated that belts may be configured with multiple hasps, or utilizing other forms of retention such as pegs, for securely engaging the proximal end of the belt material. The distal end 1616 of buckle frame 1612 is typically attached to the material of the belt by being retained within a loop of the belt material that is sewn to itself. To wear the belt, it is typically inserted through belt loops in the garment and then closed, or fastened, by inserting the tip of the belt through the interior of the buckle and inserting the proximal end 1626 of hasp 1622 into a hole in the belt material that is expected to provide the best fit. When properly fit onto the wearer, the belt will be under a selected level of circumferential tension. This tension also exists across the belt buckle itself, with forces in a first direction 1628*a*, 1628*b* pulling on the distal end 1616 of belt frame 1612 and an opposing force 1630 applied at the hasp/belt interface. It will be appreciated that the forces applied on the distal end 1616 of buckle frame 1612 are shown split into an upper and lower force as the belt material typically is slightly split at the point of attachment with the belt frame to accommodate the rotatable distal end 1624. When a non-compliant belt material is utilized, it will be appreciated that the tension of the belt is determined solely by the setting of hasp 1622.

It will be appreciated that the limited adjustability of the belt often results in the belt being either too tight, causing discomfort, or slightly too loose, causing an unseemly appearance. Placing the holes closer to one another is generally not an option because this weakens the material between the holes and the appearance of the belt is markedly diminished. In addition, the belt wearer may become uncomfortable while wearing the belt, due to changes in body position, or waist circumference, such as caused by the amount of food ingested and so forth. The discomfort may incline the wearer toward changing the belt setting, however, this is not always convenient, since in all but the most casual of surroundings such actions are not generally well received. To increase comfort and eliminate the need to adjust a belt while it is being worn, many belts utilized for casual wear have been made from compliant materials, such as elasticized cloth material. Despite their comfort, elastic belts, have enjoyed only slightly more popularity than clip-on ties. It appears that the buying public would rather suffer the discomfort of a non-compliant belt to gain the aesthetics provided by belts manufactured from traditional materials, such as leather, which have little natural compliance.

Therefore, a need exists for a garment belt with improved comfort and fit while not sacrificing aesthetics. The compliant belt buckle, or belt system, in accordance with the present invention satisfies that need, as well as others, and overcomes deficiencies in previously known techniques.

Garment comfort is a consideration that is important but lags behind issues of safety. One item of apparel that is particularly prone to causing serious injury is the conventional necktie. A necktie is often worn by business persons in many situations. A necktie surrounds the neck of the individual and drapes down in front of the individual. Wearing a conventional necktie poses a safety hazard, because if the extended portions of the tie is caught in a piece of machinery, such as shown in FIG. 43, or grasped by an assailant, the tie becomes a noose and can easily strangle the individual, or cause other forms of injury, such as pulling a portion of the individuals head or torso into contact with a piece of machinery. It will be recognized that the dangling ends of a tie may be easily caught up in machinery such as elevators, paper shredders, copy machines, garbage disposers, and any number of common devices which can cause serious injury or death to the person wearing the tie. Conventional neckties are not constructed to provide for separation at a given tension force, and generally can withstand tension forces exceeding one hundred pounds, often far exceeding this value, prior to breakage. Unfortunately, allowing these high level of tension force to be applied to the neck of the wearer poses a definite threat to safety, since there exists no situation in which the wearer would desire to be subject to such forces. The forces applied during tying and wearing of a tie should be less than 20 lbs, and generally well under about 5 lbs. for a normal (non-Gorilla) individual under everyday conditions. It should also be appreciated that bow-ties, and scarves, designed as neckwear are therefore subject to the same safety issues, although to a lesser extent.

Therefore, a need exists for a method of increasing the safety of ties and scarves, the present invention fulfills, that need as well as others.

BRIEF SUMMARY OF THE INVENTION

The present invention includes a multitasking clock (MTC) that provides a simple mechanism for tracking the accumulation of time (acctime) accorded to each of a plurality of tasks. The clock is portable with a self-contained power supply and occupies less than one hundred cubic inches, wherein it may utilized on a desktop or other convenient location. People in a number of career settings are faced with the prospects of juggling a series of tasks during their work day. Often it is beneficial, or necessary, to track the amount of time accorded to each of these multiple tasks. For example, a consultant may require that the time spent on each of their accounts during a particular day be tracked for billing purposes. A lone entrepreneur may wish to divide their time into specific intervals per day spread across a series of duties, such as marketing, sales, and accounting. Myriad applications exist wherein the tracking of the time spent on an assortment of tasks is either necessary or desirable.

Currently, persons typically record the start and stop times of the various tasks they wish to track during the day, and must spend time recording the times and then tallying the column of numbers at the end of the day. Stop watches provide for the recording of an accumulated time, and some provide split times, wherein the arrivals of each person in a race is given, however, these functions do not facilitate tracking task time. Furthermore, it would be inconvenient for an individual to obtain and use a series of stop watches as they would need to find the stopwatch on which elapsed time was being recorded, cause it to pause, then find the stopwatch for the new task that is to be performed and cause it to continue timing. Further complicating the process is the fact that the few clocks or stop watches that can start and stop a measured interval without resetting it are generally oriented for hand held use at a sporting event and the user interface is not convenient for office use. In addition, use of multiple devices make it difficult to assure that time is being accumulated for a single task only. Computer based time tracking is available, albeit, even a terminate and stay resident program (TSR) such as Time Slips™ requires a number of keystrokes to be entered for the stopping of one task and the opening and starting of another task. In order to switch between tasks to be tracked, time tracking programs generally require that the user open the billing program, open the active task, stop the active task, save the value for the active task, open a selection window, select a new task, or create a new task (filling in a set of fields prior to starting the task), start the new task. It will be readily appreciated that current clocks and methods are not conducive to the tracking of time accumulation for a series of tasks.

The clock of the present invention is capable of conveniently tracking the accumulated time accorded to any series of tasks and shall be referred to herein as a "multitasking clock", or MTC. Users of the clock can readily switch task timing, or start new tasks, with negligible overhead because task switching is performed with a single action, for example rotating the housing, moving a selector, or pressing a button. Many preferred embodiments of the present invention allow for readily shifting from one task to another, preferably with a single action, such as rotating a housing or pressing a selector. Time is a critical metric and expense item today and business people are often very interested in tracking the time spent on various activities. Businesses which charge by billable hours are interested in getting accurately recorded times, which often includes phone calls, for which to bill clients. Entrepreneurs and others that perform multiple duties can use the clock to divide their time among these duties and keep daily and running totals. Use of the multitasking clock does not depend on being in the right screen of a computer application, and so may be used very readily without delay or stress. At any point in time the user can quickly determine the amount of time that has been spent in the different duties. The optional features of the clock allow for performing time calculations, such as the summation of selected task times, addition of fixed times to a time value, conversion of time formats between hours:minutes (HH:MM) to decimal hours (HH.HH), downloading and uploading of information from a PC, and so forth. Another optional feature allows task time to be accumulated in selected periods, such as recording a daily time and keeping a running total for the selected task. Additionally, the user can group any of the tasks into categories, wherein totals may be reflected both in a category or in total of all tasks. Preferably, the multitasking clock is configured to allow the user to write down a task name, or other task information, to be associated with the task, for example writing down a task name adjacent to a task indicator or selector so that a readily modified task reference is available.

Embodiments of the MTC anticipate the desire for more complex functions, which include the following: (1) totaling of selected tasks, (2) saving of prior value, (3) shifting time from one task to another, (4) timing task as MM:SS shifting to HH:MM as time reaches sixty minutes, (5) time calculator, (6) inclusion of conventional calculator, (7) configured to allow task name and information to be attached as a self-adhesive note, (8) configured to allow task name and information to written on electronic ink portion of clock, (9) interfacing with a computer, PDA, network, or other device to communicate time information. Furthermore, the multitasking clock may be manufactured in a variety of sizes and may incorporate, or be incorporated, with other accessories such as tablets, notepads, calendars, paperweights, telephone headset controller, picture frames, day planners, display cases, games, computer keyboards, and so forth.

By way of example, the MTC may be configured as a desk clock in a housing having a series of exterior facets. Accumulated time is accrued for the task associated with a particular orientation of a facet, such as downward (or upward). A person thereby need only change the orientation of the clock housing to stop the timing of one task and to start the timing of another task. The face of the clock is configured so that it can display, in the proper orientation, the accumulated time for any of the plurality of tasks. New tasks can be added by simply rotating the clock to an unused task indicator, or one for a temporary task, such that the time may be readily tracked for a phone call or similar interruption. Additionally, the clock may be configured to display the current time of day in addition to the displayed accumulated time for any task, or when no accumulated times are being displayed.

An object of the invention is to provide for registering the accumulated time spent on each of a plurality of tasks.

Another object of the invention is to allow for the quick selection of a task for which the accumulated time is to be registered.

Another object of the invention is to allow for single-action switching between tasks whose time is being tracked.

Another object of the invention is to allow for switching between tasks in response to rotation of the unit.

Another object of the invention is to provide a multiple-task recording clock that may be readily manufactured and which is attractive, reliable, and low cost.

Another object of the invention is to provide a task recordation clock that optionally provides a sum of the accumulated times being recorded.

Another object of the invention is to provide a multitasking clock that is capable of recording multiple temporary acctimes for later recall.

Another object of the invention is to provide a multitasking clock that is capable of recording voice annotations, which may be associated with individual tasks or temporary tasks.

Another object of the invention is to provide a multiple-task recording clock upon which each of the plurality of tasks available for selection is visible.

Another object of the invention is to provide a multitasking clock in which task names and/or notes may be written by the user adjacent to a task selector.

Another object of the invention is to provide a task recordation clock that allows the user to write task information on self-adhesive notes for adherence adjacent a task selector or indicator.

Another object of the invention is to provide a task recordation clock that may be implemented with either analog or digital display faces.

Another object of the invention is to provide a multitasking clock capable of registering acctimes, time of day, and numeric calculation data on a single calculator display.

Another object of the invention is to provide a task recordation clock that may be implemented with a flip-flop digital display face whose character up/down orientation is determined by the position of the multitasking clock.

Another object of the invention is to provide a task recordation clock that may be implemented with an analog LCD display face.

Another object of the invention is to provide a task recordation clock that may be implemented with an analog LCD display face whose hour dial markings may be reconfigured according to the rotated position of the multitasking clock.

Another object of the invention is to provide a multitasking clock in which task information may be written with an electrode stylus upon areas comprising electronic ink and erased electronically.

Another object of the invention is to provide a multitasking clock in acctimes and time of day may be displayed with a display comprising electronic ink.

Another object of the invention is to provide a task recordation clock that optionally provides for the retention of writing material for the recording of task name and information.

Another object of the invention is to provide a task recordation clock that optionally provides an interface to other devices, such as personal computers, wherein information may communicated such as for loading into a billing program.

Another object of the invention is to provide a multitasking clock upon which a time calculator may be incorporated.

Another object of the invention is to provide a multitasking clock upon which a numeric calculator may be incorporated.

Further objects and advantages of the invention will be brought out in the following portions of the specification, wherein the detailed description is for the purpose of fully disclosing preferred embodiments of the invention without placing limitations thereon.

The present invention includes a tweezing device that provides feedback responsive to the interposition of items within the head, such that selective and accurate grasping/tweezing may be performed. The tweezing device is configured with a plurality of sensors in the head that detect characteristics of the interposing items. The characteristics may be such as depth, width, pressure, color, or other characteristics. The electronics interprets signals from the sensor to determine characteristics of the interposing item, after which it generates user feedback so that the user can more accurately grasp items in a more efficiently, safe manner. It will be appreciated that users with poor eyesight will be aided by the registration of small hard to see objects, which facilitates their ability to "tweeze".

By way of example and not of limitation, an embodiment of the device provides a small tweezing apparatus with a self-contained power supply, having a series of optical sensors for registering interjecting objects between the opposing members within the head. The optical sensors register the presence, and preferably the size (width), number, and position of small objects interposed between the head portions. Feedback on size, number, and location of an objects to be tweezed allows the user to decide if they have the correct object, the right number of objects (such as one), the right type of object (e.g. hair instead of a fold of skin), and are properly aligned to remove the item with the tweezing head. Small objects which interject between the head portions block a portion of the light between a light source and a detector which allow for registration of the object. The light source and detector are preferably coupled to the small head of the tweezers with light-conducting pipes, such as sections of optical fibers. The electronic circuit of the device registers the changes in received light for each of the sensors in order to detect objects breaking the light path. The nature of the interposing item is characterized, for example, according to size (i.e. skin, single hair, multiple hair, void) and feedback is provided to the user through an indicator adapted to alert the user of the apparatus, for instance the generation of audio tone patterns associated with the character of the interposing item. It will be appreciated that the indicator may take other forms, such as visual, tactile, and combinations thereof.

Another aspect of the invention provides for the automatic tweezing of a hair or other small object being interjected at the tweezing head. The head portions of the tweezers are configured to move in a manner that pulls on the item being grasped toward the base of the tweezers, so that the tweezers themselves need not be moved by the user to "pluck" an item. This automatic tweezing is herein referred to as "autotweeze" and it can greatly speed up the tweezing process. By way of example, the autotweeze mechanism is triggered by the user, such as in response to a pulse of pressure applied to the handles of the tweezers after the optical head had registered the presence of an item interjected between the halves of the tweezing head. Preferably the motion of the head portions during autotweezing causes them to engage a cleaning member which removes the hair or other interjecting member that is being tweezed, so that the tweezers is prepared for a subsequent operation.

An object of the invention is to provide a tweezing device that is capable of registering the interposing of items within the head.

Another object of the invention is to provide a tweezing device that is capable of providing feedback as to the character of the item being interposed within the head.

Another object of the invention is to provide a tweezing device that provides user feedback that allows the user to determine if the correct item is interposed between the head and ready for being plucked.

Another object of the invention is to provide a tweezing device that provides user feedback while being reliable and inexpensive to manufacture.

Another object of the invention is to provide a tweezing device that provides user feedback and may be battery operated.

Another object of the invention is to provide a method of providing feedback for a tweezing device while additionally providing tightly focused light near the tweezers head.

Another object of the invention is to provide a method of providing feedback for a tweezing device whose operation and accuracy are not unknowingly comprised by environmental contaminants.

Another object of the invention is to provide a method of providing feedback for a tweezing device that provides internal calibration to minimize feedback generation in response to atypical device conditions, such as low battery, optical sensor damage, light source damage, head alignment error and so forth.

Another object of the invention is to provide a tweezing device whose power is activated by contacting the head portions with one another, and that shuts off automatically subsequent to use.

Another object of the invention is to provide a tweezing device that provides user feedback while being easy to use.

Another object of the invention is to provide a method of providing feedback for a tweezing device that is applicable to any form of tweezing or similar precision grasping device.

Another object of the invention is to provide a tweezing apparatus which can automatically pluck an interjecting item between the halves of the head in response to user input.

Another object of the invention is to provide a tweezing apparatus with an automatic plucking mechanism which is self cleaning.

Further objects and advantages of the invention will be brought out in the following portions of the specification, wherein the detailed description is for the purpose of fully disclosing preferred embodiments of the invention without placing limitations thereon.

The present invention includes a belt buckle, or belt with buckle, that introduces a limited amount of compliancy into the belt system without the need to utilize a stretchy belt material. A belt buckle of the present invention having a substantially rigid frame is configured with a compliant means which allows the circumference of the belt and buckle system at a given setting to stretch under circumferential tension. The belt buckle of the invention adds at least one compliant member into the permanent buckle/belt interface at the distal end 16 of buckle frame 12. The belt buckle is provided with a first and second belt attach location. The first belt attach location is provided for substantially permanently attaching said belt material, such as by encircling it with a loop of the leather or other material of the belt. The second belt attach location is provided with a fastener, such as a clasp, or other type of cinching device to secure the belt loop at a first circumference. Under the action of expansive circumferential tension force, the compliant member is urged to move such that the circumference of the combination belt and buckle increases, to a second circumference, and reduces the applied tension force, which increases the comfort of the wearer.

The compliant member allows the belt to be aesthetically retained at a proper tension while not subjecting the wearer to undue constriction. The amount of compliance provided by the buckle of the present invention is at least approximately one-eighth inch while being less than approximately one inch. The preferred amount of compliance is approximately one-half inch, although in certain styles and sizes this much compliance can be difficult to achieve without beginning to sacrifice aesthetics. The amount of compliance allowed further depends on the style and size of the buckle utilized. It will be appreciated that providing up to one-half inch of stretch will increase belt comfort, simplify achieving a correct fit, and aid in retaining belt aesthetics despite slight changes in waist circumference. By way of example, the loop of the belt material, into which the distal end 16 of buckle frame 12 is permanently retained, is configured to engage a compliant member. The compliant member may be implemented using a variety of structures and materials. Compressible materials, such as high-density foam may be retained between the interior of the loop of belt material and the distal end 16 of buckle frame 12. The compressible material is preferably retained in some manner to either belt material or the frame to prevent shifting or loss. The belt buckle can be configured with a mechanically compliant member that is capable of moving in response to the amount of circumferential force being applied through the attached belt material. The present invention may be utilized within belts configured with either conventional bar hasps, or dress belts utilizing peg style hasps.

An object of the invention is to increase the compliance of a garment belt in increase comfort.

Another object of the invention is to increase compliance of a garment belt to improve the fit and thereby the aesthetics of the belt without adding more holes to the belt material.

Further objects and advantages of the invention will be brought out in the following portions of the specification, wherein the detailed description is for the purpose of fully disclosing preferred embodiments of the invention without placing limitations thereon.

The present invention includes a tension-controlled dress tie, bow-tie, or scarf, that upon being subjected to a predetermined level of tension (under 100 lbs. and preferably in the 20–40 lb. range) that fully or partially separates under tension so as to eliminate the possibility of strangulation, or other injury, to the wearer. By way of example, these garments may be easily manufactured by creating the tie in one or more discrete portions which are joined by a tension-controlled fastening means. The tension controlled fastening means may provide a one-time release (destructive) or a non-destructive release that allows the tie to be manually reassembled and reused thereafter. One example of a tension controlled fastening means can be implemented with a hook-and-loop fastener, or with snaps, that connect portions of the tie to one another, wherein the application of at least a predetermined level of tension causes the tie portions to separate, thereby preventing injury to occur to the neck of the wearer. Use of a non-destructively separating tension release joint which can be manually reassembled provides an additional benefit in that a small section of the tie material maybe configured with complementary fasteners on each end which may be inserted between portions of the tie to extend its length, as it will be appreciated that the proper length of a tie depends on the height of the individual upon which it is being worn. Another example of a tension-controlled fastening means is the use of a tear-away seam (destructive separation), wherein a minimal number of strands of a low-strength thread is utilized to retain the separate portions of the tie during wear and which thereby separate under at least a given level of tension to prevent wearer strangulation. The predetermined separation tension for a particular tie implementation should be determined through testing to assure that it lies within a safe range and provides repeatable separation.

An object of the present invention is to reduce the occurrence of deaths and injuries resulting from neckties being grasped manually or caught in machinery, such that the wearer is subject to strangulation, or other injury.

Another object of the present invention is to provide a safety tie, or scarf, that may be easily manufactured with convention equipment.

Another object of the present invention is to provide a safety tie, or scarf, that may be fabricated to appear conventional and to follow existing styles.

Another object of the present invention is to provide a safety tie, or scarf, that may be reused after a separation in a tension-incident.

Another object of the present invention is to provide a safety tie, or scarf, that may be inexpensively manufactured.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

FIG, 10 is a front view of a button-selection mode multitasking clock according to an embodiment of the present invention, shown with a plurality of task selection buttons instead of the registration of unit orientation.

Figure 11:
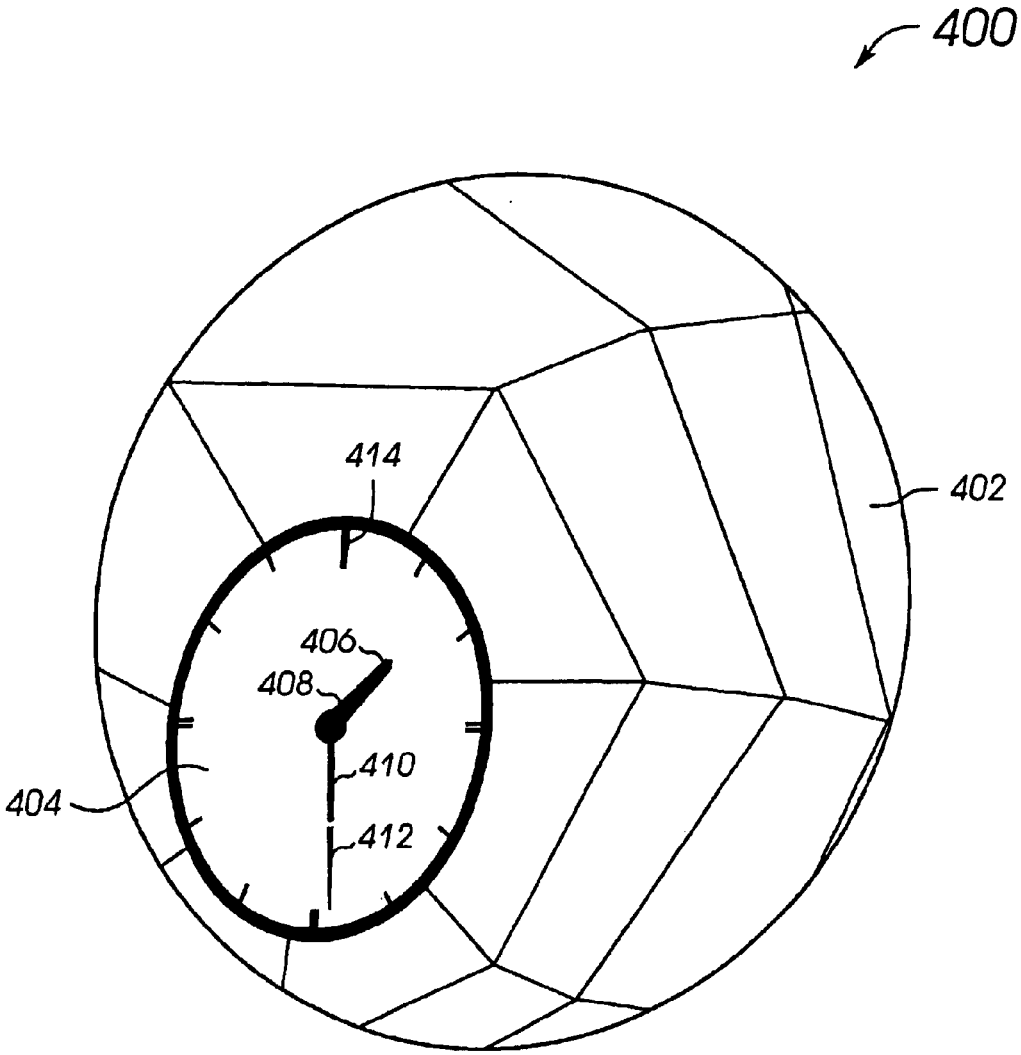

FIG. 11 is a front view of a generally spherical multitasking clock according to an embodiment of the present invention, shown having facets positioned in more than one plane to which task selection is responsive.

Figure 12:
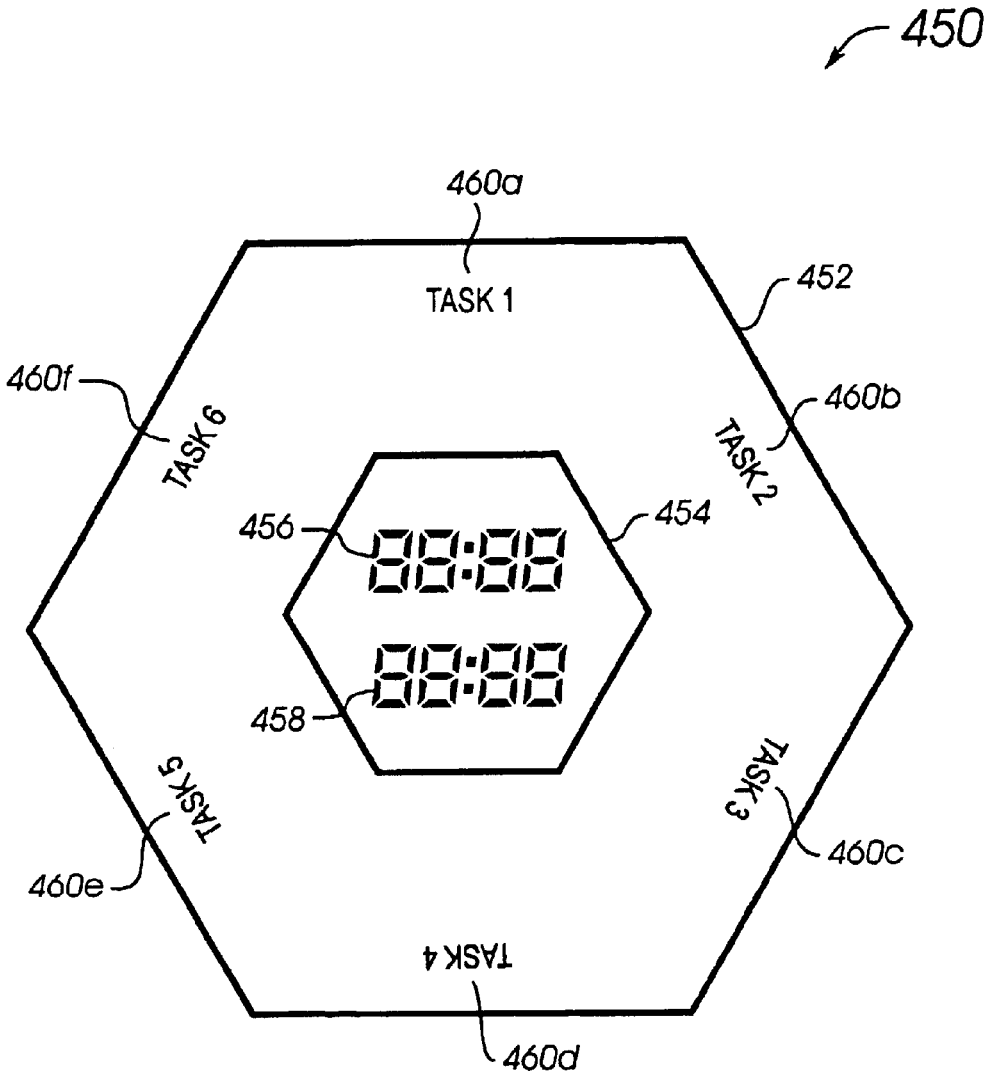

FIG. 12 is a front view of a rotating multitasking clock according to an embodiment of the present invention, shown with a bi-direction dual-seven segment display capable of inverted display in response to an inverted orientation.

Figure 13:
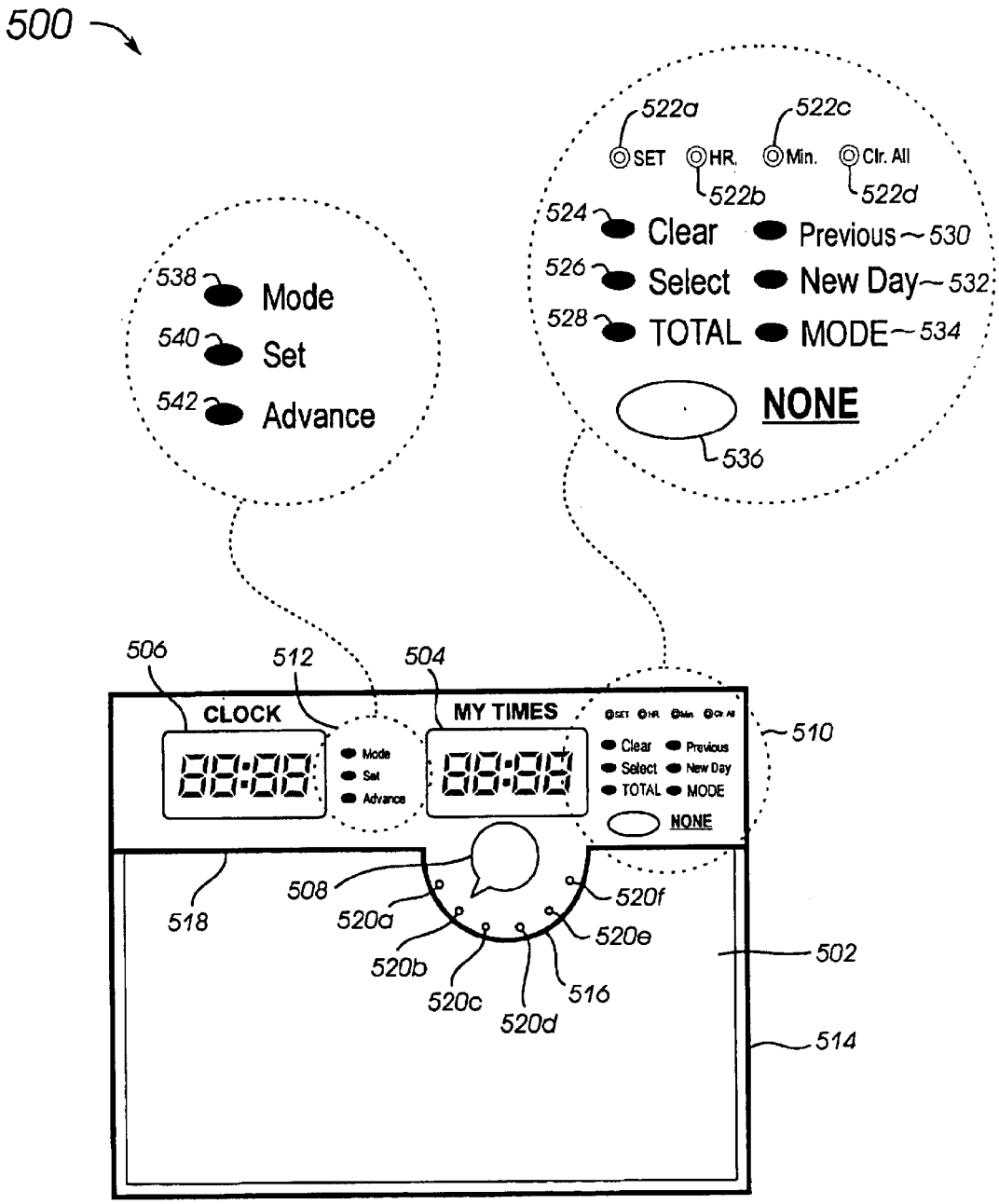

FIG. 13 is a front view of a multitasking clock configured with a rotating task selector according to an embodiment of the present invention, shown with a time of day clock and a writing surface adjacent the task selector.

Figure 14:
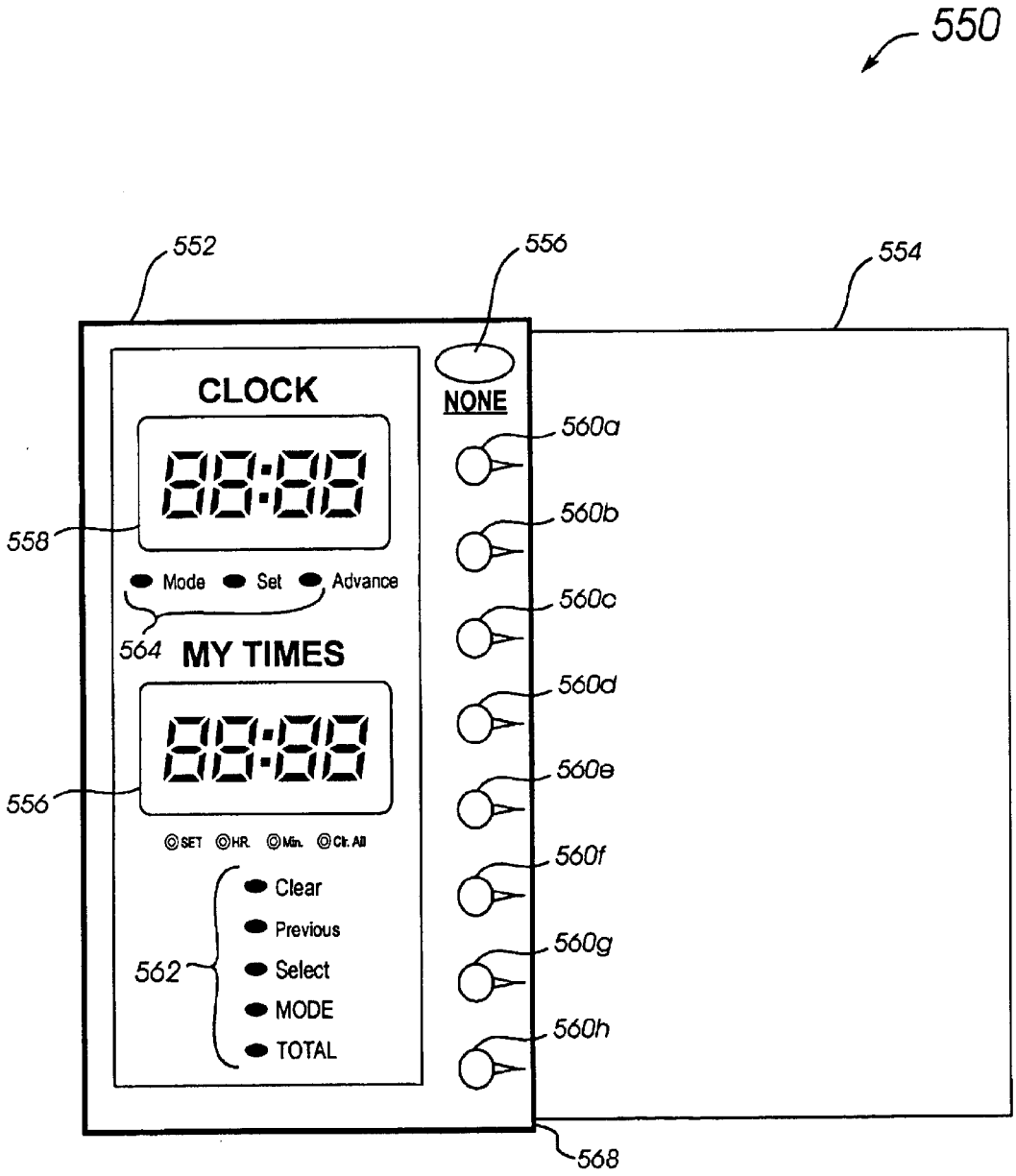

FIG. 14 is a front view of a multitasking clock configured with a button-style task selector according to an embodiment of the present invention, shown with a time of day clock and a writing surface adjacent the task selector.

Figure 15:
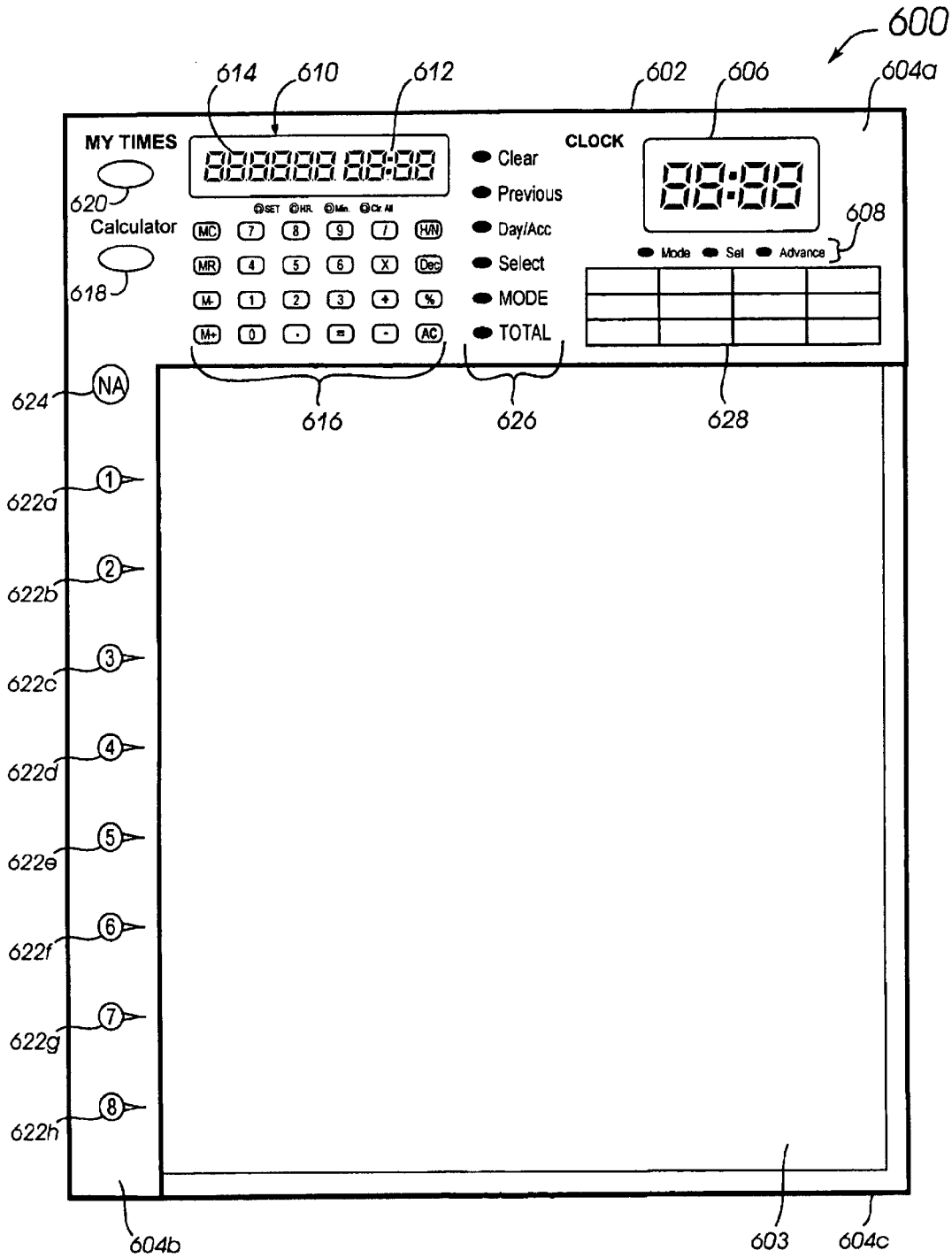

FIG. 15 is a front view of a multitasking clock configured with a button-style task selector, clock, and calculator functions according to an embodiment of the present invention, shown with a tablet style writing surface adjacent the task selector.

Figure 16:
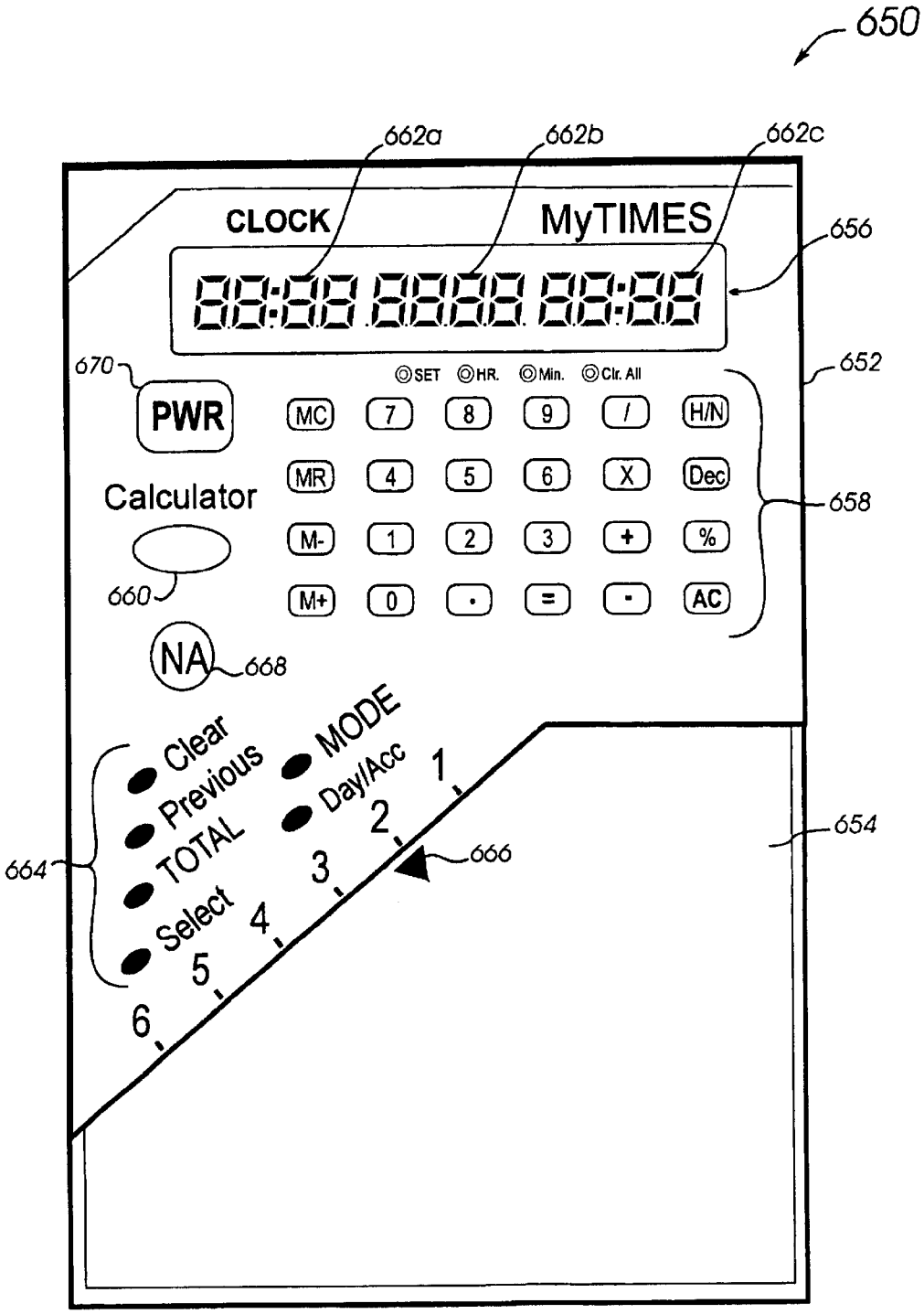

FIG. 16 is a front view of a multitasking clock configured with a sliding task selector, clock, and calculator functions according to an embodiment of the present invention, shown with a small writing surface adjacent the task selector.

Figure 17:
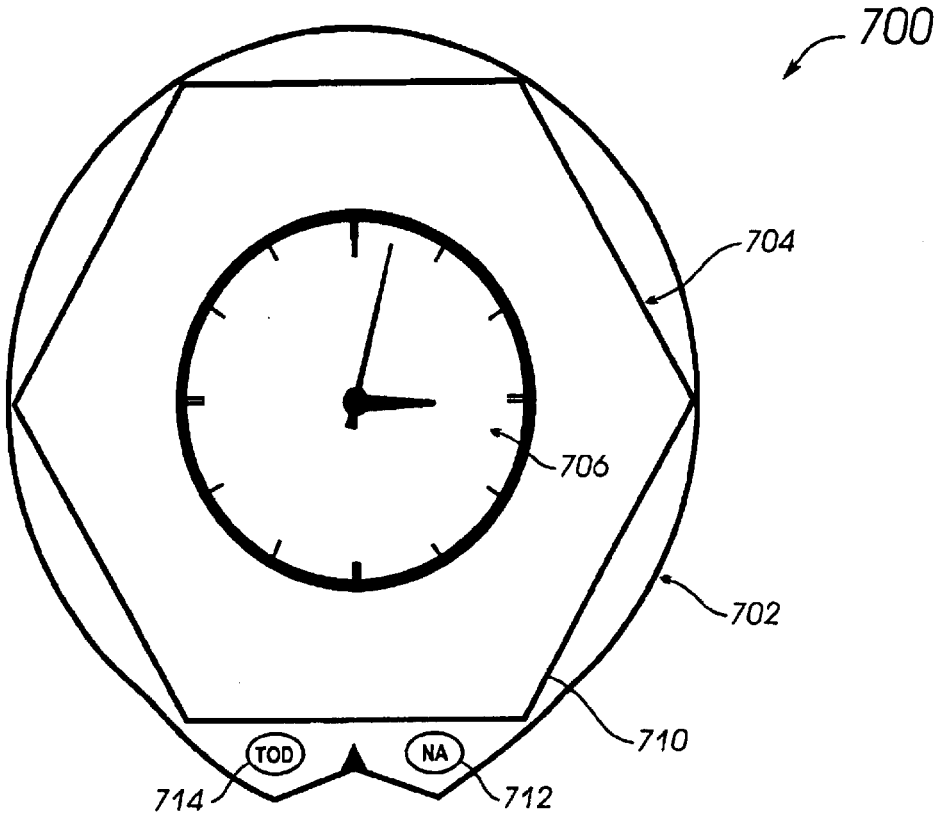

FIG. 17 is a front view of a vertical hexagonal multitasking clock configured with a rotating top portion for task selection according to an embodiment of the present invention, shown with an analog clock face.

Figure 18:
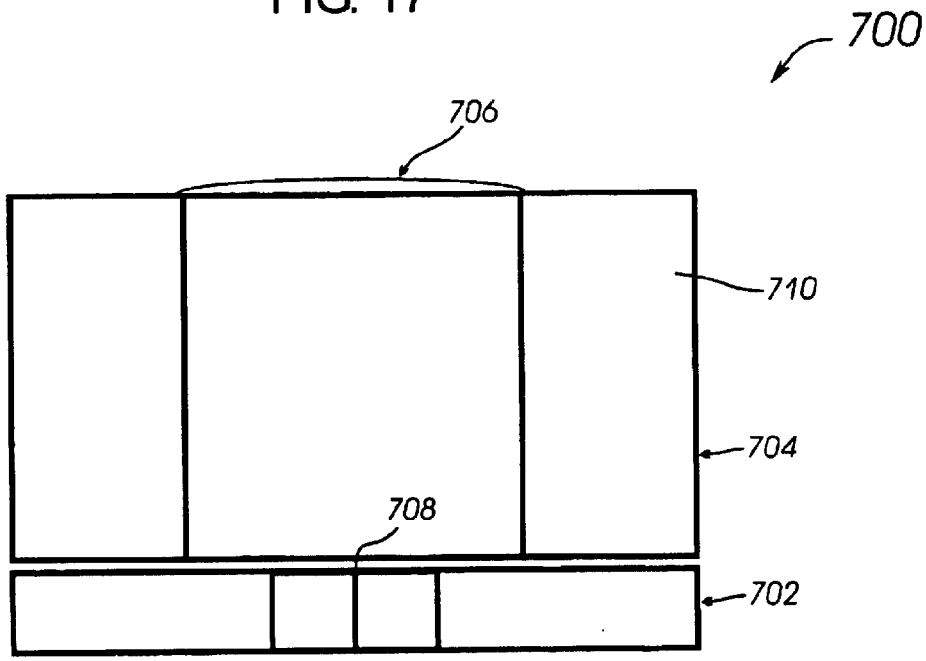

FIG. 18 is a side view of the vertical multitasking clock of FIG. 17.

Figure 19:
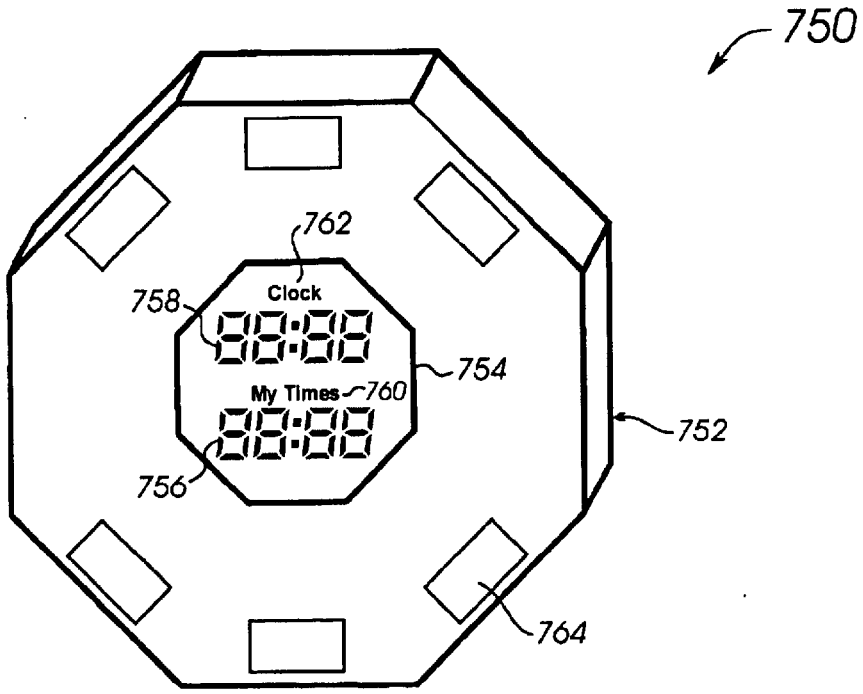

FIG. 19 is a front view of a rotatable octagonal multitasking clock configured with a dual digital flip-flopping display according to an embodiment of the present invention, shown for the timing of up to six tasks.

Figure 20:
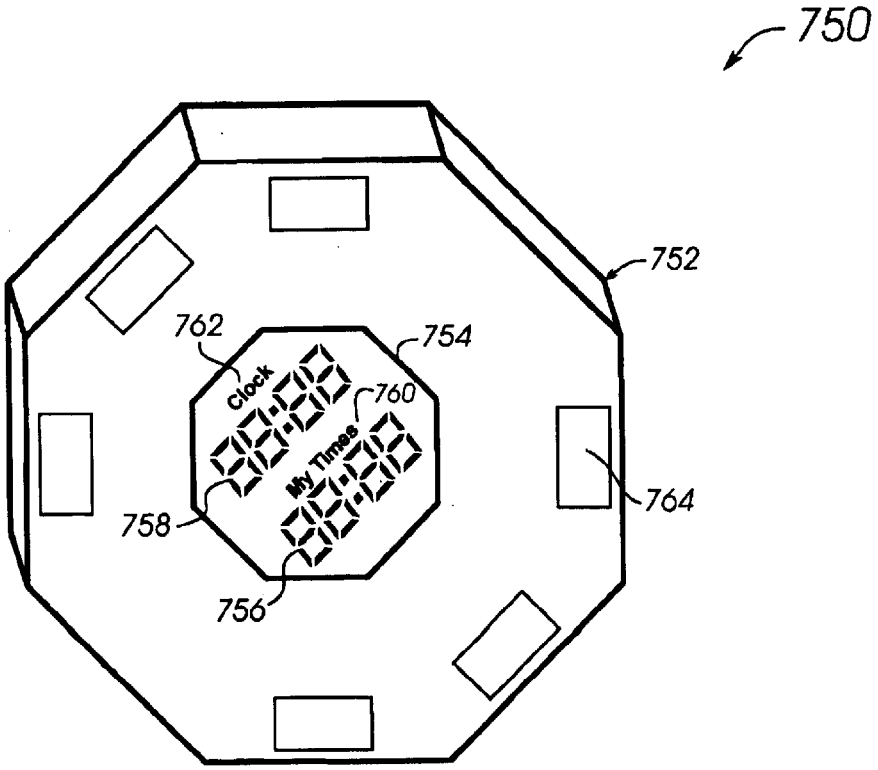

FIG. 20 is a front view of the rotatable octagonal multitasking clock of FIG. 19, shown rotated to time a different task than shown in FIG. 19.

Figure 21:
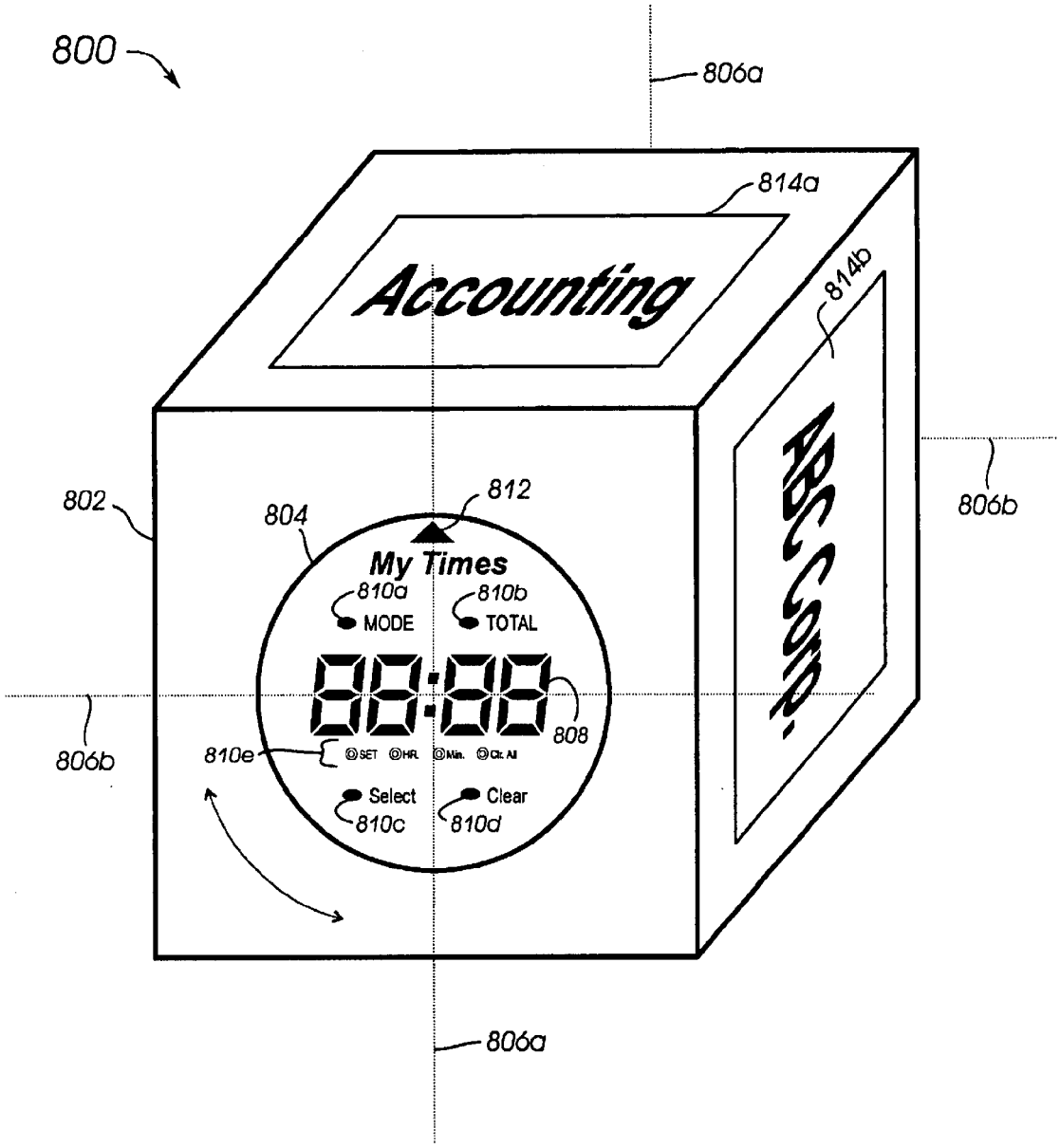

FIG. 21 is a perspective view of a rotatable cubical multitasking clock configured with a rotating digital display according to an embodiment of the present invention, shown with adhesive-backed task notes attached.

Figure 22:
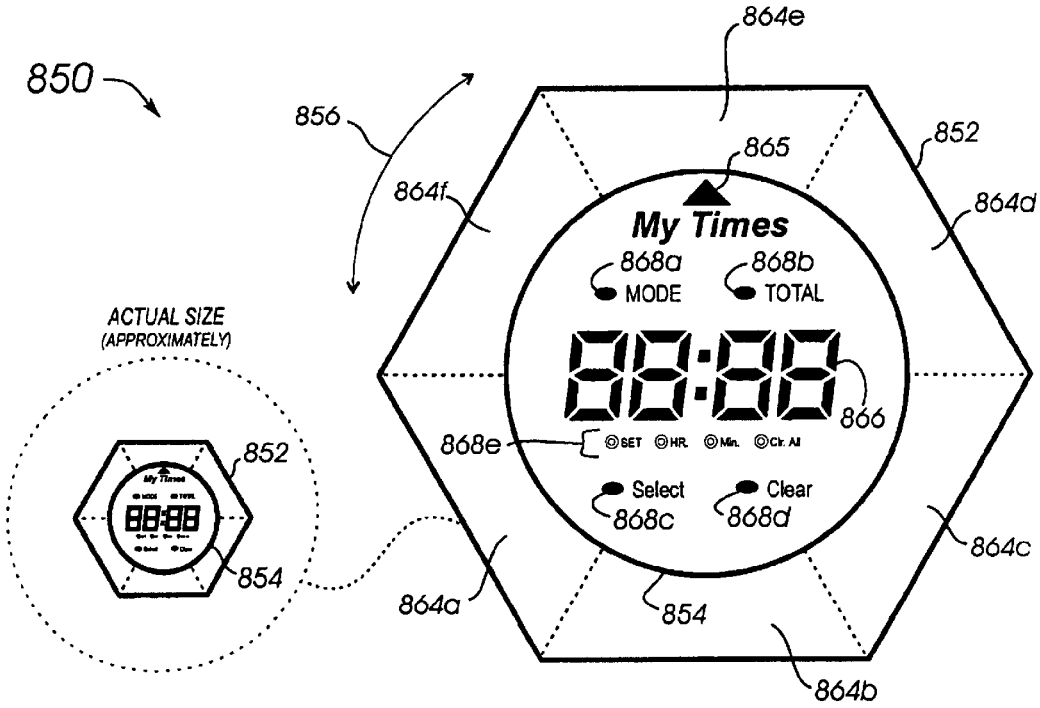

FIG. 22 is a facing view of a small multitasking clock configured with a surrounding rotating hexagonal task selector according to an embodiment of the present invention.

Figure 23:
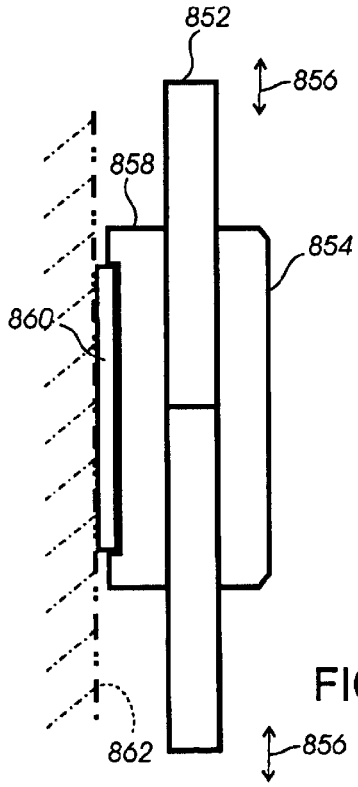

FIG. 23 is side view of the small multitasking clock of FIG. 22 shown attached to a vertical surface.

Figure 24:
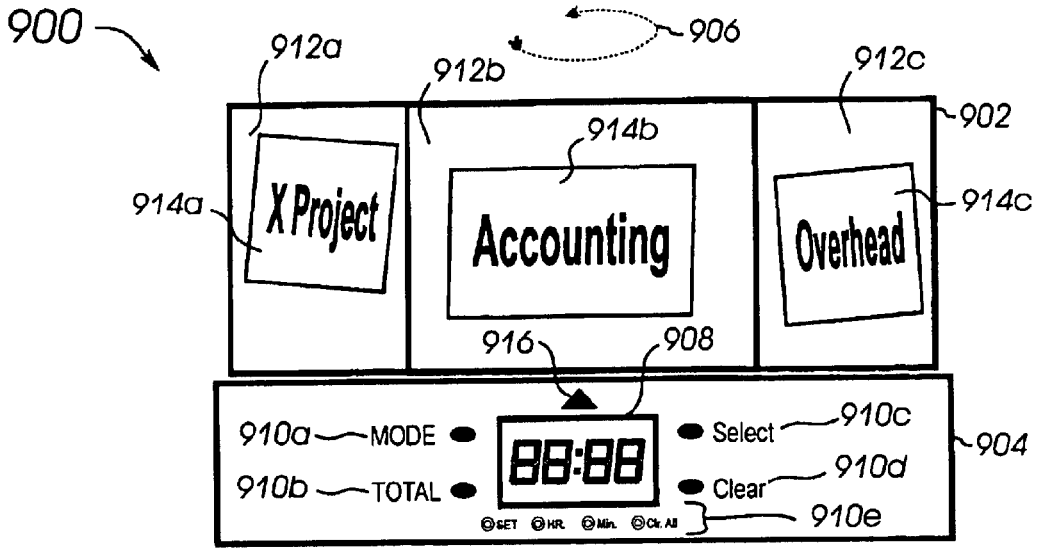

FIG. 24 is a facing view of a hexagonal vertical multitasking clock having a rotatable upper housing for retaining task notes above a fixed display according to an embodiment of the present invention, shown with task notes attached to upper surface.

Figure 25:
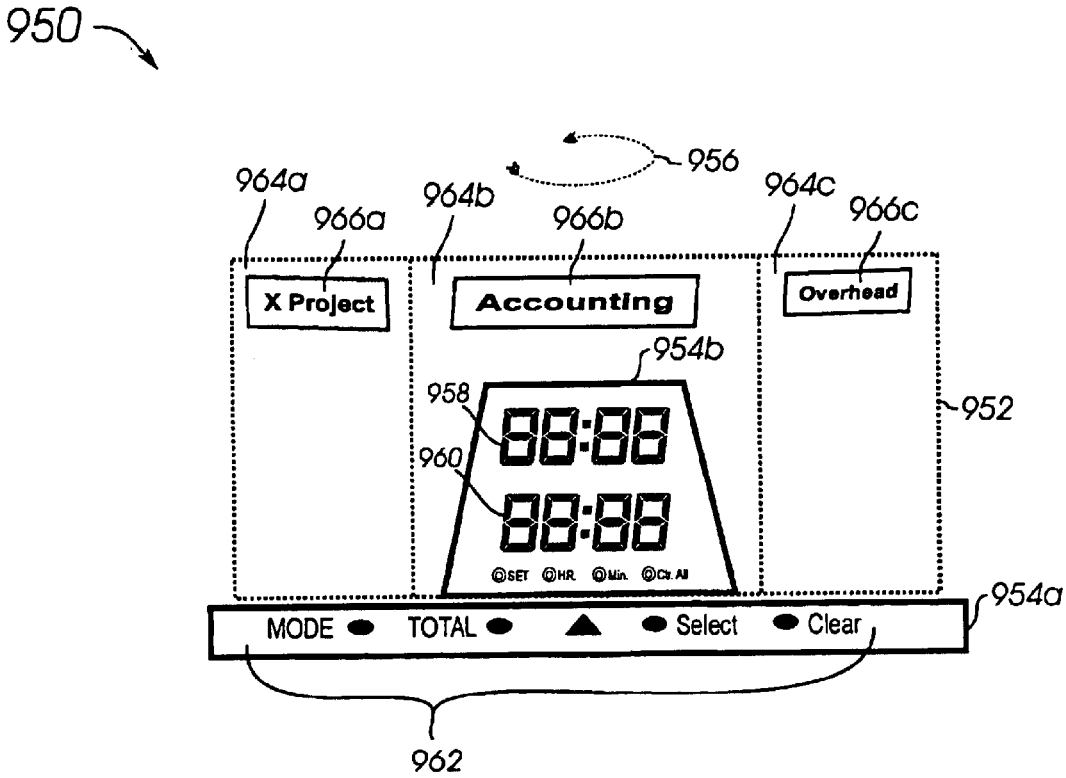

FIG. 25 is a facing view of a hexagonal vertical multitasking clock having a rotatable substantially transparent upper housing for retaining task notes and enclosing a time display and a multitask clock display according to an embodiment of the present invention, shown with task notes attached to upper surface.

Figure 26:
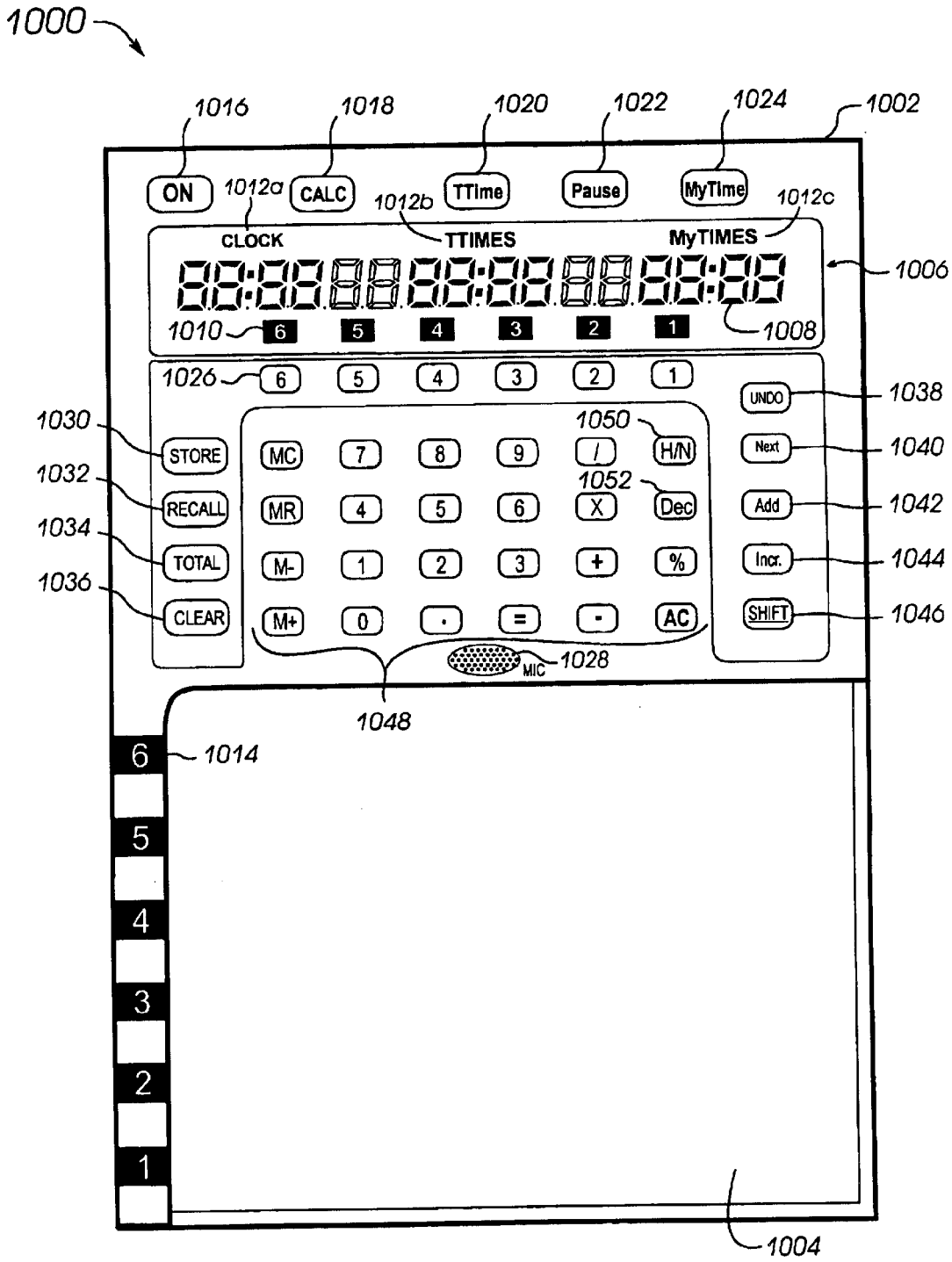

FIG. 26 is a facing view of a multitasking clock configured with time of day clock, calculator, voice recording capability, and user notation areas associated with task selectors according to an embodiment of the present invention.

Figure 27:
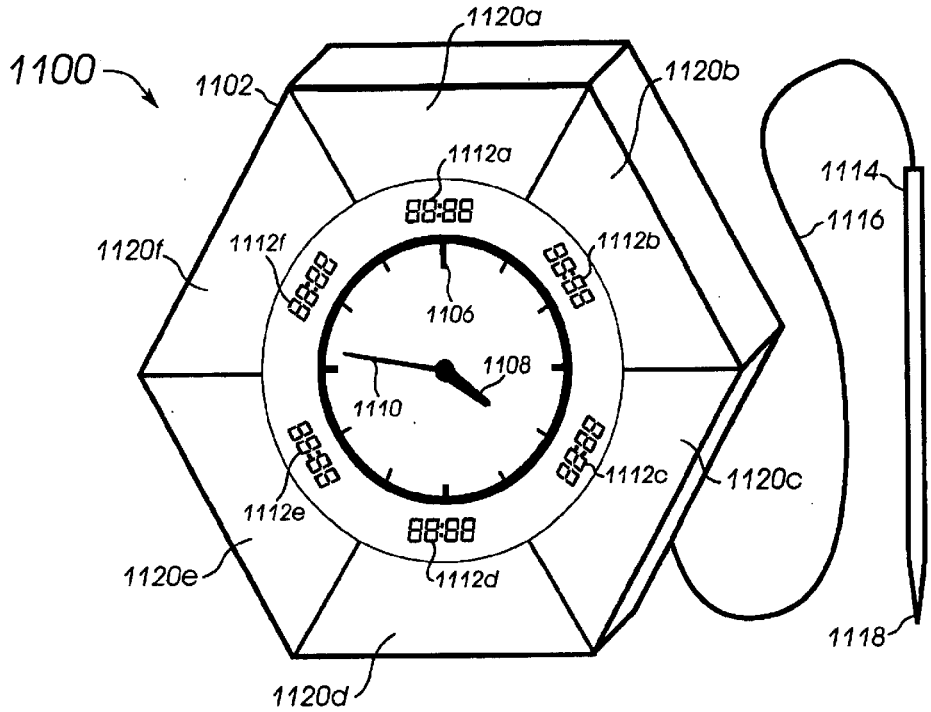

FIG. 27 is a facing view of a hexagonal multitasking clock with an analog display which utilizes electronic ink to form portions of the display according to an aspect of the present invention, shown with a stylus for noting task name and information on portions of the electronic ink regions.

Figure 28:
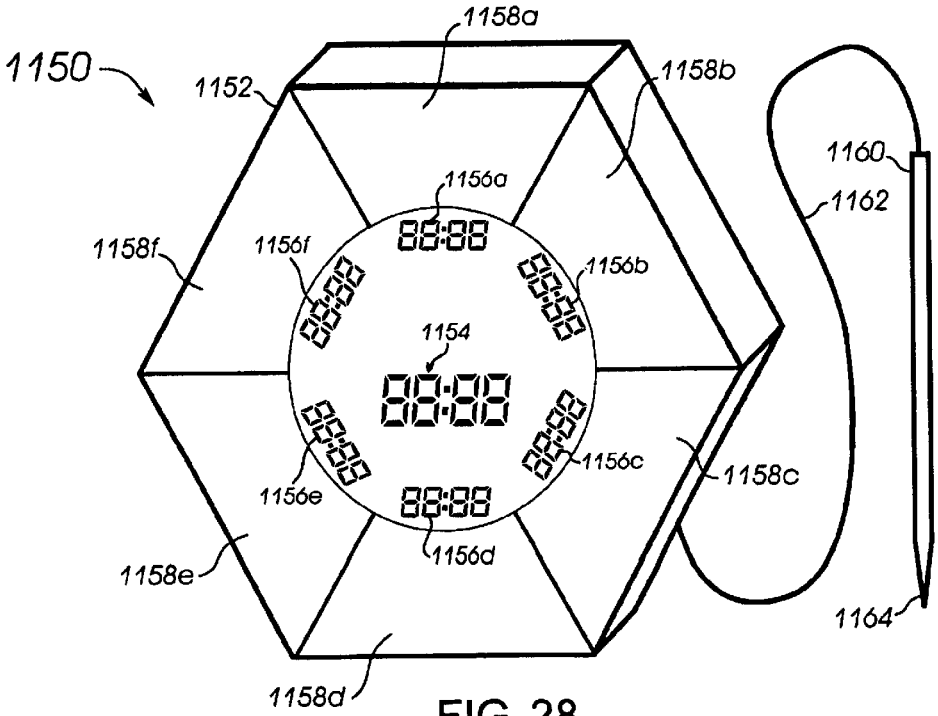

FIG. 28 is a facing view of a hexagonal multitasking clock with a digital display which utilizes electronic ink to form portions of the display according to an aspect of the present invention, shown with a stylus for noting task name and information on portions of the electronic ink regions.

Figure 29:
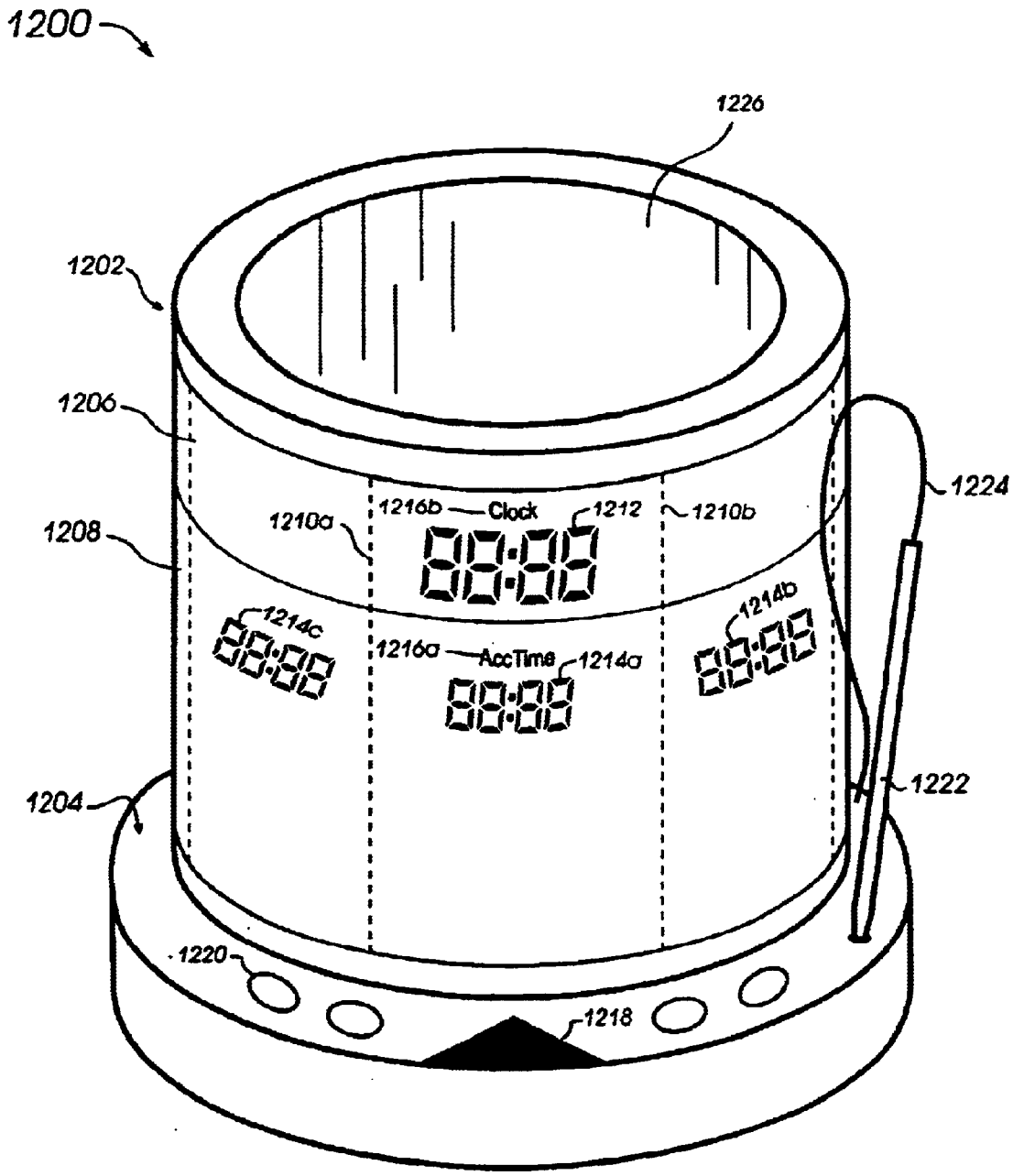

FIG. 29 is a perspective view of a multitasking clock configured as a vertical cylinder configured with electronic ink areas, and capable of displaying task information about a rotating cylindrical section according to an embodiment of the present invention.

Figure 30:
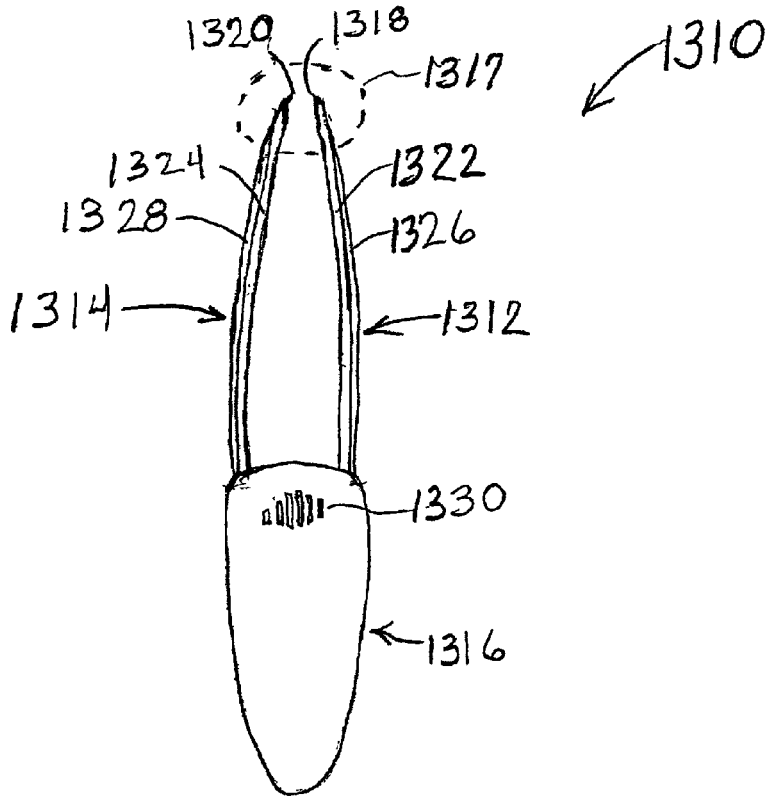

FIG. 30 is a front plan view of a cosmetic tweezers device according to an embodiment of the present invention, shown for providing feedback in the form of audio while concurrently lighting the head area of the tweezers.

Figure 31:
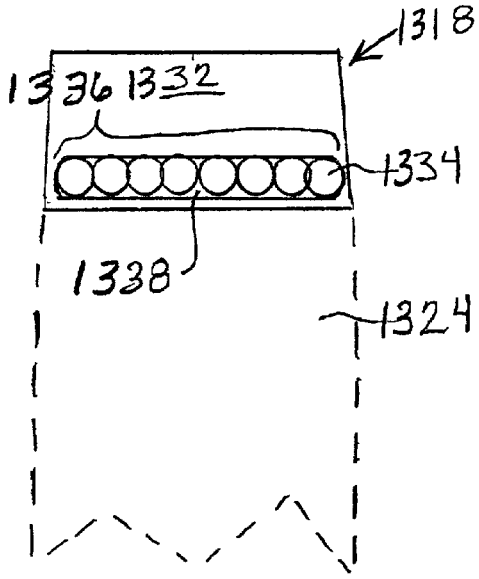

FIG. 31 is a detailed plan view of a first half of a tweezing head having sensors according to an embodiment of the present invention, wherein a series of optical fibers provide light conduits for the optical sensing.

Figure 32:
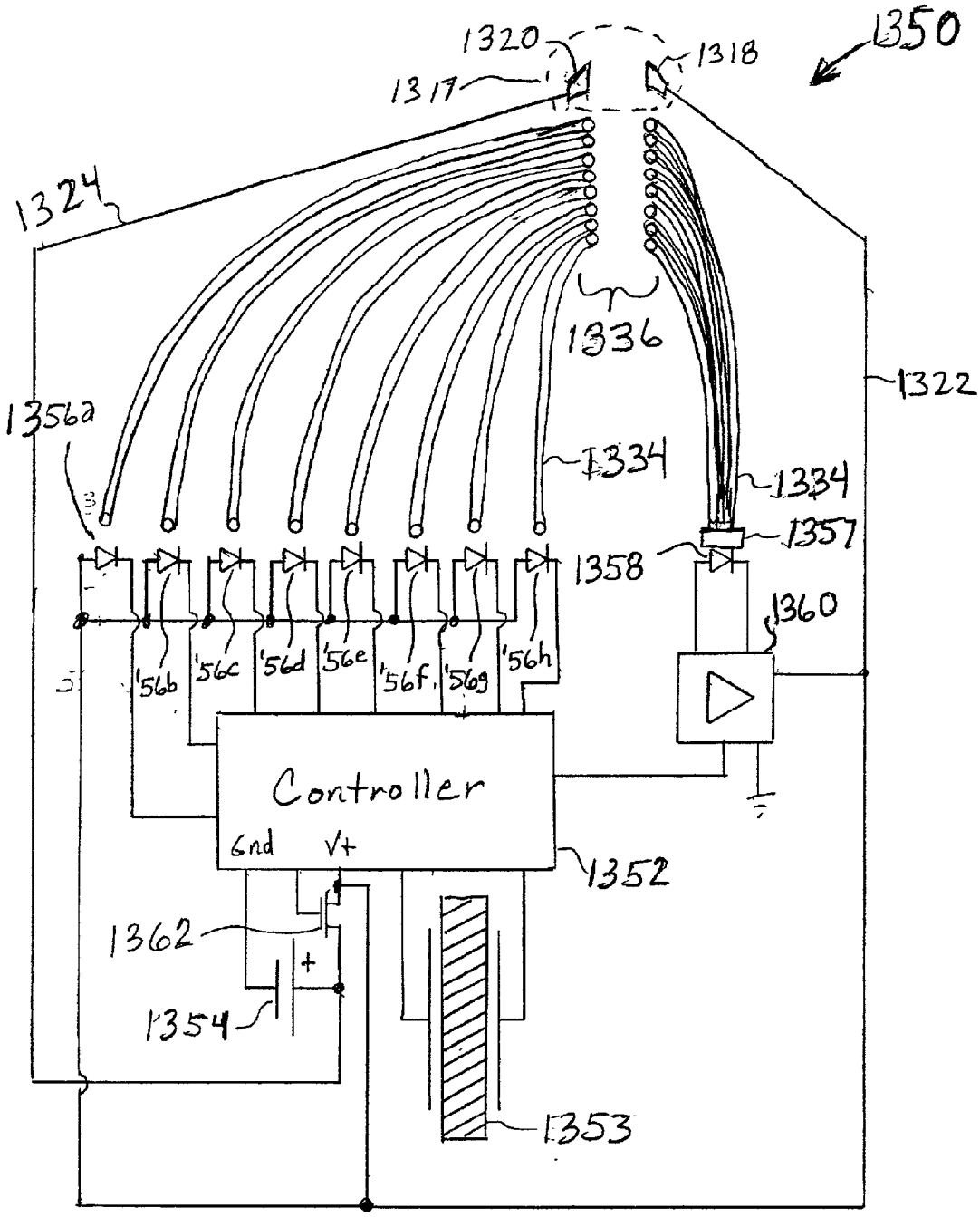

FIG. 32 is a schematic of a sensor and feedback circuit according to an embodiment of the present invention and shown utilizing a microcontroller and light pipes from the head to remote light sources and sensors.

Figure 33:
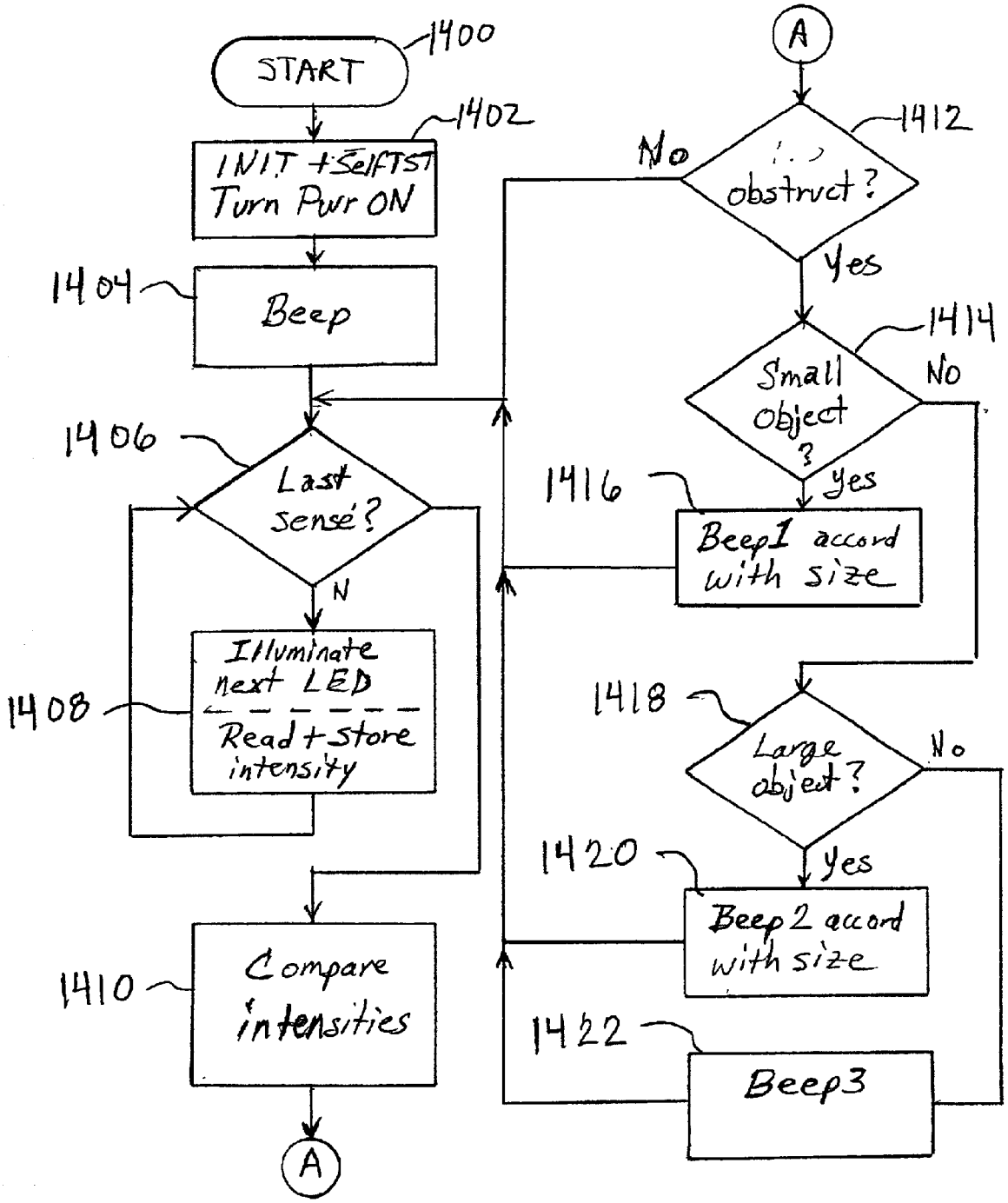

FIG. 33 is a flowchart of tweezing device program flow according to an embodiment of the present invention.

Figure 34:
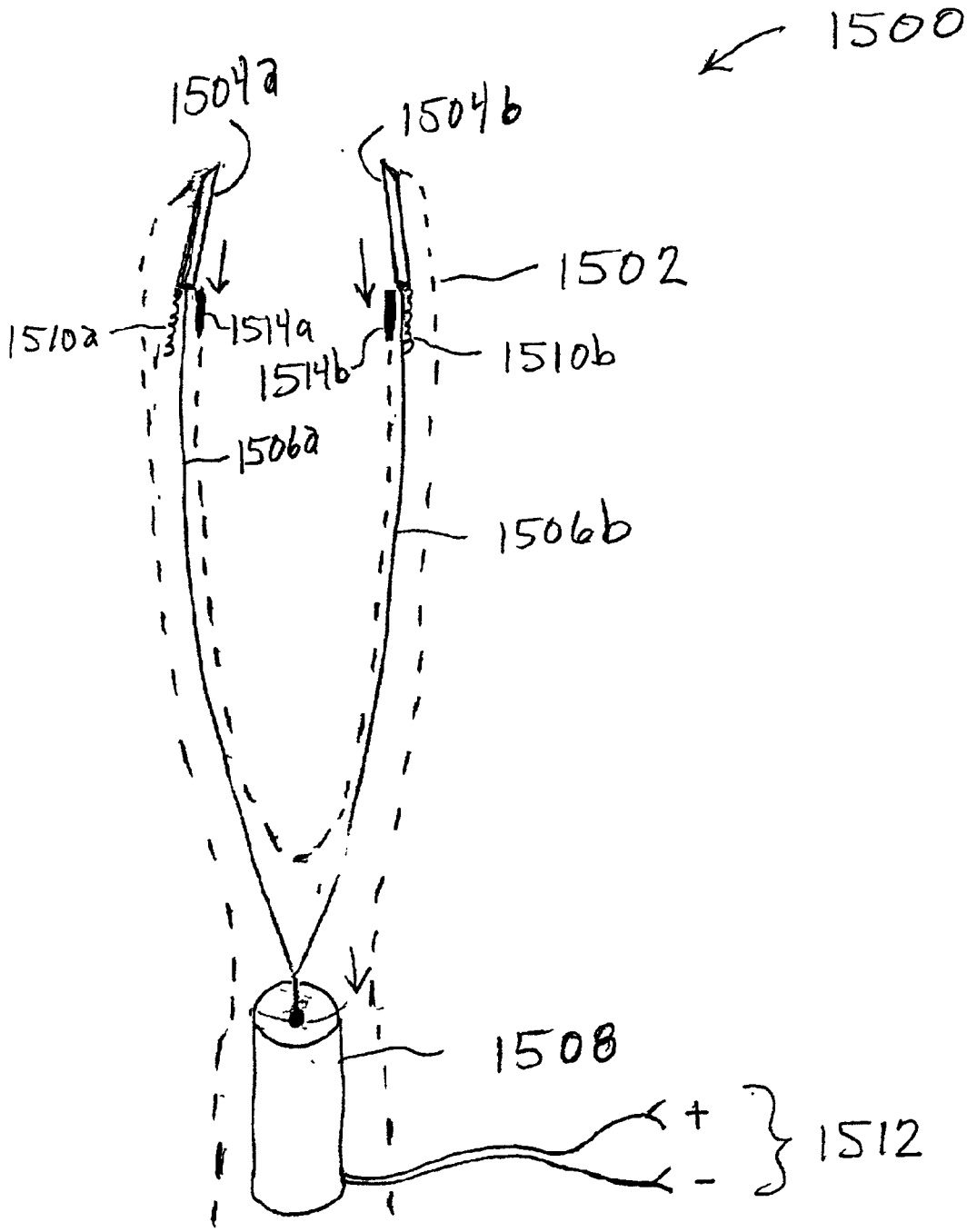

FIG. 34 is a front view of an automatic tweezing mechanism according to an aspect of the present invention, shown with slidable tweezing heads positioned within a tweezers housing shown in phantom.

Figure 35:
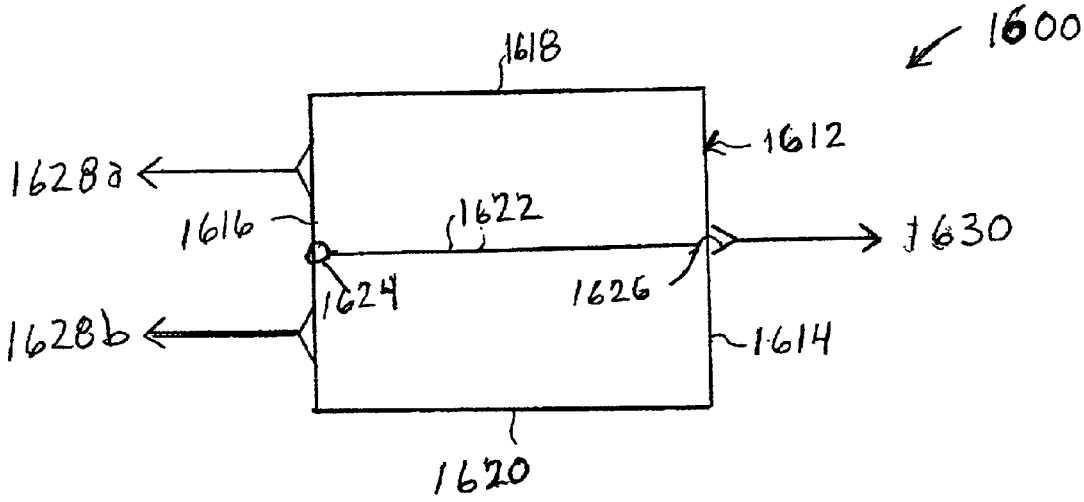

FIG. 35 is a schematic view of a conventional belt buckle subject to circumferential forces applied by the belt material.

Figure 36:
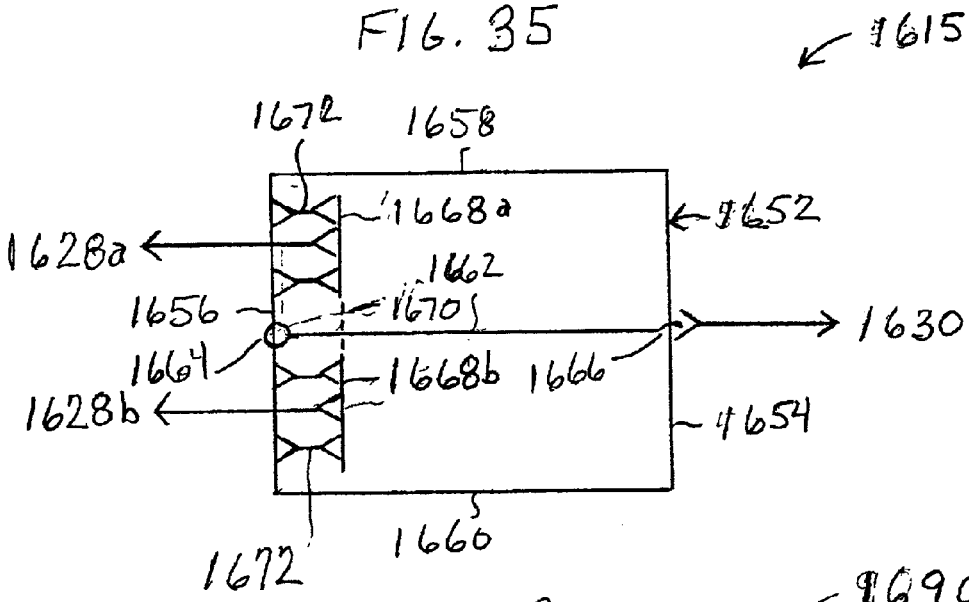

FIG. 36 is a schematic of a belt buckle which is configured with a compressibly compliant member according to an embodiment of the present invention.

Figure 37:
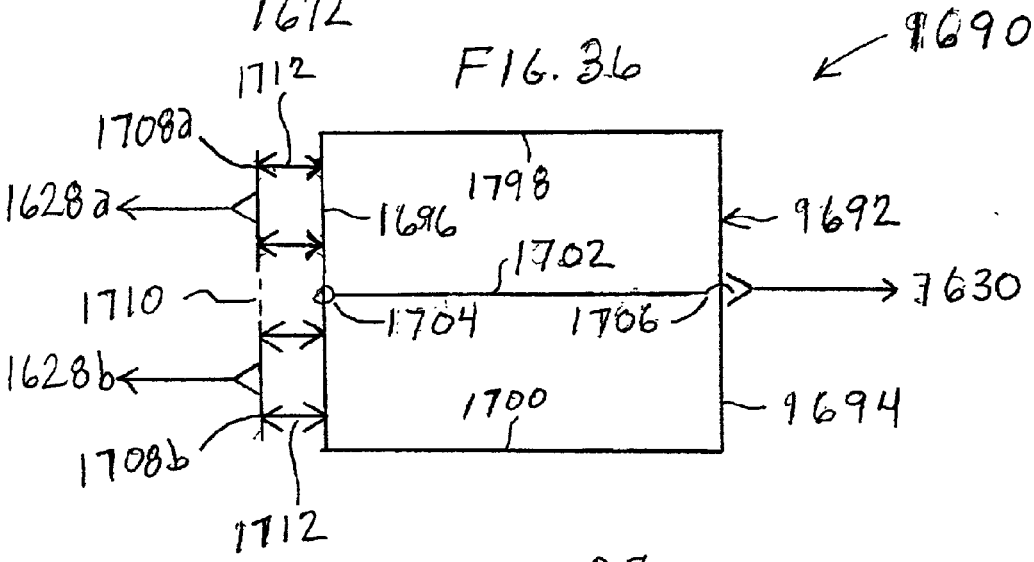

FIG. 37 is a schematic of a belt buckle which is configured with a expandably compliant member according to an embodiment of the present invention.

Figure 38A:
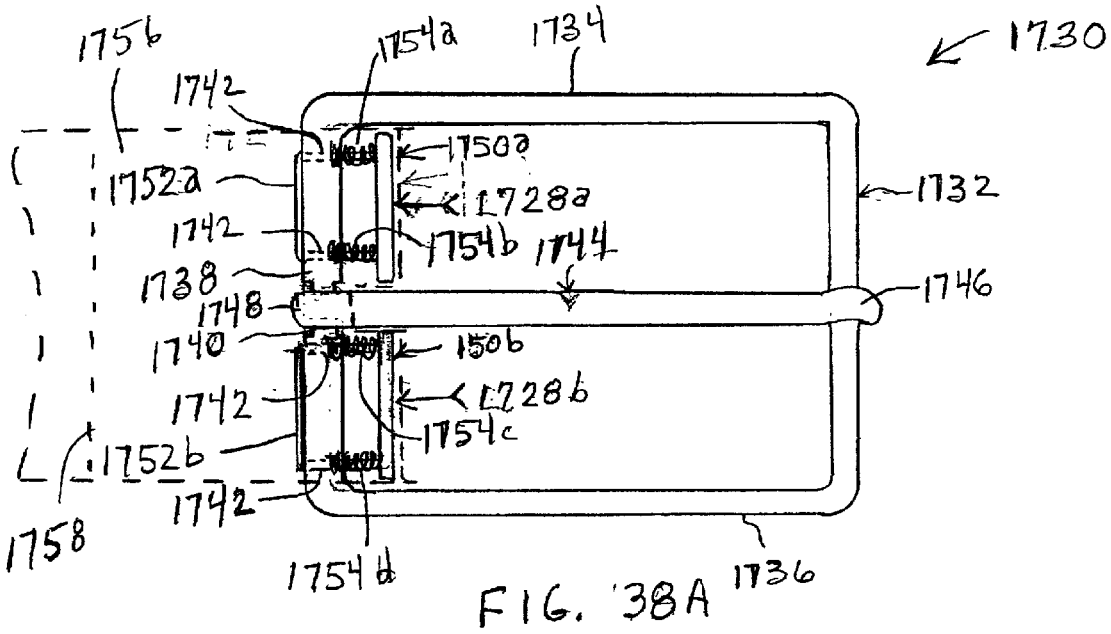

FIG. 38A is a facing view of a belt buckle having compressible spring driven bars to provide compliance according to an embodiment of the present invention, shown subject to circumferential forces less than the spring force.

Figure 38B:
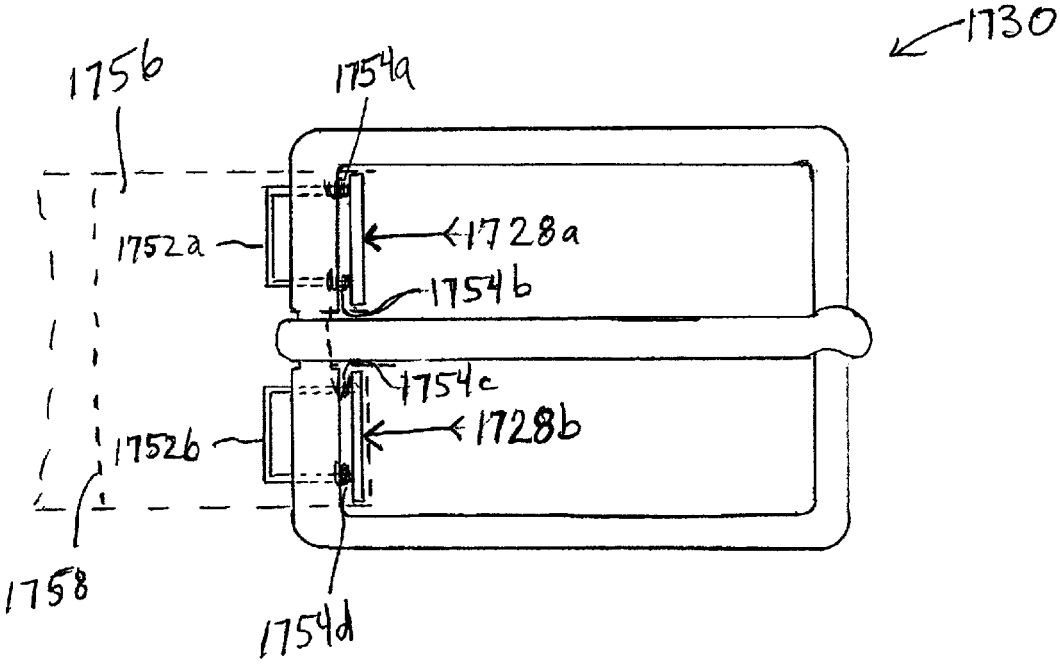

FIG. 38B is a facing view of the belt buckle of FIG. 38A, shown under sufficient tension to nearly fully compress the springs.

Figure 39:
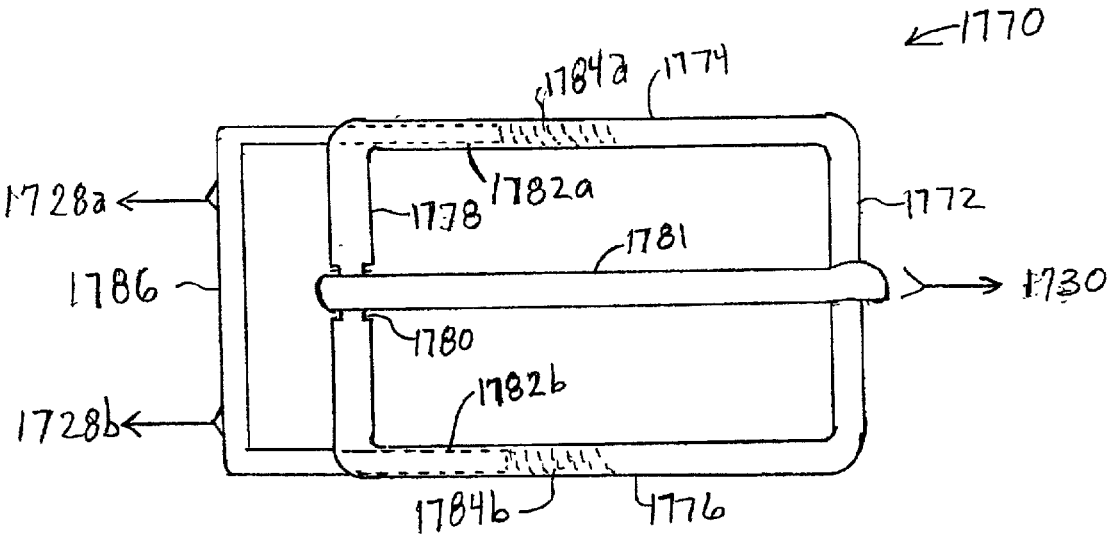

FIG. 39 is a facing view of a belt buckle that offers compliancy by the extension of a portion which attaches to the belt material according to another embodiment of the present invention.

Figure 40:
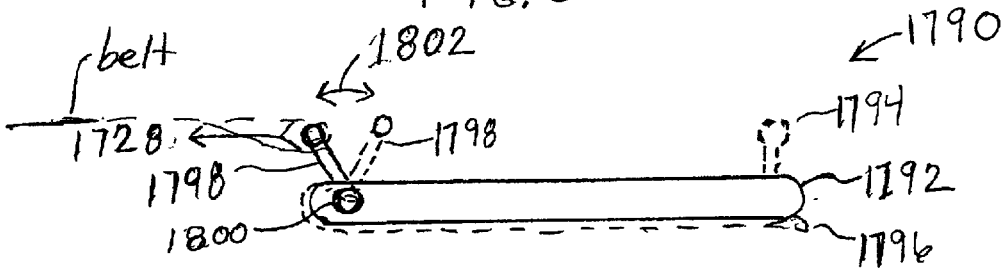

FIG. 40 is a top view of a belt buckle having a compliant pivoting attachment according to another embodiment of the present invention.

Figure 41:
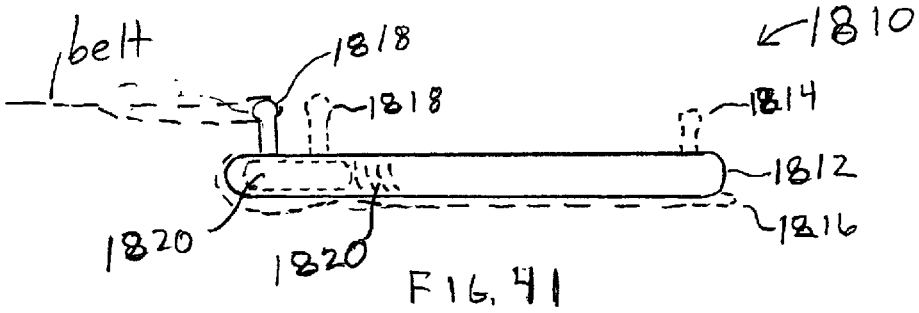
Figure 42:
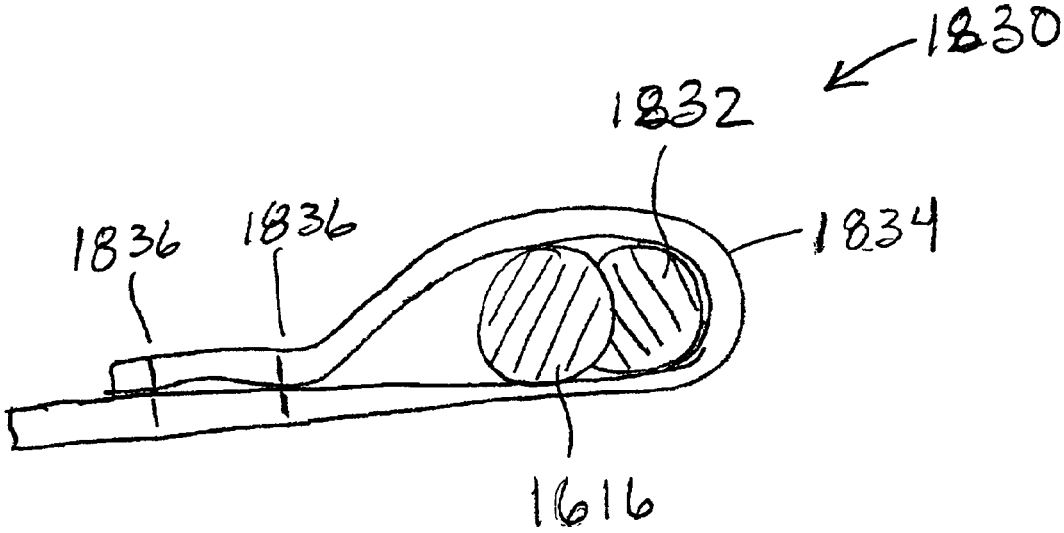

FIG. 41 is a top view of a belt buckle that utilizing a rearside sliding compliant member according to another embodiment of the present invention FIG. 42 is a top cross section view of a belt material to belt buckle interface that incorporates a compressible compliant member according to another embodiment of the present invention.

Figure 43:
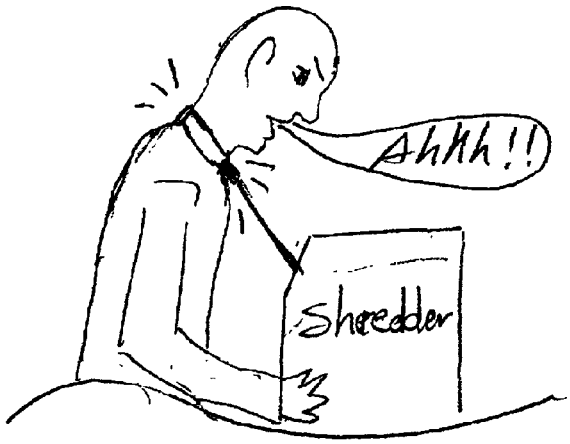
FIG. 43 (Prior Art)

FIG. 43 is a side view of a conventional tie shown being subjected to a form of tension-related incident, in this case wherein the individual is being strangled and pulled toward a paper shredder as a result of catching their tie therein.

Figure 44:
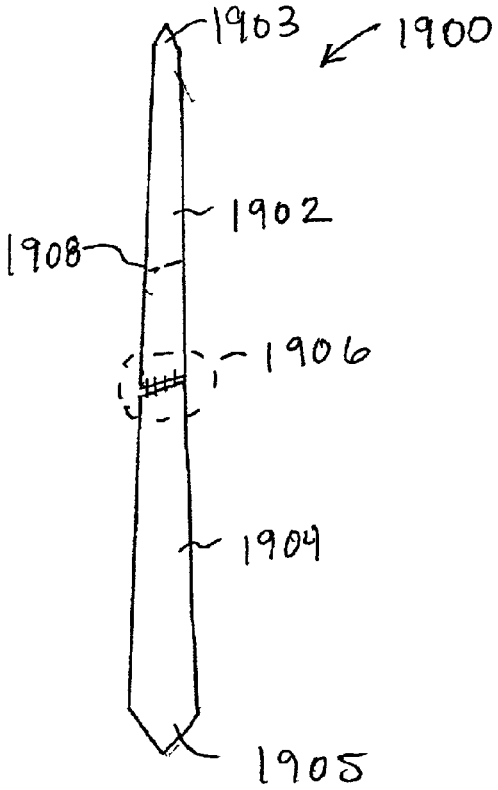

FIG. 44 is a top view of an outstretched tie according to an aspect of the present invention shown with at least two section being joined by a tension-controlled fastening means according to an embodiment of the present invention.

Figure 45:
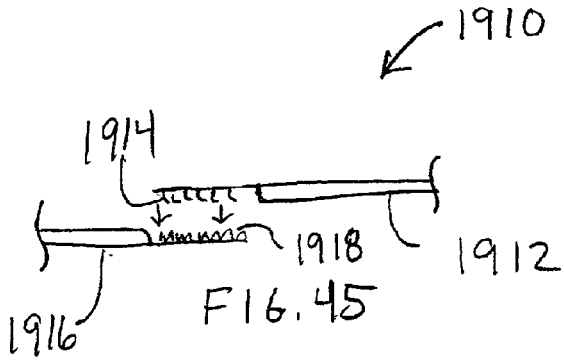

FIG. 45 is a side view of a tension-controlled fastening means according to an aspect of the present invention comprising a hook-and-loop fastener joining portions of the tie to one another.

Figure 46A:
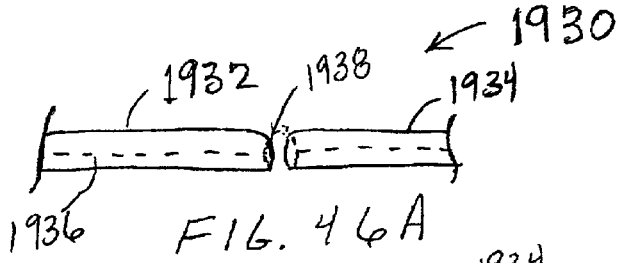

FIG. 46A is a side view of a tension-controlled fastening means according to an aspect of the present invention, showing two portions of a tie in preparation for being joined to provide a predetermined separation threshold.

Figure 46B:
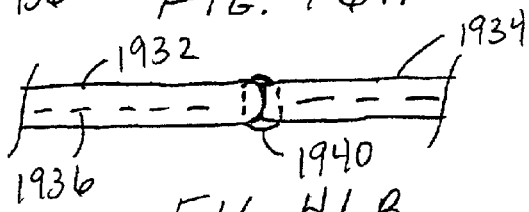

FIG. 46B is a side view of the tie of FIG. 46A, showing the two portions of the tie stitched together to provide a predetermined separation threshold.

Figure 46C:
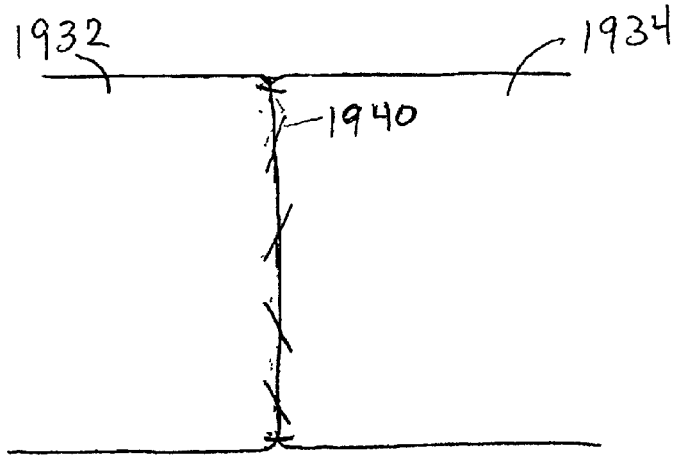

FIG. 46C is a top view of the tie of FIG. 46B.

Figure 47:
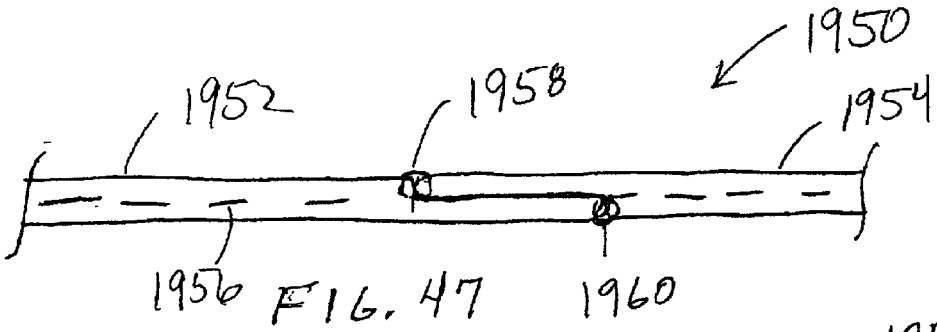

FIG. 47 is a side view of a tie which is configured to separate when a tension exceeding a predetermined separation threshold is applied, showing a stitched method of construction having upper and lower attachments.

Figure 48:
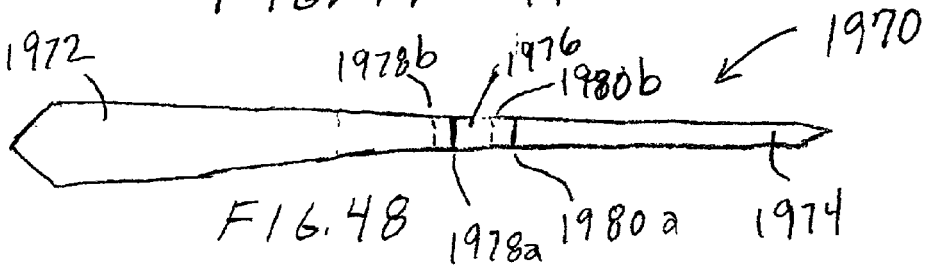

FIG. 48 is a top view of a tie configured to non-destructively separate at a tension exceeding a separation threshold according to an aspect of the present invention, shown with an section of material added to extend the length of the tie.

DETAILED DESCRIPTION OF EMBODIMENTS

Referring more specifically to the drawings, for illustrative purposes the present invention is embodied in the apparatus generally shown in FIG. 1 through FIG. 48. The detailed description exemplifies specific embodiments of the invention which are described in sufficient detail so as to allow a person of ordinary skill in the art to practice the invention without undue experimentation. It will be appreciated that the apparatus may vary as to configuration and as to details of the parts without departing from the concepts according to present claimed invention.

Figure 1:
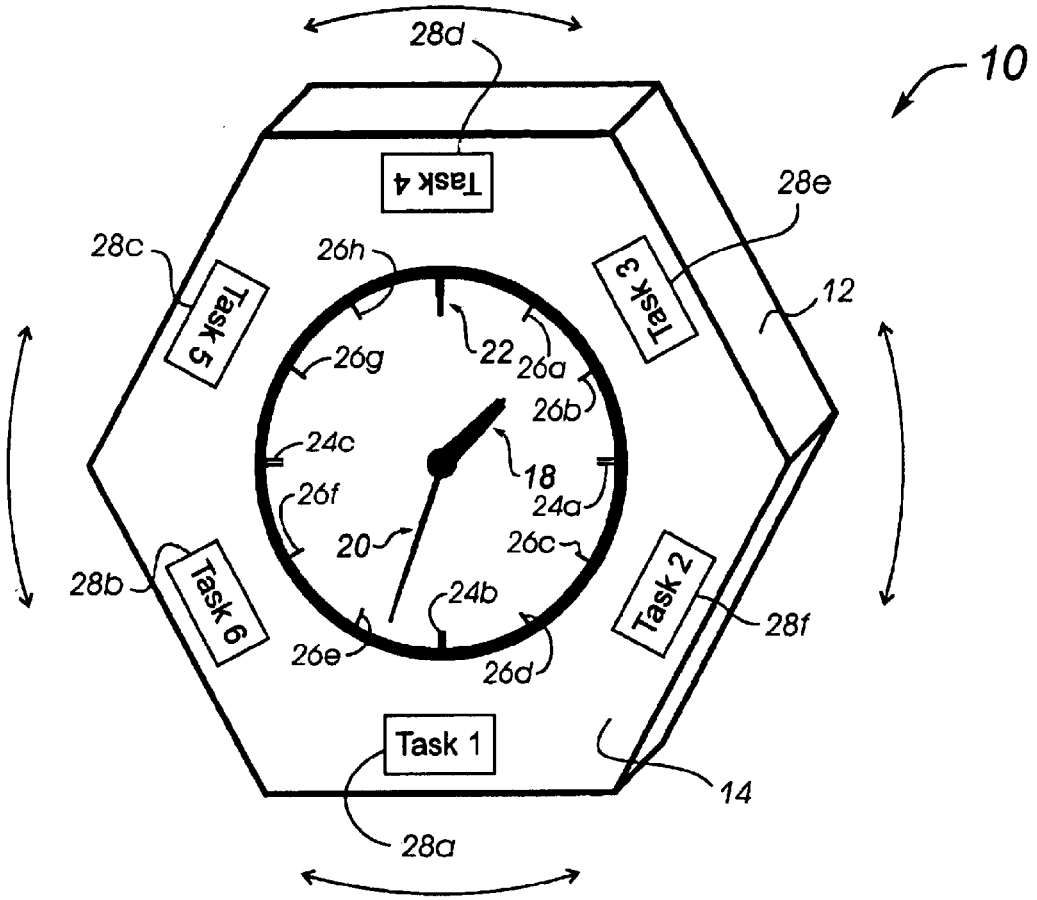
FIG. 1 is a front perspective view of a rotatable multitasking clock according to an embodiment of the present invention, shown for rotatable selection of a task associated with each of the six perimeter facets.

FIG. 1 depicts a clock 10 for tracking the acctime on each of a plurality of tasks. It will be appreciated that the capability of tracking accumulated time for at least three tasks is generally necessary for those desiring to track task time, and in many cases an individual may desire to track up to a dozen or more tasks. It is also preferred that the user can track an amount of time expended per interval, for example, the time spent in a given day, or week, wherein this time can be accumulated to a running total. Tracking accumulated time accorded to a task involves allocating elapsed time to one of a series of tasks, and provides control of these accumulated times, "acctimes", for example resetting. The present invention facilitates low-overhead acctiming and the figure is one of a number of embodiments described. The embodied MTC exemplifies tracking six tasks, however, it can be implemented for registering acctime on any number of tasks, preferably ranging from three tasks to twenty four separate tasks. The clock 10 is shown with exterior faceted sides 12, a front face 14, and a bezel with face 16. Face 16 of the clock is shown with hour hand 18, minute hand 20, and optional twelve-hour hand 21. The optional twelve-hour hand allows the display to register acctimes that exceed twelve hours, since the twelve-hour hand 21 indicates the number of twelve-hour periods which have been accumulated. Surrounding the hands are the hour markings comprising a large mark 22 corresponding to "12", slightly smaller markings 24*a* through 24*c* corresponding to quadrant marks of "3", "6", and "9", and the minor hour marks 26*a* through 26*g* corresponding to the hour marks of "1", "2", "4", "5", "7", "8", "10", and "11". In addition, a series of task tags 28*a* through 28*f* are shown about the periphery of the clock. The clock 10 can be rotated to rest on any of the six perimeter facets whereby time will accrue on the task associated with the downward facet. The displayed clock face, however, is electronically reoriented to remain vertical to simplify proper viewing of the time.

Upon sensing a new orientation, the face 16 of the clock (herein shown as an LCD) reconfigures into a vertical position for the new orientation, while acctiming for the previous task is suspended and timing for the new task associated with the new orientation commences. It will be appreciated that the movement is debounced in either hardware or software to assure stable transitions between registered orientations. The device preferably is capable of displaying the current time when oriented to a facet not containing a tag, and/or when lying on its back. It will be appreciated that no configurations need to be performed when a new task is started, such as prompted by a user receiving a phone call, wherein the user need only rotate the MTC to an unused task tag to commence acctiming. The reconfiguration of the clock face according to orientation is performed in this embodiment by utilizing a polar clock display with hands and hour marks that may be selected for any of multiple sizes. It will be appreciated that utilizing a color display device of sufficient resolution allows for displaying of multiple time values, such as TOD and acctime simultaneously, or a number of task acctimes without fear of confusion. The reorientation of the clock face may alternatively be performed in a variety of ways, such as mechanical rotation, graphic transform for a dot matrix display, or decoding changes for use in segmented displays.

Figure 2:
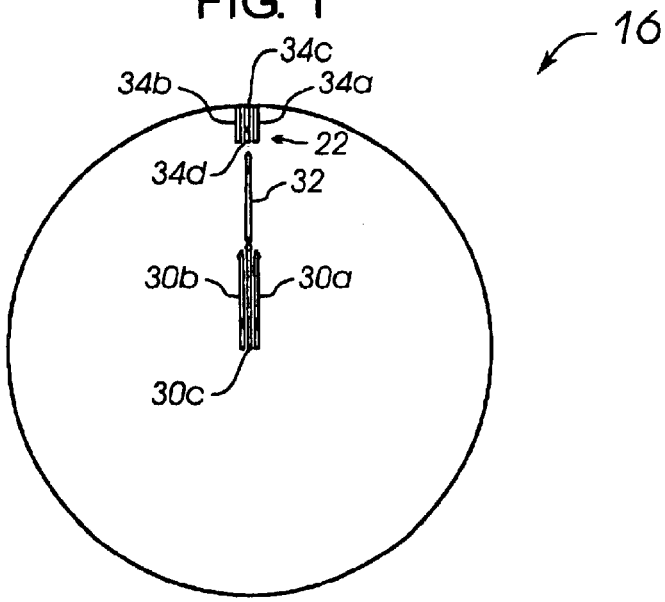
FIG. 2 is a plan view of an analog-style LCD clock face according to an aspect of the present invention which shows the multiple utilization of radial segments of the clock.

FIG. 2 shows a portion of a clock face with a series of nested markings, whose relative sizes has been exaggerated for the sake of clarity. For example, the hour mark 22 of FIG. 1 shown in a vertical position is shown in FIG. 2 comprising nested marks 22 which correspond to a non-quadrant hour 34*c*, such as "1", nested within a mark corresponding to a quadrant hour 34*d*, such as "3", nested within a mark corresponding to the "12" hour 34*a* and 34*b*. In this way the marks may be altered to suit the orientation. The hour hand 18 and minute hand 20 of FIG. 1 may be conventionally configured for an LCD clock within FIG. 2, wherein radial segments are selectively activated to create a short and wide hour hand 30*a*, 30*b*, and 30*c*, or alternately a long and thin minute hand 30*c* and 32. It will, however, be appreciated that a number of alternative methods exist for displaying time that may be readable in a variety of orientations.

Figure 3:
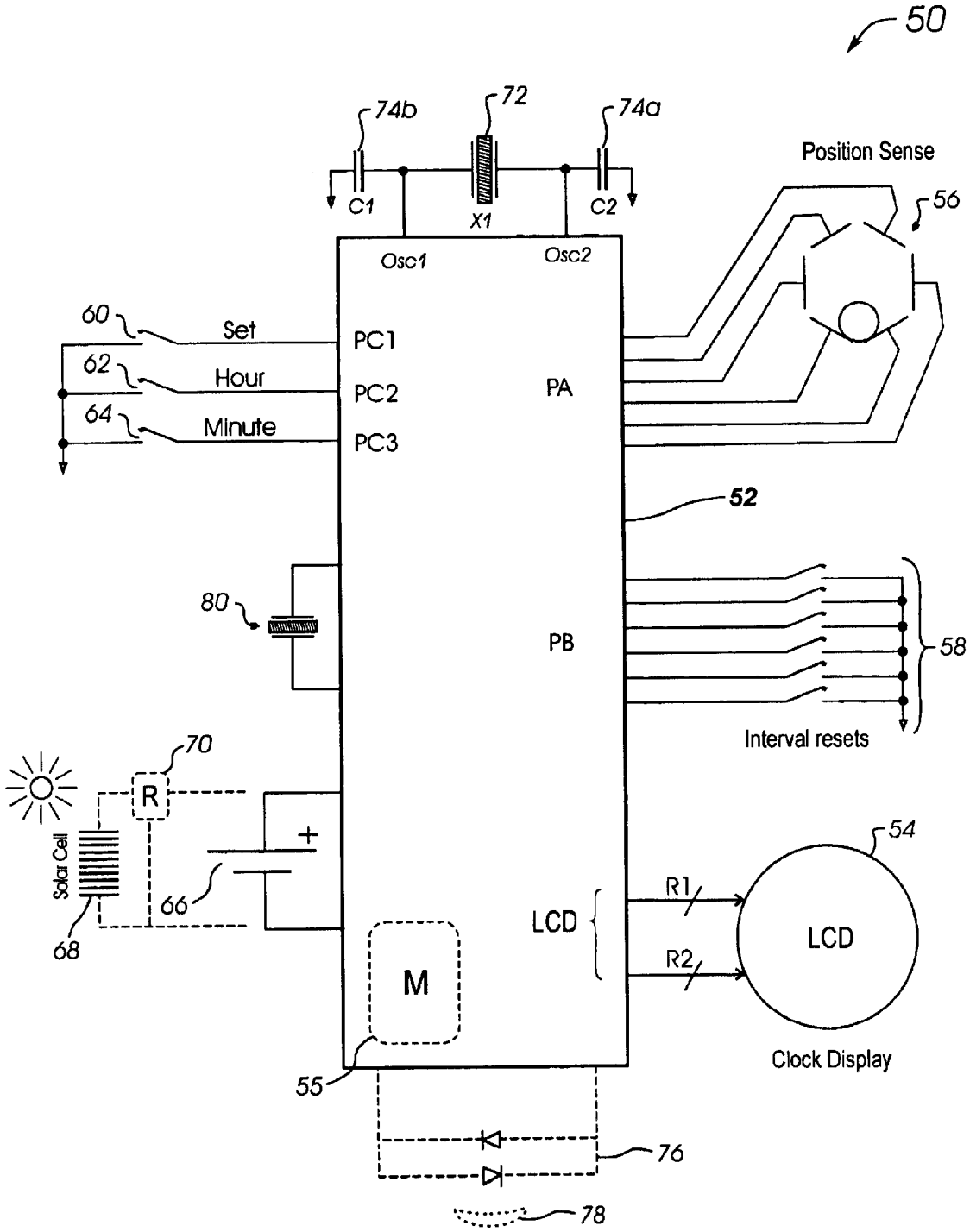
FIG. 3 is a schematic of a multitasking clock circuit which is capable of registering and displaying the accumulated time spent on any of the tasks according to an embodiment of the present invention.

Referring now to FIG. 3, a circuit 50 is exemplified for performing the acctiming and functions of MTC 10. A microcontroller 52 having a plurality of external inputs and outputs is utilized for driving an LCD clock face 54 such as shown in FIG. 1 and FIG. 2. An orientation sensor comprises a series of I/O lines on the microcontroller that are connected to a mechanical orientation sensor 56. A pulse is generated in a round robin fashion on each I/O line about the circle while the input state is registered on the nearby I/O lines to determine if the pulse is coupled to the line. Sensing hardware and/or software debouncing of the orientation eliminates any ambiguity as to which task is selected. The mechanical portion of the sensor will later be described in greater detail. For applications subject to a moving non-static environment, such as within a vehicle, other task selection mechanisms or orientation sensors may be utilized, such as solid state acceleration sensors.

A set of interval resets 58 is shown on another series of I/O lines. These interval resets 58 may be configured to sense the removal and insertion of the task tags associated with each task being tracked, such that the operations identifying the task and activating the task are combined. However, the software is preferably configured to allow a task tag to be swapped out without the immediate resetting of the associated interval, for instance to allow a "temporary" (catchall) task to be instantiated with a more appropriate name, as it preferably requires that the tag need be removed for at least a couple of seconds prior to performing the reset operation. To facilitate setting the time of day clock, and to allow initiating, or correcting, task tracking intervals a series of buttons 60, 62, 64 are provided for selecting setting 60 along with the advancement of either hours 62, or minutes 64. The device is shown powered by a battery source 66, such as a button cell lithium battery, however, it will be appreciated that numerous alternative power sources are available, such as solar power from a solar cell 68, and that any of these alternatives may be utilized within the device. Furthermore, the power from the battery may be directly connected to the clock or passed through a regulator 70 to optimize the source of power for use with the clock circuit. The microcontroller 52 is shown utilizing a crystal time base comprising quartz crystal 72 with load capacitors 74*a* and 74*b*. It will be appreciated that the quartz crystal sets a frequency of operation which should be rapid enough to provide for switch debouncing, provides for orientation sensing, and which facilitates proper control signaling, while the frequency should also be set such that an accurate timebase may be derived for registering seconds, minutes, and hours.

MTC 50 is shown optionally configured to communicate with external devices to transfer information therebetween, such as downloading or uploading. An infra-red optical communication link 76 and lens 78 are shown connected to microcontroller 52. It will be appreciated that wired connections, and radio links, may be alternatively employed to facilitate communication. The communication link can be used to facilitate communicating the time accorded to each of the tasks into a spreadsheet, or other logging software, such as may be running within a personal computer, personal digital assistant, or other electronic device. In addition, an optional audio annunciator 80, shown as a piezoelectric transducer, is preferably utilized for generating audio status tones. It will be recognized, however, that speech, music, and other audio may be generated by the device from the audio annunciator. By way of example, these sounds may be generated upon changing tasks, changing unit settings, and at predetermined or selected intervals.

It should be appreciated that the circuit of FIG. 3, exemplifies but a single method of implementing a circuit capable of performing task time accumulation according to the present invention. Numerous variations will be obvious to one of ordinary skill in the art, including the use of different mechanisms for resetting the accumulated task times through the use of other switches which may be associated with a specific task as determined by the orientation of the clock, or the state of additional switches.

Figure 4:
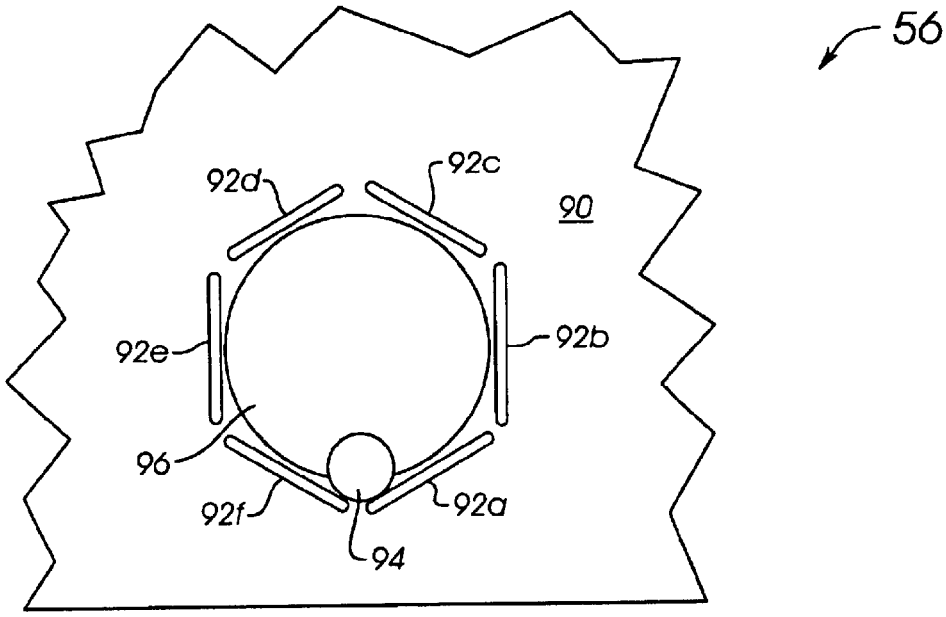
FIG. 4 is a plan view of a mechanical orientation sensor according to an aspect of the present invention, showing a contact ball in a rest position between contacts.
Figure 5:
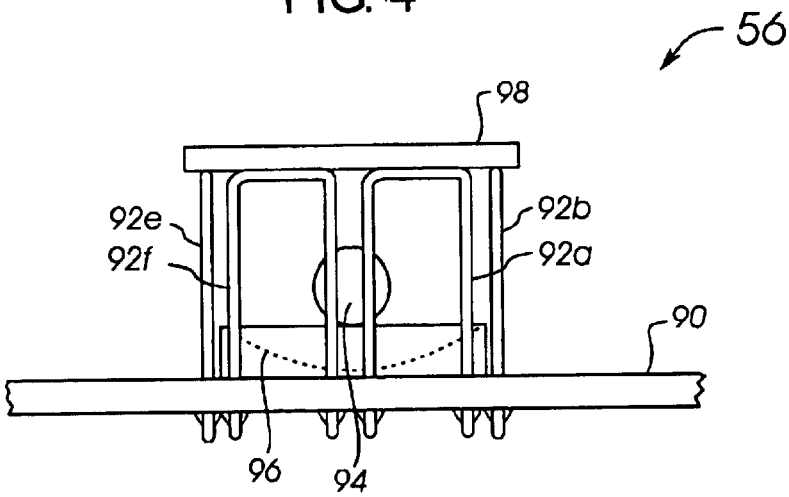
FIG. 5 is an elevation view of the mechanical orientation sensor shown in FIG. 4.

FIG. 4 and FIG. 5 illustrate a mechanical orientation sensor 56, shown also in FIG. 3, which comprises a base member 90, for instance a printed circuit board, in conjunction with raised conductive projections 92*a* through 92*f*, which are shown configured as U-shaped conductive segments, which preferably are gold plated to resist corrosion. A contactor member 94, is shown as a ball whose exterior is also preferably gold plated. The ball may be of metal, although conductive polymers and other resilient materials having a conductive exterior can eliminate the rattle and provide increased contact reliability. A dish-shaped non-conductive member 96 is situated in the middle of the conductive segments to isolate contactor member 94 from all the conductive projections 92*a* through 92*f* when the device is lying in a predetermined position, such as on its back. It is preferable that if a single time display is provided, it will display the time of day when none of the tasks are selected, and/or when a task is selected for which a task tag has not been inserted (remaining in a reset state). FIG. 5 shows a side view of the mechanical orientation sensor with a top-piece 98 that prevents contactor member 94 loss. The conductive segments 92*a* through 92*f* are shown soldered into a printed circuit board base member 90.

Figure 6:
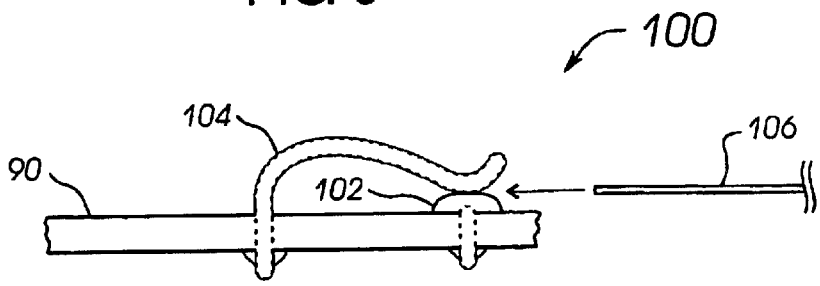
FIG. 6 is an elevation view of a combination task-tag holder and time reset switch according to an aspect of the present invention.

FIG. 6 is a task interval reset switch 100, with a metal contact 102 and a compliant metal contact arm 104 on a printed circuit board 90. A small cardboard sheet 106 exemplifying a task tag that is being inserted within the task interval reset switch 100. Without a task tag inserted in the task interval switch, the registered interval associated with the task is reset. Upon inserting a task tag within the task interval reset switch 100, the interval associated with the switch may begin counting the accumulated time if the task has been selected.

Figure 7:
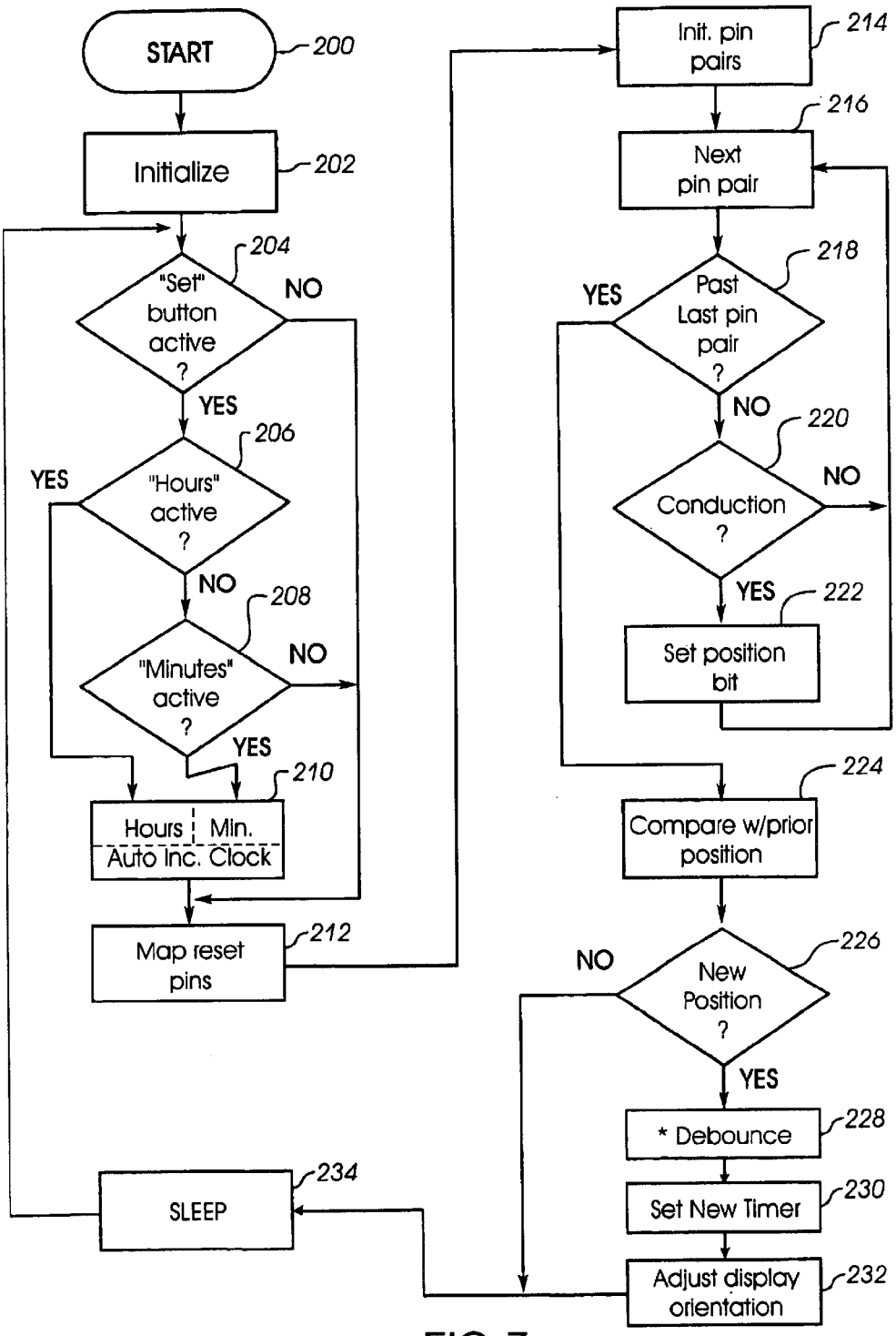
FIG. 7 is a flowchart of a routine for providing the registration of accumulated time for each of the plurality of tasks according to an embodiment of the present invention and shown with additional time setting steps.

FIG. 7 illustrates a firmware flowchart for task interval tracking. Firmware execution begins at block 200, after which the microcontroller and circuits are initiated at block 202. A main loop begins at block 204 with a check of the time setting buttons. At block 204 the "Set" button is checked and if it is active, then the "Hours" button is checked at block 206. If the "Hours" button and the set button are being pressed, then the hours on the clock are incremented at block 210. If instead the "Minutes" button is being pressed as detected in block 208, then the minutes are incremented at block 210. If neither hours or minutes are being set, then a check is performed at block 212 on the status of the reset pins which are mapped to determine which tasks are active. If no mapping changes exist, then the orientation of the device is determined starting at block 214 with an initialization of the pin pairs, whereafter the pin pair is incremented at block 216. If the last pin pair has already been tested as determined by block 218, then all pins have been checked and comparisons are performed at block 224. Otherwise, conduction between pin pairs is checked at block 220, and if sufficient conduction is occurring, which is characteristic of being bridged by the conductive ball making contact between the contacts, then the position is logged at block 222. Testing continues with execution looping back to block 216 until all pin pairs have been tested. At block 224 a comparison is made with the steady-state condition of the orientation sensor, if the position has changed, as determined by block 226, then the orientation sensor is debounced at block 228 (orientation signal is verified) and the prior task stopped and the new task interval is started at block 230, with a commensurate adjustment of display orientation 232, such as swapping a display mapping table. The output of the readings to the display is exemplified within an interrupt routine isr_tick which periodically updates the recorded time and the display. Once the interval has been started, the routine enters a sleep mode at block 234, and the loop is repeated periodically.

Figure 8:
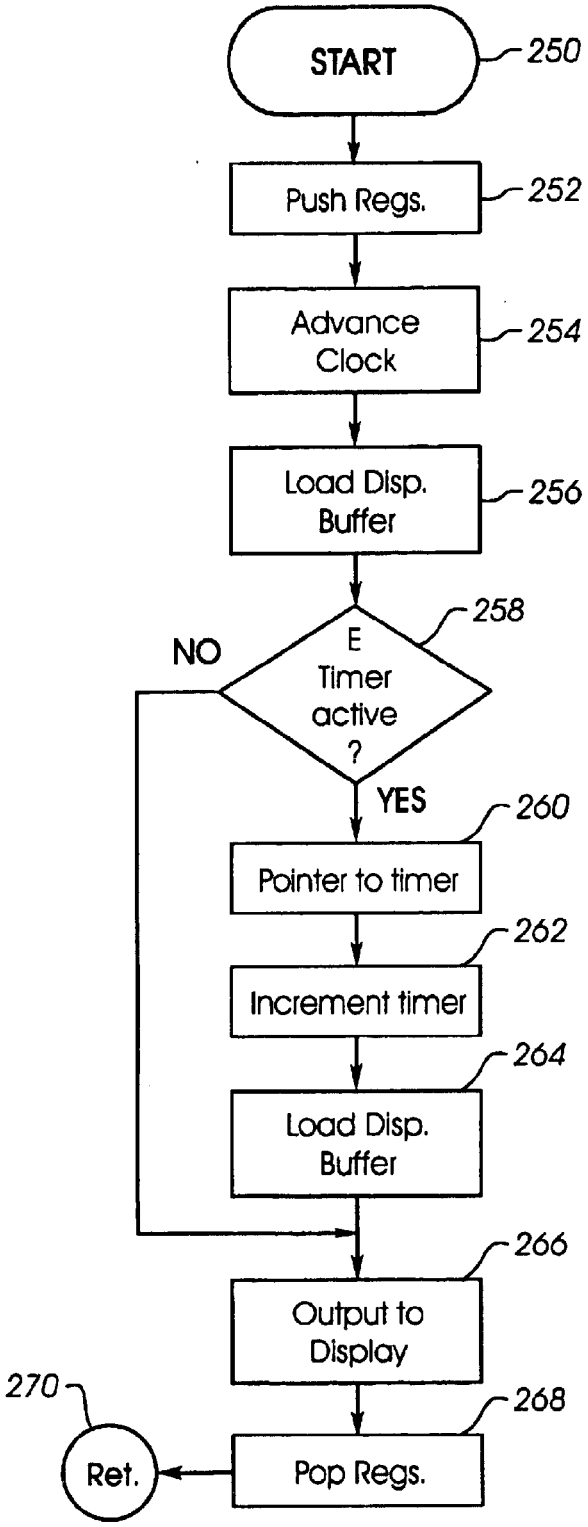
FIG. 8 is a flowchart of an interrupt routine for updating the task and time of day according to an embodiment of the present invention.

FIG. 8 illustrates the interrupt routine isr_tick which awakens periodically to update the task intervals and update the display. When the interrupt awakens the processor at block 250, the registers are saved at block 252 and the clock is advanced at block 254, and a display buffer is loaded at block 256. If a task timer is active as detected at block 258, the pointer to the timer is retrieved at block 260 and the timer has been incremented at block 262 after which the display buffer is loaded at block 264. The display buffer is written to the display, or displays, at block 266 and then the registers are restored at block 268 after which the interrupt routine returns at block 270.

Figure 9:
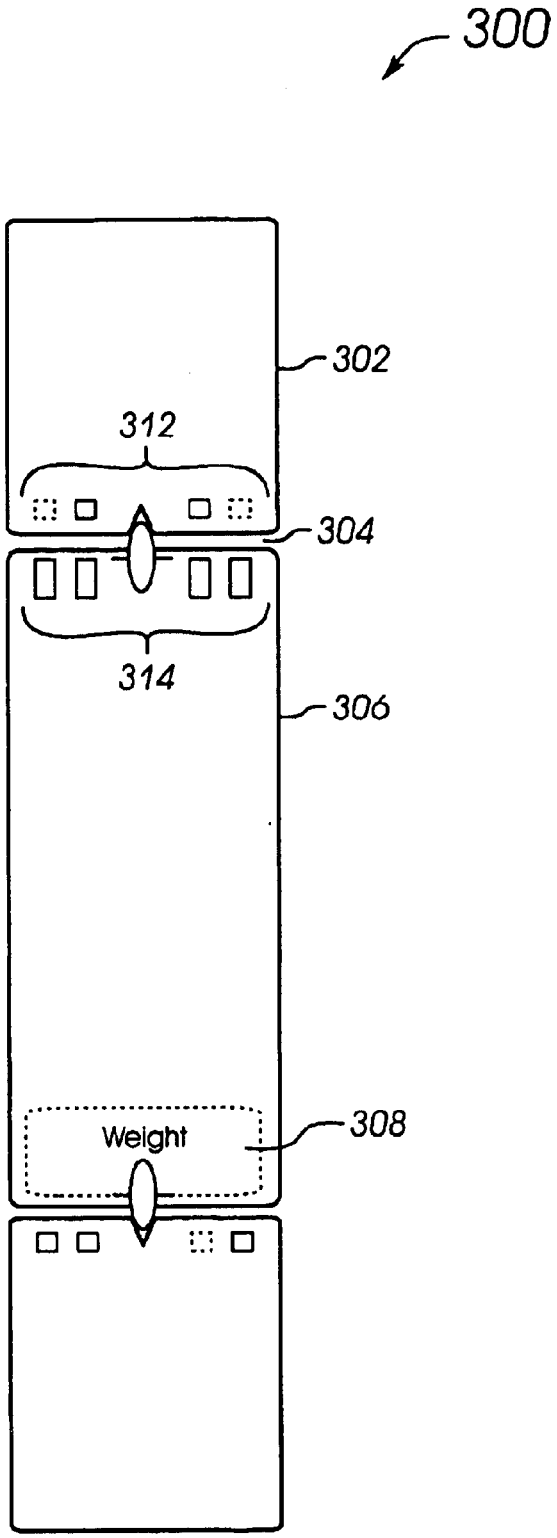
FIG. 9 is a side cross-section view of a rotatable multitasking clock according to an embodiment of the present invention, shown utilizing a rotating center clock assembly.

FIG. 9 is another embodiment of an MTC 300 having a housing 302 with a cutout 304 and a rotating clock bezel 306. The rotating clock bezel 306 contains a weight 308 and is free to rotate within the cutout 304 on the wheels 310. The rotating bezel is adapted with a means for sensing its position within the housing, such as contact, magnetic, inductive, capacitive, and optical. Position sensing within this embodiment is exemplified by a magnetic sensing arrangement, wherein up to four magnets 312 are positioned near the bezel in each of the facets. The number and position of the magnets is then sensed by hall effect sensors 314 within the clock bezel 306, which can decode the binary magnetic bits (shown are 4 bits which provide up to 16 possible positions) to determine the orientation of the bezel in relation to the housing 302. The face of the clock bezel 306 has a display that rotates to stay vertical and displays the accumulated time for the task associated with relative orientation of the housing 302.

Figure 10:
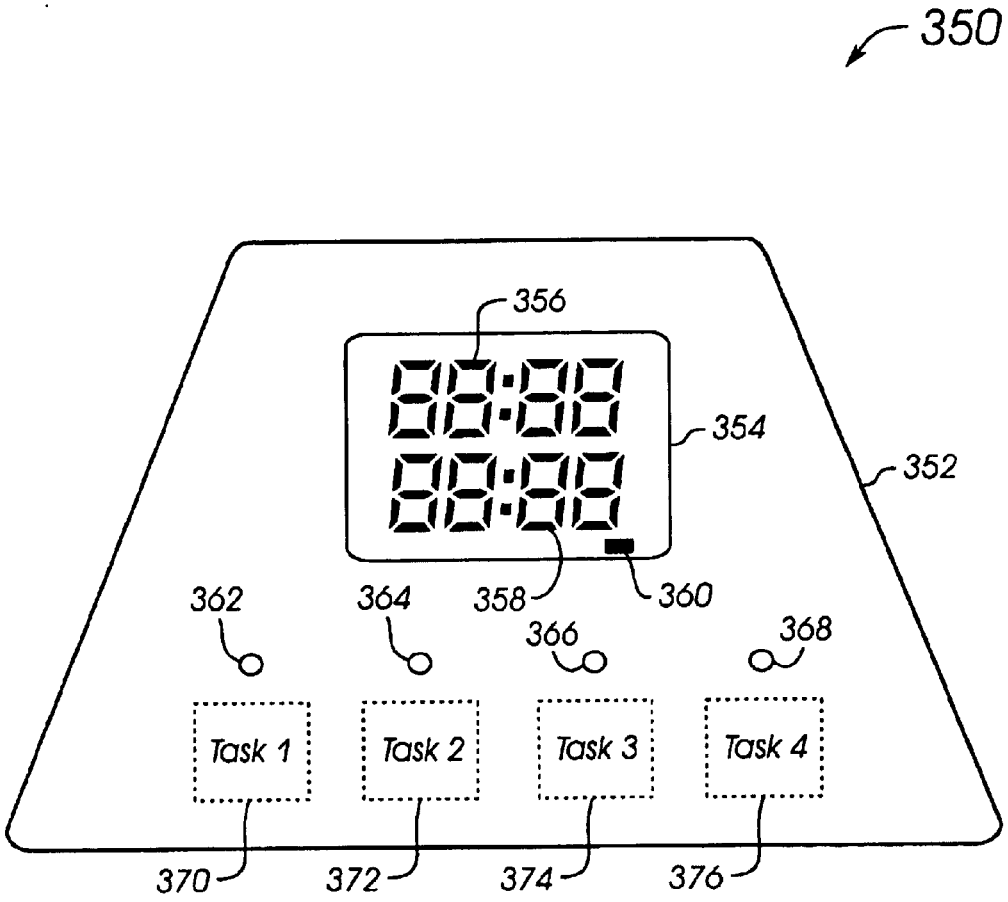

FIG. 10 is another embodiment of an MTC 350 whose housing 352 contains an LCD display 354 capable of displaying a pair of time displays 356 and 358. The upper display 356 displaying the time of day, while the lower display 358 registers the total time for "task 4" whose selection is indicated by a flag 360. A set of buttons 362 through 368 is located below the display for selecting the task, "Task 1" 370 through "Task 4" 376, upon which time is to accrue. It will be appreciated that the user would typically write a real task name associated with the task for which acctiming is performed, such as "accounting", a client name, "phone calls", and so forth. The names are illustrated as "Task n" just as placeholders for the sake of clarity. It will further be appreciated that the embodiment is preferably adapted for positioning the task names substantially adjacent to the task selectors wherein the user can select a task based on the name that they have given the task. Furthermore, it will be appreciated that the user may start a new task without first creating a task name or doing any other preparation, they need only select an unused task which may be named at a later time if desired. The task which has been selected is indicated by presence of an task status indicator, exemplified by the bar flag 360 on display 354 in a position which is associated with a given task.

FIG. 11 is another embodiment of an MTC 400 having a three dimensional exterior, that is generally configured in the shape of a sphere within this embodiment. The three dimensional exterior provides for a large number of exterior facets 402 which may be associated with various tasks. The face of the clock 404 is configured as an analog clock, such as an LCD, containing segmented hands 406, 408 representing the hour hand and segments 410 and 412 representing the minute hands. To detect orientation, the ball may utilize any of a number of sensor types including a three dimensional contact set, or other position sensing, or the use of a tilt sensor or acceleration sensor. The task labels within this embodiment may be written on the facets of the sphere so that the task whose time is being accrued is preferably the task whose facet is oriented at the top of the sphere. The sphere may be constructed of any of a variety of shapes and materials, including metals, plastics and so forth. For example, if the sphere is fabricated of clear Lexan™, the exterior facets could be written on with a marker and wiped off and written over when the task changes. This spherical embodiment is well suited for implementation with electronic ink, or similar. The exterior surface of the sphere, for example, may be coated with e-ink along with the appropriate electrodes to allow each facet of the unit to be non-permanently written to with an electrode stylus, or similar, which may be erased electronically. The use of electronic ink will be further detailed within subsequent embodiments of the present invention.

FIG. 12 depicts an embodiment of a MTC 450 of the invention whose faceted housing 452 has a bezel 454 containing a seven-segment LCD unit capable of displaying two time values 456, 458, each comprising hours and minutes, along with seconds and any additional units or flags desired. One display is preferably utilized for displaying the time of day while the other can display acctime according to the selected task. Task selection is exemplified by the positioning of the clock such that the task upon which time is to be accumulated is at a predetermined position, such the top of the clock as depicted by TASK 1 is in FIG. 12 (although the unit can be designed to allow selection at any known position). A set of six facets and associated tasks 460*a* through 460*f* are located about the periphery of the housing 452. It would at first appear confusing to utilize a seven segment display within a clock that may be rotated, even to an inverted position, however, the circuit within this embodiment of the present invention drives the segments according to a first decoding for "TASK1", "TASK2", and "TASK6" and drives the display according to a second decoding pattern in an inverted manner by changing the digit coding, for "TASK3", TASK4", and "TASK5". In this way the display never needs to be read inverted, while the sixty degree offsets pose no problem to understanding of the displayed values. It will be appreciated that the marked tasks, TASK1 through TASK6 are shown for illustration, however the actual task would be represented by the user in any manner desired, such as "Accounting", "ABC Corp", "System maintenance", and so forth according to the tasks the user wishes to track. The tasks names for housing 452 of clock 450 can be delineated by a user that applies adhesive stickers, small sticky flags, tape, or that marks directly on the plastic housing of the unit, for instance with a felt-tipped pen or grease pencil. Marking of the tasks may therefore be simple to exotic, such as the contemplated use of e-inked patches responsive to rewriteable marking with a electrode stylus. A reset button is provided on the rear of the unit which when pressed will reset the time for the selected task back to an initial state of "00:00". A set of recessed hour and minute setting button are also preferably included for adjusting the time of day portion of the clock. As this embodiment does not provide task tag holder/reset switches within the exemplified embodiment (as there were in FIG. 1), the circuit is configured such that continued pressing of the reset switch for a particular task will at first reset the task preparing it to accumulate time for another task and then switch that task position into a mode wherein it will also display the time of day. The hour and minute time setting buttons may also be used to advance the time on the selected task, should the user have inadvertently forgotten to position the clock to accumulate time for a specific task.

FIG. 13 is another embodiment of a MTC 500 that is configured with an included writing surface 502, a digital display for acctime display 504, a digital display for a time of day (TOD) clock 506, a task selector 508, a set of task time accumulation controls 510, and a set of controls 512 for setting the clock. This embodiment of the invention appreciates that a user may want to dynamically set the tasks to be timed within any particular day or period of time. The inclusion of a writing surface 502 allows the user to jot down not only a task name, but to note other task related information. It should be appreciated that the writing surface is adjacent the task selector to allow the user to associate their own named tasks with a task capable of being selected for acctiming. The writing surface is preferably implemented as a small notepad, or Post-It™ Notes as manufactured by 3M Corporation, that is retained by a portion of the housing. A note pad retainer 514 is incorporated within the housing for holding small standard sized notes. Examples of some standard size notes are 3"×5", 3"×5", 3"×3". A protruding circular portion 516 of multitasking clock 500 is configured to overlap the note pad retainer area. Preferably the housing is also configured with a protruding lip 518 that overlaps the note pad area to aid in retaining the notes. The pad of notes, or stack, may be inserted under the circular portion 516 and protruding lip 518.

The controls on the MTC are configured to provide simple rapid control of task timing. Controlling task timing is performed by setting a selector 508 for one of the tasks for which time is to be accumulated. Selector 508 is configured with a rotary control that may be positioned in any one of six task positions which are preferably indicated by markings 520*a*–520*f*, the mark 520*b* being the task currently selected by the selector 508. It will be appreciated that the note pad area is directly adjacent the selector so that a name, or designator, may be associated with any of the six tasks upon which times may be accumulated. In addition, the user can quickly insert other information relating to the task.

In using the MTC, the user starts a new task by rotating selector 508 to an open task position. Accumulation of task time commences immediately upon selecting the new task, the user is not required to do anything else. This aspect of the invention is very beneficial because when an event occurs, such as a client call, the user can simply select the new task without delay, and without traversing a set of screens. Selector 508 is implemented here as a rotary selector which provides a simple intuitive interface that can be operated with either hand. It is at user discretion whether they want to write down a name, or notes, on the pad for a particular task. The task associated with a telephone call may end with the call, or it may start a new task that the user will be working on at other times of the day. If no other work will be done according to that task, then the user may want to record the time spent and information necessary to record the time later. A task such as a telephone call may be considered a temporary task, which is in contrast with an ongoing task.

The controls exemplified with this embodiment of the MTC comprise acctime controls 510 which include setting controls having a SET 522*a*, HR. select 522*b*, MIN. select 522*c*, and a Clear All 522*d*. The separate acctimes for a selected task may be cleared by pressing the CLEAR button 524. A SELECT button 526 can be used for selecting given task values for a given function. A TOTAL button 528 allows for summing all daily task values with a single keypress of TOTAL 528. If pressed twice in rapid succession TOTAL operates to sum accumulated long-term totals. When a total is selected the user can move the task selector 508 and press SELECT button 526 to remove any values from the displayed total. A PREVIOUS button 530 allows a previous value, such as a previously cleared task total, to be recalled. A NEWDAY (period) button 532 adds the current total for the day to the total acctime for that task. A MODE button selects display modes, such as from display of acctime for a task on a given day to total acctime for the task. A NONE button 536 may be selected to pause all timers, and is pressed an additional time to resume timing. It may be preferable for the MTC to blank the displays and enter a low-power mode in response to pressing the NONE button 536. The acctime display is preferably configured to time accumulated time in a minute:second (MM:SS) format until the amount reaches "59:59" after which is switches to an hour:minute (HH:MM) format. Preferably, the display provides an indicator of which format is being timed, for example, a section of the display containing "HH:MM:SS" wherein the fields "HH" and "SS" may be alternatively selected depending on acctime mode, although the update rate itself is indicative of the nature of the time being registered.

A set of generally conventional set of clock setting controls 512 comprising a MODE button 538, SET button 540, and an ADVANCE button 542 are included within the embodiment so that user can view both accumulated task times and the time of day. It should be appreciated that acctime information such as cumulative totals may be selectably displayed on TOD display 506 when MTC 500 is held within select modes.

FIG. 14 is another embodiment of a MTC 550 with housing 552 that is configured for retaining the edge of a note pad 554, such as by clamping the front and back along a small section. MTC 550 is configured with both an acctime display 556, and a TOD display 558. MTC 550 utilizes a series of button-style task selectors 560*a*–560*h* for changing between tasks for time that is to be accumulated. Preferably these buttons incorporate an indicator, such as a flashing SMT LED, that signals the task for which time is being accumulated. A number of alternative indicators may be utilized, such as (1) numbered buttons and a portion of the LCD display that displays the presently active task number with a task number display, (2) LEDs incorporated within or near the buttons, the LEDs may operate intermittently to conserve power, (3) electronic ink regions, and so forth. MTC 550 has similar acctime controls 562, and TOD controls 564 as previously described.

FIG. 15 is another embodiment of a MTC 600 configured on a large note tablet housing 602, shown holding tablet 603, and having a control top section 604*a*, a selector sidebar 604*b*, and a tablet retainer 604*c* shown as a portion of the housing configured to receive a tablet. A TOD display 606 and adjustment controls 608 are provided for convenience. A large display 610 is used for both displaying one or more acctimes and for both standard calculator functions and time calculations. One portion of display 610 is shown configured for hour-minute display 612 while the remainder is configured for displaying number with decimal points or commas. A calculator keypad 616 is configured to enter both standard and time calculations when the calculator mode selector 618 has been activated. An acctime mode selector 620 can be used to engage the acctime function, such as to disengage calculator mode. A set of eight task selectors buttons 622*a*–622*h* are aligned on the left side of the housing configured to be adjacent to the writing area of a received tablet 603. The embodiment is again adapted with selector buttons that are spaced and positioned adjacent the writing surface wherein information written on the tablet may be associated with the task selection. An "NA" button 624 may be pressed when the selectors are "not-applicable". The NA button can be configured to pause acctiming or to commence a separate temporary "interruption" acctime. Acctime controls 626 are similar to those previously described. MTC 600 may be powered from various sources, such as batteries or solar cell 628.

FIG. 16 is another embodiment of a MTC 650 having a small tablet-holder housing 652 configured for receiving a small tablet 654. A single combination display 656 over a calculator keypad 658. Calculator functions may be selected with "Calculator" mode button 660. Display 656 is configured to simultaneously display TOD 662*a*, and acctime 662*c*. Center section 662*b* is preferably blanked in normal operation to separate the TOD and acctime display. In calculator mode, the entire display can display numbers. Display center section 662*b* may also be used to display totals and other information depending on mode. A set of acctime controls 664 is provided similar to previous embodiments. A sliding acctime task selector 666 is configured as a mechanical lever adjacent the writing area of small tablet 654 to allow task names and/or information to be associated with the task being timed or considered for selection. An "NA" button 668 allows for disabling task selection. A "PWR" power button 670 allows the display and calculator operation to be turned off when not in use.

FIG. 17 and FIG. 18 illustrate another embodiment of a MTC 700 implemented as a rotating vertical hexagon with an analog clock face. A lower stationary housing 702 supports a rotating upper housing 704 which is exemplified in a hexagonal shape and contains a display 706. Upper rotating housing 704 may fixedly retain a display whose output may be reconfigured depending on the angular position of the display, such as a LCD display having relocateable hour marking tabs. It will also be appreciated that a twelve-hour hand (not shown) may be activated when displaying acctimes that exceed twelve hours. Display 706 may also be attached to stationary lower housing 702 with an upper housing 704 that surrounds, and rotates about, rising element containing display 706. Any form of electronic digital or analog display may be utilized with a fixed angular position of display 706. A selector marking in the lower housing 708 provides an indication of the orientation of display 706 and the task selection. The large facets 710 on the exterior of the upper housing provide space for marking a task name, such as by writing, or the attachment of adhesive-backed notes. An "NA" button 712 allows the deselection of all acctimers, while a "TOD" button 714 allows temporary selection of a time of day clock function. Additional controls for acctiming may be hidden, so as not to detract from the elegant aesthetics of the unit.

Electronically, MTC 700 senses the relative orientation of the rotatable portion of the upper housing, which is preferably configured with detents to prevent confusion as to the selection. A number of techniques may be used for position sensing, including those previously described, such as the use of electrical contacts engaging selectively conductive areas, magnetic sensing, and so forth.

FIG. 19 and FIG. 20 exemplify another embodiment of a MTC 750 implemented in a rotatable octagonal housing having multiple digital displays. A housing 752 of MTC 750 is configured with exterior facets upon which the MTC may be set to select a task for acctiming. A center display 754, such as an LCD or similar low power display, is configured with a first display 756 and a second display 758. The digits are generated to these displays in a conventional manner when MTC 750 is substantially up-right, but then the digits are generated with an alternative seven-segment mapping when MTC 750 is in a substantially inverted position. This mode of display operation is referred herein as flip-flop operation. Display legends 760, 762, may be incorporated as part of display 754 to indicate which display is used for TOD and which is used for acctime. Preferably these time legends are contained on the LCD for the two orientations.

Task selection is performed by rotating MTC 750 to the desired task associated with a facet. Adjacent each task selection facet is an area 764 upon which a task name may be written, a label applied, or a Post-It™ type note applied. It should be appreciated that the unit is exemplified in an octagonal housing yet is configured for acctiming in relation to only six of the facets, so that that digital displays are retained in a position that provides for easy viewing. FIG. 20 shows MTC 750 rotated to select a different task for acctiming. It should be appreciated that a more expensive graphic display may be utilized for providing all display functions. The software for driving the graphic display should be configured to modify its generation of text and graphics in response to the position of the unit, and is capable of generating upright text regardless of the actual physical orientation of MTC 750.

FIG. 21 exemplifies yet another embodiment of MTC 800 which is implemented with a faceted exterior 802, herein configured as a cube. The MTC 800 has a rotating digital display 804 wherein task selection is responsive to the positioning of the housing 802 in relation to display 804. Display 804 is shown with axis of rotation markings 806*a*, 806*b*, at the facing side and rear of the unit, wherethrough the display unit preferably rotates. Display 804 is shown comprising a seven-segment time display 808 for displaying acctimes and a set of control buttons 810*a*–810*e*. It will appreciated that additional displays may be incorporated of various types to provide a TOD display and additional task timing displays. A pointer 812 is provided on display 804 to remind the user which task is currently selected. Labels, such as handwritten Post-It™ Notes 814*a*, 814*b*, are shown attached on the facets about the periphery of MTC 800 for recording task names and additional information at the discretion of the user. Each of the facets may be additionally configured to retain an entire note tablet, such as within a recess, wherein changing the task name, or notes is performed by peeling off the top sheet of notes and writing the desired task information on the previously underlying sheet. The cube shape of the present embodiment facilitates the in-situ writing of task names and other notes as the upper surface is horizontal.

It will be appreciated that a number of methods may be utilized for providing a rotating display 804 within housing 802, such as rotating display 804 about an axle in response to a off-center display mass wherein the display automatically rights itself based on position. In addition, the display may be variously elongated within housing 802 and configured with rotating members, such as wheels, the provide an interface for allowing the display to rotate. A number of methods exist for allowing the electronics of the device to sense the relative rotation of the display 804 to housing 802, including mechanical switches, magnetic sensors (i.e. hall-effect), inductive sensors, optical sensors, and so forth that are configured to distinguish one position from another. It will be appreciated that acctimes are preferably not subject to change while the display is transitioning. It will further be appreciated that tipping the display back on the rear facet can select another time for display, such as the time-of-day, or a temporary time interval. This position can be sensed with the aforementioned moving ball form of sensor as well as other methods. Furthermore, the unit can be set in a mode wherein the main display alternates between displaying time of day and the acctime for a specific task, such that the user is provided additional convenient information. In one preferred implementation, MTC 800 upon sensing that the rear facet is down, switches to the display of time of day and simultaneously commences the timing of a temporary acctime. After a few seconds have elapsed the acctime is shown and thereafter the display automatically toggles between the display of the temporary acctime and the time-of-day. This mode allows the user to quickly time phone calls or other events, as well as provides a clock display. The user at any time, may just tip back the unit to see the TOD.

FIG. 22 and FIG. 23 exemplify another embodiment of a MTC 850 configured with a small rotating dial-ring for mounting to any convenient surface, such as computer CRT, telephone, cubical, and so forth. The configuration of MTC 850 can be implemented in a compact size, shown in the inset, for example down to less than a two inch diameter. A dial-ring 852 is rotatably attached to a display housing 854, and may be rotated 856 in either direction. The rear 858 of display housing 854 is configured with adhesive-foam 860 to provide semi-permanent attachment to a surface 862 as shown in FIG. 23. It will be appreciated that other forms of mounting may be utilized, such as clips, fasteners, hook-and-loop fasteners, snaps, magnets, and so forth. Dial-ring 852 is shown marked off into six segments 864*a*–864*f* that each correspond to a task for which acctimes may be accumulated when the segment is rotated to be lined up with arrow 865. Preferably, the rotatable interface is configured with detents so that each task-portion 864*a*–864*f* of the display may be centered on the arrow 865. Preferably, the display is also configured to display time-of-day (TOD) any time a segment 864*a*–864*f* is not properly aligned with arrow 865. The user may thereby get a time-of-day reading by slightly turning dial-ring 852, or when switching from one task to another. In addition, the unit can be alternatively or additionally set to alternate between displaying acctimes and time of day. It will be appreciated that task names may be written on dial-ring 852 to provide indicia for task selection. A seven-segment display, such as an LCD, is exemplified within the display housing 854 which is similar to that in prior embodiments, and a set of controls 868*a*–868*e* is similarly shown. The exemplified embodiment is shown for fixed mounting, however, it may be enhanced with time-of-day display and configured as a wrist-watch which is capable of acctiming according to a named task.

It will be appreciated that numerous methods may be utilized for sensing the rotational position of dial-ring 852 in relation to display housing 854. Three binary bits are capable of representing up to eight states within which the six task positions and a seventh position indicative of no-selection, may be represented. These bits may be driven by electrical contacts, or various electronic and/or mechanical sensors. For example dial-ring 852 may be configured with conductive pads positioned in three concentric rings within an inner portion of dial-ring 852 which interfaces with display housing 854, which utilizes a three sets of dual-contacts that are each capable of sensing the presence of a pad underneath. The binary pad combination sensed would represent the selected task on dial-ring 852, while in the absence of sensing conduction on the three contact sets the dial-ring is known to not be positioned on any of the task selector portions.

FIG. 24 and FIG. 25 illustrate other forms of rotating housing MTC units. In FIG. 24 MTC 900 is configured with an upper housing 902 that is rotatably attached to a lower housing 904 which is configured with a display 908 upon which acctimes are registered and a set of timing controls 910*a*–910*e* are located. Upper housing 902 is configured with task areas, exemplified by six facets 912*a*–912*c*, and 912*d*–912*f* which are not shown in this view, on the periphery forming a hexagonal. It will be appreciated that in this and other embodiments, the task areas subject to selection by way of rotation may comprise areas of any shape that may be identified in some manner by the user when selecting a task for which times are to be accumulated. Task portions of the upper housing 902 are shown labeled 914*a*–914*c* with task names, such as by the user of adhesive-backed notes. It will be appreciated that the top of upper housing 902 may be configured with a recess within which a pad of notes, or alternate items, may be stored. It will be appreciated that upper housing 902 may be either opaque or transparent as desired. It will further be appreciated that by utilizing a transparent upper housing 902, that items may be displayed within the upper housing, such as memorabilia (baseballs, miniature stock certificates, etc.) without affecting the operation of the device.

FIG. 25 is a variation of FIG. 24, and illustrates MTC 950 having a transparent upper housing 952 rotatably attached to a lower housing 954*a* having a display housing portion 954*b* which is viewable within upper housing 952. Upper housing 952 is capable of being rotated 956 on lower housing 954*a* to provide for task selection. This configuration facilitates the incorporation of large and/or multiple displays 958, 960. Often used controls 962 are preferably incorporated in lower housing 954*a* to provide ease of access. Upper housing 952 is segmented into task regions 964*a*–964*c*, and 964*d*–964*f* hidden in this view, by utilizing facets of a polygon, herein exemplifying a hexagon. Each of these task portions may be labeled to provide for user selection, as illustrated with small labels 966*a*–966*c* shown attached to portions 964*a*–964*c*.

FIG. 26 exemplifies another embodiment of multitasking clock/calculator 1000 which provides added features for recording and displaying temporary acctimes and for recording voice annotations. A housing 1002 is configured to retain the MTC/calculator functions and for preferably receiving a note pad 1004 upon which task names and information may be written as desired. A display area 1006 is configured for displaying status information, task selection, results of calculations, as well as acctimes and time-of-day. A numeric portion 1008 of the display allows for various items to be displayed, and is shown configured for displaying up to 16 digits for calculations and up to three clock fields for displaying acctimes, time-of-day values, as well as calculated time values. It will be appreciated that the display may be alternatively configured with alphanumeric or graphics display types without departing from the present invention. A set of task selection indicators 1010 are shown capable of being displayed in response to the selection of the task for which acctimes are to be recorded. Additionally, various indicia and status fields may be displayed, such as the active modes "CLOCK" 1012*a*, "TTIMES" 1012*b*, and "MyTIMES" 1012*c*. The lower portion of the housing 1002 is configured with task numbering indicia 1014 which provide numbers ("1–6") which can be associated with the task selections being registered by selection indicators 1010.

MTC 1000 is preferably configured to operate in a variety of modes as controlled by mode selection buttons 1016–1024. An on/off control "ON" 1016 allows turning off the unit to save power when no tasks are being serviced. Preferably, the acctimes are retained in non-volatile memory, such as battery-backed memory, so that timing is retained from one use to the next. A calculator button "CALC" 1018 selects the unit for calculator mode. It should be appreciated that MTC 1000 is preferably configured to allow users to perform time-based calculations, such as performing addition and subtraction of various times and the conversion of HH:MM or MM:SS times to decimal based time. In addition, the unit is configured to provide user access to the acctimes which may be used as part of time-based calculations. A temporary time button "TTime" 1020 selects a mode for recording temporary tasks which are not subject to one of the ongoing tasks that may be recorded within task 1 through 6. A "Pause" button 1022 allows suspending both temporary and task timing. A acctime button "MyTime" 1024 selects the task timing mode of MTC 1000. A set of task selection buttons 1026, exemplified with six buttons labeled "1" through "6", are provided for allowing the user to select which task is to be timed. It will be appreciated that an adjacent indicator is provided by way of task selection indicators 1010, which correspond to with task numbering indicia 114. The user can readily associate a task for which a name is written on the writing surface 1004 with a task number as shown on the display. Task indication in this manner is provided with one level of indirection, that is somewhat less preferable than the direct adjacent-location association of the majority of previous embodiments, however, the implementation of the interface has been simplified. An optional microphone 1028 is shown included within this embodiment for the recording of notes, which can be especially useful for taking voice notes about temporary tasks. It will be appreciated that digital voice storage may be readily implemented by one of ordinary skill. A number of features may be performed with MTC 1000 through a series of command buttons 1030 through 1046 along with calculator function buttons 1048.

The present embodiment incorporates a separate acctimer for temporary task time accumulation. It should be readily appreciated that the temporary timer may also be incorporated within the previously described embodiments of the invention. In operation, pressing a "TTime" mode button 1020 over-rides the setting of the selector and commences timing a temporary event. This allows the user to start timing any task without having to first consider what category the time will be accumulated within. An indicator 1012*b* preferably is used to signify that temporary accumulation is being performed so that the user readily recognizes that the accumulated time being displayed is not associated with the time selector. The temporary accumulation may be stopped by pressing "Pause" button 1022, whereafter the accumulated time may be restarted, cleared, or added to any of the existing tasks at the discretion of the user. Another preferable feature of temporary task timing "TTime" is that of storing temporary task times along with information associated with the task time. Often the time spent on even a temporary task, such as a fifteen minute phone conversation, should be applied to a task, or billing category. A temporary task generally differs from other tasks which are considered to be ongoing tasks. A person returns to an ongoing task after an interruption, while a temporary task IS an interruption. However, a temporary task is an interruption that in many situations should be kept track of. It will be appreciated that business people billing according to time spent, such as consultants, accountants, attorneys, and so forth have the need to record even small tasks, the time and event for which should be recorded for client billing. A temp-store feature allows the accumulated time to be saved, preferable in combination with a reference designator for the temporary task. Temp-store may be optionally implemented to save a time of day reference associated with either the start or end of the accumulated time. A designator for the temporary task may be stored automatically, such as by assigning a sequential number to each temporary task when it is stored. The user then can write out a designator for the temporary task. For example, the user may list client names, or other tasks, associated with each temporary task. A couple of implementation examples follow to help clarify the use of the Temp-store feature:

(1) Store Accumulated TTime in sequence and TTime designation: MTC 1000 can simply store the time in a list under user selection, which may be recalled later. Preferably the MTC also stores the start time of the temporary task. The user manually maintains a list of designators on the note pad for each stored time. For example: "Dave C.—Headset", "KJY", "Yanni—check TMs". By ordering these as vertical rows on the note pad the user can easily associate the designators and notes with the stored accumulated time and start time of each temporary task.

At a later time, such as at the end of the day, the user can display each entry in the list of temporary tasks. Preferably a number is indicated both when information about each temporary task is stored or recalled which aids in differentiating the tasks and the entries in the list.

(2) Store Accumulated TTime in sequence and voice annotated designation: The MTC stores the TTime, and optional TTime start time, into a list and the user voices a short voiced designator into microphone 1028 which is digitally recorded on a digital recording circuit and stored in association with the other TTime information. At any time, such as at the end of the day, the user can recall the entries and handle entering the information in the proper categories or charging time to the proper clients. It will be appreciated that when recalling the entries the accumulated temporary time and the time of day at the start of the TTime may also be annunciated in addition to the stored speech segment.

By way of example, the present embodiment of MTC 1000 is configured with a number of control buttons whose functions is generally described below.

MODE selections:

TTIME—Enter TTime MODE—(1020) Pause acctiming for other task

Start recording accumulated temporary time

MYTIME—(1024) Enter selected task timing mode, start accumulating task time for the selected task PAUSE—(1022) Pause accumulating time in the present mode Press again to continue. Does not change acctime mode The action of the following generic buttons depends on mode:

STORE—(1030) Store acctime and other info for current mode

TTime mode—store acctime, TOD, etc in list and clear display

MyTime mode—sum amount to the cumulative total

RECALL—(1032) Recall entries in current mode (keep timing unless paused)

TOTAL—(1034) Display total for task, in TTime mode sum value list press twice in succession to display sum of all acctimes CLEAR—(1036) Clear the selected task value or TTime value SHIFT—(1046) Used with other selected keys to select opposing action NEXT—(1040) Display next/last in series, such as TTimes ADD—(1042) Add/subtract the displayed value to selected task or TTime INCR—(1044) Increment/decrement displayed acctime—correct acctimes/TTimes UNDO—(1038) undo last operation (clear mistake)

The calculator keyboard 1048 is substantially conventional, however, it contains additional calculation keys for selecting between numeric and time mode 1050, and for converting between HH:MM time and decimal time HH.HH (hours and decimal fractions of hours) 1052. The selection of time mode preferably defaults to HH:MM mode wherein times entered are assumed to be times and calculation are performed on them as time values. The conversion between HH:MM and HH.HH decimal time, and vice-versa, is a convenience feature as many situations require the use of one or the other format for entering time values.

FIG. 27 through 29 illustrate the incorporation of electronic ink materials, which may be utilized within the various embodiments of MTCs. Electronic ink is typically manufactured as microspheres containing ink that moves within the sphere in response to applied voltage and is capable of retaining its position, and displayed color, even after removal of the applied voltages. Electronic ink can be manufactured inexpensively in various materials such as papers, plastics, and so forth. It should be appreciated that the writing surface described for any of the embodiments may be implemented utilizing an overlay containing electronic ink which may be written upon by a stylus whose tip generates a programming voltage when contacting the surface of the electronic ink. Furthermore, the electronic ink can also provide an inexpensive display as the color of an array may be readily changed by applying a voltage across a portion of the paper to change the optical state of the material. The programming voltage is applied in conjunction with an opposing voltage plane at the backing. Applying a programming voltage changes the spheres to a color that is in contrast with the background, such as black against a background of spheres which are white. Erasure of a section of the electronic ink can be accomplished by applying a voltage that is of opposite polarity in relation to the programming. Preferably, a substantially transparent electrode overlays the front surface of the electronic ink, such as a closely spaced grid of metalization. To erase a section of the sheet of electronic ink, a voltage is applied to the front electrode in relation to the backing electrode that has an opposite voltage relationship as the programming voltage to the backing, such that programming is reversed.

In the aforementioned multitasking displays, any portions of the unit which are configured for accepting task names, an other notes, may contain electronic ink to allow the user to easily write task information and names. Preferably, the electronic ink is configured in task sections that are each provided with a separate erasure electrode connected to a task erase function. The task name may be written by the user with a stylus and later erased at user discretion, such as by pressing a separate task name erase button, or by double-clicking the clear button for the acctime on a particular task.

FIG. 27 through 29 illustrate embodiments that accrue additional benefits from the inexpensive and non-volatile nature of electronic ink. FIG. 27 is a MTC 1100 in the form of a polygonal housing 1102 in a hexagonal shape whose facing areas contain electronic ink, wherein a central analog face 1104 clock display is shown. Clock display 1104 may be implemented with conventional LCD, electronic ink, other display forms, or configured as a rotating display (i.e. mechanical display). In a preferred implementation, the entire face of MTC 1000 contains electronic ink overlaying conductive segments and over which a transparent mesh of conductors is connected. The analog display can be implemented in similar manner to an LCD wherein the hour markers 1106, and hands 1108, 1110 are portions of the electronic ink which overlay separately addressable electrodes. Clock display 1104 is shown surrounded by acctime displays 1112*a*–1112*f* for representing the accumulated time for each selectable task. These displays are preferably configured as electronic ink sandwiched between electrodes and it will be appreciated that the use of electronic ink drastically reduces the cost and complexity of forming the display in relation to the cost and difficulty with creating a similarly sized LCD display. Furthermore, the use of electronic ink in the facing of the display allow the user to write task information onto the electronic ink, which can be retained until that portion of the electronic ink is electrically erased. A stylus 1114 is connected by a wire 1116 to MTC 1100. The tip of the stylus 1118 is configured to generate an electric potential opposite that which is present behind the layer of electronic ink on each task segment 1120*a*–1120*f* on the face of the unit. The user need only write in one of these areas with the stylus to "program" the underlying electronic ink into a visible state. Each task segment on the face of the unit 1120*a*–1120*f* is configured with a separately addressable set of front or rear electrodes so that each task area may be erased separately under circuit control. Preferably, controls on the rear of the unit allow for selection of which task area is to be erased, these controls also allow for the selection of clearing the time accumulated for each task. It should be appreciated that the use of electronic ink provides an extremely low power display, as power is only consumed during display changes as a result of the intrinsic material capacitance, and leakage currents. It should also be appreciated that the elements of the display may be a mixture of electronic ink and conventional display technologies. FIG. 28 illustrates an MTC 1150 having a similar configuration as that shown in FIG. 27, however, it utilizes all digital displays. MTC 1150 is contained in a housing 1152 configured for being rotated for selecting the desired task. A central TOD clock display 1154 is surrounded by acctime displays

1156*a*–1156*f*, and separate task indicia areas 1158*a*–1158*f* which are adjacent to the task selector provided by the perimeter facets whose rotation is sensed for performing task selection. The task indicia areas 1158*a*–1158*f* are configured with electronic ink areas, or other display material having similar non-volatility and programmability, that may be written on by a stylus. It will be appreciated that low tech solutions to the "non-volatility" of the display may be provided by writing on an erasable surface with a special pen, the use of pressure sensitive layered material (often found in children's writing tables) that are written upon by the application of pressure and erased by lifting one of plastic sheets, or the use of labels such as Post-It™ Notes. The display may be implemented in a number of ways, such as in electronic ink, as an LCD or similar, and so forth. One way in which the number of addressable areas of the display can be reduced is by providing a rotating electronics assembly behind the face of the unit. The rotating electronics assembly would preferably contain the timing elements necessary for tracking the acctimes, TOD, and so forth, as well as electrode areas corresponding to a large display 1154 and a small display, such as 1156*d*. Upon sensing movement, the display discontinues updating, and upon stabilizing in a new position area about the large display 1154 is erased (exclusive of the areas of the acctime displays 1156*a*–1156*f*). The time-of-day is then output on the electrodes underlying display 1154 to set the segments of the display. It will be appreciated that the electrodes associated with segments of the display to be turned off may be pulsed with opposite polarity voltages to clear the segments. This can be done by erasing the entire display area (requiring only a single electrode on one side) or by individually erasing the segment area, (requiring individually addressable segments on both sides of the layer of electronic ink). The acctimes for the currently active task are updated as time accumulates, yet the other acctime displays 1156*a*–1156*c* and 1156*e*–1156*f* retain the acctime value they had accrued when last selected, or default to zero when unused. In this way, the number of addressable electrodes has been reduced and the time-of-day display is always shown in an upright position. It will be appreciated that a number of implementation alternative may be provided by one of ordinary skill in the art without creative efforts.

FIG. 29 is similar to FIG. 28 in that it utilizes a single pair of display electrode sets according to the currently selected task. MTC 1200 has a vertically oriented housing 1202, that is herein implemented as a cylinder, connected above a base member 1204. A rotatable outside portion of the housing 1206 is configured as separate sections 1208 of electronic ink, preferably showing markings 1210 between each task area as a writing boundary. The separate electronic ink areas allow for separate erasure of the information about each task. Preferably, the accumulated times and user recorded task notes for each task may also be separately erased, as the user may wish to retain the task names but restart acctiming. The rotatable outside portion of the vertical housing 1204 allows rotating the layer of electronic ink over a preferably stationary set of electrodes which are positioned to generate a TOD display 1212 and acctime display 1214. The electrodes on the facing side of the rotating layer of electronic ink are electrically connected to the electronics of the timer mechanism, and can sense position in a number of ways, such as previously described. Alternatively, a clear sheet having embedded electrodes may be retained stationary over the front facing task area, wherein the rotating layer of material containing electronic ink is rotated between fixed electrodes retained on opposing sides of the material. The rotation of the electronic ink areas allows the times associated with previously selected task to be retained for display. In addition, the time-of-day at which the task was last selected may be retained by simply not erasing the time-of-day for a non-selected task subsequent to the selection of a new task. Indicia 1216*a*, 1216*b*, may be included on the display in addition to the displays themselves, these indicia may be permanent or formed as part of the display elements. A task selector indicator 1218 is shown to clearly indicate which task is selected. It is preferable that the rotating portion of the housing be configured with detents to assure proper positioning of a task for selection. A set of controls 1220 are shown provided on the base 1204 of the unit. A stylus 1222 is connected to the unit with a wire 1224. The cylindrical vertical housing 1202 is shown configured for storage, such as a pencil-holder recess 1226. It will be appreciated that the unit may be configured in a large variety of shapes and configurations without departing from the present invention.

Accordingly, it will be seen that this invention provides a multi-tasking clock (MTC) device for easily tracking the accumulated time (acctime) spent on each of a plurality of tasks. MTCs may be implemented in myriad ways without departing from the teachings of the present invention. Specifically, it will be appreciated that selecting between tasks may be accomplished with orientation sensitive mechanisms and other forms of switching which provide for the association of a user written task name (and/or information) with a task selector. A variety of displays may be utilized upon which to display the accumulated intervals. Power and control circuitry may be configured in a number of ways that will be recognized by one of ordinary skill in the art. Embodiments have exemplified additional features which may be incorporated with multi-tasking clocks, such as: acctime totaling, modifying, accumulation into day periods and total cumulative times, time calculations, temporary acctime recording, and so forth. Implementations have been described to exemplify various mechanisms, display types, display formats, and operation. It should be appreciated that these aspects of the invention may be mixed or matched in various combinations within an MTC clock or incorporated within other devices without departing from the present claimed invention. The depicted embodiments are provided as examples to represent but a few of the numerous ways the present invention may be implemented. The MTC functionality and teachings of the present invention may be incorporated in various desk accessories as described, and within other devices, such as wristwatches, calculators, cellular phones, telephones, telephone accessories, PDAs and so forth. It will be appreciated that one of ordinary skill in the art can modify or extend the embodiments without departing from the present invention. The following describes a only a few of the alternative features and implementations considered within the present invention.

MTC clocks are well suited for implementation as desktop accessories, however, it will be appreciated that items such as wristwatches may be adapted to provide MTC functionality, which can be especially useful in concert with voice storage of task name and information associated with a task selector. The general functionality of the MTC may also be adapted to create a separate interface which provides a simpler time billing interface for computers, laptops, PDAs and so forth. The interface is preferably implemented as a pop-up program that allows the user to quickly track acctimes without the time and overhead associated with entering a billing program. The simpler time billing interface is configured to provide a simple standard output from which any program that utilizes time billing can extract information from. In the billing program the categories may be associated permanently with billing categories or the user can elect to direct the application of the times to the proper billing categories.

The interface is preferably configured to allow single key access, such as pressing the F12 key to bring up a task list which can be displayed as just a row of buttons labeled with a key name, an acctime and a task name, for example "F1—02:45—Accounting", "F2—00:12—Dunnings", "F3—04:43—Marketing" and so forth. User can enter simple strings for a task and can control actions of these elements in a similar manner as described for the clock based MTCs described previously. Pressing the appropriate function key starts the selected task and pauses other task timing. Additional function keys such as F9—F11 can be utilized for functions such as those previously described, including "Clear", "Mode", "New Day", and so forth. A button, such as "EDIT" can allow for editing any of the times and amounts using the keyboard or other input mechanisms for the device. These functions can be tied to the internet or intranet as well. On an intranet, when the time category is changed an email can go out to a time receiver recipient which will track company time. This would also allow top office personnel to track the tasks being performed company wide. The applications for the present invention extend into various business and personal areas wherein the time spent in each of multiple tasks should be tracked.

Another aspect of the invention comprises a set of tweezers having a sensing head that alerts the user to the interposition of small objects between the opposing members of the head which are used to grasp obstructions, such as for plucking.

FIG. 30 depicts a tweezing device 1310 having a first arm 1312, a second arm 1314, and a housing 1316. Arms 1312, 1314 terminate in a head 1317 having a first portion 1318 and a second portion 1320. In use, conventional tweezing is performed by positioning the first 1318 and second opposing grasping portions 1320 of the head 1317 on both sides of a projection, a small object, that is to be grasped. The arms 1312, 1314 comprise structural members 1322, 1324 to which are attached a plurality of optical light pipes 1326, 1328, that are connected between the head 1317 and the housing 1316, which contains an audio output 1330.

FIG. 31 shows a detailed view of one head portion 1318 at the proximal end of structural member 1322. A flat area 1332 of head portion 1318 is shown with optical fibers 1334 that are organized as a row 1336 of the round fibers that pass from the exterior of the structural member 1322 to the inside of the head by way of slot 1338. The depicted head illustrates eight adjacent fibers which span a width of approximately 3/16 inch. Preferably, corresponding optical fibers are attached to each structural arm 1322, 1324. It will be appreciated, however, that various forms of structures can be provided to support the head of the tweezers.

FIG. 32 is a circuit 1350 for sensing the interposition of items within the head 1317 of the tweezing device 1310. The circuit comprises a control circuit 1352, exemplified as a microcontroller having an audio output device 1353, exemplified as a piezo-electric transducer. The tweezing device circuit 1350 preferably has self-contained power source, such as being powered by a battery 1354. Each LED within a row of LEDs 1356*a* through 1356*h* are coupled to an optical fiber 1334 which is routed to one portion 1320 of head 1317. It will be appreciated that the use of a larger number of light sources and attendant light pipes can result in increased resolution of the tweezing head and improved item differentiation. The LEDs may comprise any spectral range of light but either visible or near infrared light is preferred. Optical fibers 1334 from an opposing portion 1318 of head 1317 are routed back down from the head 1317 to an optical coupler 1357, which may comprise optics such as a color filter and lens to provide for the proper coupling of the transmitted light to the sensor and the attenuation of non-band, spurious, or ambient, light. The optical coupler 1357 connects to an optical detector 1358, a diode detector for example, which is coupled to a conditioning circuit 1360 comprising an amplifier and low pass filter. The output of the conditioning circuit 1360 is connected to an analog-to-digital input of the control circuit 1352.

In operation, the light generated from the LED sources 1352*a* through 1352*h* are coupled through the fiber optics 1334 to the head portion 1320 and are directed at the corresponding fibers on head portion 1318. Light emitted from head portion 1320 that is not otherwise blocked by obstructions is received at head portion 1318 and coupled by way of the optical fibers 1334 to the optical coupler 1357 into the optical sensor 1358 to be registered and conditioned by conditioning circuitry 1360. As sensitive optical sensors and the associated circuitry are typically far more expensive than a light source, the exemplified circuit 1350 has been implemented with a single sensor 1358, but a collection of light sources 1352*a* through 1352*h*. To utilize a single sensor 1358 without a loss of information, the light sources 1352*a* through 1352*h* are sequentially activated wherein the control circuit 1352 monitoring the amplitude of the light received by the conditioning circuit 1360 can determine the amplitude of light being transferred across the gap between portion 1318 and portion 1320 of the head. Typically the amplitude of light crossing between the head gap is in direct proportion to coupling between the output and corresponding input. Therefore, the control circuit can determined the extent and character of an obstruction which is interposed between the portions 1318, 1320 of head 1317. For example, a small obstruction, such as a hair will cause the light amplitude to be reduced in one or perhaps two adjacent fibers and due to motion will typically have a bounded level of fluctuation between adjacent fibers. In contrast, a section of skin is likely to obscure a section of the sensors, either covering all sensors or a portion on one side or the other, and has less variation. The control circuit 1352 maps the variations per segment over periods of time, and at intervals correlates the information to determine the obstructive state of the sensor head, whereby it generates a corresponding audio output in transducer 1353. Users are thereby provided feedback as to the number of small protrusions interposed between the heads and the character of those protrusions. The feedback provides the user with the capability of directing the use of the tweezing device without the need of seeing the items that are to be removed. The control circuit also is capable of differentiating the relative closure of the tweezers head, as increases in the head gap lead to increased dispersion of the light, which is spread out more when it arrives at the optical sensor portion of the head. The resolution of the device is thereby increased as the user closes down the head near a possible projection, and the gap between the optical surfaces is reduced.

A simple implementation of the circuit 1350 for use within a cosmetic tweezers, for example for use in plucking hairs, generates no sound if all LEDs are received with equal brightness, and will generate a tone, or tonal pattern to be associated with "pluck me" when a small obstruction is registered between a small gap in the portions 1318, 1320 of head 1317. The tonal pattern is modified for the registration of multiple small obstructions, such as hairs. If a large portion of the light is blocked from one side of a head portion, then a piece of skin, or other obstruction is considered to be obstructing the device and a warning tone is generated to prevent the user from inadvertently causing injury.

Power is preferably activated within circuit 1350 by closing the head gap and touching the two conductive arms 1322, 1324 to one another, upon which power is activated and an alerting tone issued. As the head gap is closed, power from the battery passes through the conductive arms 1322, 1324 and head portions 1318, 1320 between the battery and the control circuit 1352; to thereby provide power to the control circuit 1352. After a first predetermined time period, such as 0.5 seconds, control circuit 1352 outputs a power latch signal to a power switching element 1362, which then retains the battery power to the device while it is being operated, and also generates an audible alert indicating that power has been latched on. In addition, the control circuit is preferable configured with a low battery sense wherein an audio pattern corresponding to "low battery" may be output. Once use has discontinued for a second predetermined interval, such as 3 minutes, the circuit powers itself off to conserve battery power.

As the speed of detection is quite rapid, the device need not constantly be in a mode of scanning the output LEDs and may either turn on all the light sources to provide lighting to the area on which the device is being used, or turn off the light sources to conserve battery power. Further battery conservation measures may be taken with regard to the use of a sleep mode within the control circuit 1352 and/or the conditioning circuitry 1360.

FIG. 33 exemplifies a simplified routine for providing feedback according to the interposing projection at the head of the tweezing device 10. Power is applied to the device by contacting the portions 1318, 1320 of head 1317, to start the device as in block 1400. The control circuit initializes the hardware and runs a self test wherein the light sources are scanned and the received light intensity checked. In addition, should the self test data fall within established parameters, the intensity data received may still be used to calibrate the results to be obtained with the unit during operation. The self test thereby registers the condition of the device, such as if the heads appears dirty, or the battery is low. After a predetermined time, the control circuit activates the power latching switch as per block 1402, followed by the issuance of a power activation tone, or beep according to the results of the self test as per block 1404. A loop, containing blocks 1406 and 1408 is then entered for registering a series of intensities as the output light sources are activated in succession. Unless the last light source has been registered as detected in block 1406, the next LED is illuminated and the corresponding light amplitude is registered and stored in block 1408. After all outputs are scanned and read in, the intensities are compared at block 1410. A determination of the interposition is performed based on intensities, preferably in addition to history of prior reading, as well as calibration data as per block 1412. If no obstructions exist, (light passes across unattenuated) then the condition is registered and the sensing loop can commence again. If obstruction is encountered as detected in block 1412, then the nature of the obstruction is determined first at block 1414 wherein the discernment of small objects is performed. Should the object be a small object, then a predetermined beep is registered according to the nature of it in block 1416. Larger objects are discerned within block 1418 and upon detecting a large object, such as a section of skin, a second type of beep is generated at block 1420. If the object is neither small nor large then additional beeps can be generated at block 1422. It will be appreciated that heuristic programming for the circuit may be performed at any level of complexity by a person of ordinary skill in the art without departing from the teachings of the present invention.

FIG. 34 is a tweezers portion 1500 which includes an automatic tweezing means which moves to pluck the hair, or other projection, which is interjected between the portions of the tweezing head. The present embodiment 1500 utilizes a tweezers body 1502 into which tweezers head portions 1504*a*, 1504*b* are retained that are connected by a joining member 1506*a*, 1506*b*, such as a wire or spring steel which retract toward the base in response to the movement of an actuator, such as a solenoid 1508. It will be appreciated that a number of mechanical contrivances may be implemented to alternatively retract or move the tweezing head portions, when an interjecting member is being grasped therebetween. The tweezers head portions 1504*a*, 1504*b*, are biased toward their normal (non-retracted) grasping position by a biasing member, such as a spring 1510*a*, 1510*b*. It should be appreciated that actuator 1508 may be powered in a number of ways, such as electronically (solenoid, motor, muscle wire) or pneumatically. The use of an electronic device, as depicted by a solenoid 1508, is activated from a control device 1512. The unit is fitted with a cleaning member 1514*a*, 1514*b* which is positioned to swipe a hair, or other interjecting element, that remains attached to one or the other portion of the tweezing head as the portions retract toward the base in unison to pluck a hair.

Accordingly, it will be seen that this invention provides a tweezing device that generates feedback in response to the characteristics of one or more items interposed between the portions of the tweezing head. It should be appreciated, however, that the tweezing head may comprise any mechanism capable of grasping, and is not limited to the bifurcated head of the exemplified device. In addition, it will be recognized that grasping and/or tweezing may be accomplished with a variety of mechanical structures within which a sensing unit may be connected. It will be realized further that the optical sensing embodied herein is but one form of sensor that may be utilized, whereas other sensors such as pressure, inductive, capacitive, and even RF sensors may be used alternatively within the invention. Additionally, the invention can be configured to provide for power-assisted removal of small objects, such as hairs, using an autotweezing feature. The invention is directed primarily at cosmetic applications, however, it will be recognized that grasping and/or tweezing may be performed in other instances.

The use of belts having a buckle, such as the conventional buckle described for FIG. 35, which attached to a generally non-stretchy section of material are often uncomfortable as the correct circumference can not always be achieved and is subject to variation according to position or the amount one may partake of at the dinner table for instance.

FIG. 36 is a belt buckle 1615 shown with a compressible compliant member according with the present invention. A buckle frame 1652 comprises a proximal end 1654, a distal end 1656, a top section 1658 and a bottom section 1660. A bar style of hasp 1662 has a distal end 1664 connected with the distal end 1656 of buckle frame 1652. The proximal end 1666 of hasp 1662 is configured to close onto the proximal end 1654 of buckle frame 1652 when inserted into a hole in the belt material under tension. A pair of movable belt material attachment points 1668A, 1668*b*, are shown by way of example. One of more attachment points may be utilized, which may be separated, attached to one another by extension member 1670, formed of a single piece, or formed from a series of pieces. It will be appreciated that the movable belt attachment points may be configured in various ways so long as they are capable of interfacing with the material of the belt. The movable belt attachment points are shown interfacing to one or more compressible compliant members 1672. Under circumferential tension of forces 1628*a*, 1628*b* in opposition with force 1630, these compliant members compress such that the circumference of the belt and buckle system increases. A number of means may be utilized to provide the compressibly compliant member at the interface between the belt buckle and the belt material.

FIG. 37 is a similar diagram to that of FIG. 36, however, it represents a belt buckle 1690 shown with an extendable compliant member. A buckle frame 1692 comprises a proximal end 1694, a distal end 1696, a top section 1698 and a bottom section 1700. A bar style of hasp 1702 has a distal end 1704 connected with the distal end 106 of buckle frame 1702. The proximal end 1706 of hasp 1702 is configured to close onto the proximal end 1704 of buckle frame 1702 when inserted into a hole in the belt material under tension. A pair of movable belt material attachment points 1708A, 1708*b*, are shown by way of example, with optional attaching extension member 1710. The movable belt attachment points are shown interfacing to one or more extendable compliant members 1712. Under circumferential tension of forces 1628*a*, 1628*b* in opposition with force 1630, these compliant members extend such that the circumference of the belt and buckle system increases. A number of means may be utilized to provide the extendably compliant member at the interface between the belt buckle and the belt material.

FIG. 38A is belt buckle 1730 having compressible spring driven bars to provide compliance with the attached substantially non-compliant material of the belt. The frame of belt buckle 1730 comprises a proximal end 1732, a top section 1734, a bottom section 1736, and a distal end 1738 configured with a recessed portion 1740 and apertures 1742. A bar style of hasp 1744 has a unattached proximal end 1746, and a distal end 1748 rotatably connected to distal end 1738 of belt buckle 1730. A set of interface bars 1750A, 1750*b*, provide movable belt material attachment points. Interface bars 1750*a*, 1750*b* are attached to a unshaped member 1752*a*, 1752*b* that is slidably engaged within the apertures 1742 within distal end 1738 of buckle 1730. Interface bars 1750*a*, 1750*b* are being urged into an extended position by springs 1754*a*, 1754*b*, 1754*c*, 1754*d*. The material of the belt 1756 is shown in phantom surrounding interface bars 1750*a*, 1750*b*, in a loop wherein the front and back portions of the loop are fastened 1758, such as by stitching them to one another. It will be appreciated that under tension, the interface bars will move to compress springs 1754*a*–1754*d* to allow the loop of belt material 1756 to move away from the proximal end 1732 of the belt buckle to increase the circumference provided by the belt and buckle system. In FIG. 38B the force has been increased to compress springs 1754*a*–1754*d* to increase the circumference.

FIG. 39 is a belt buckle 1770 that offers compliancy by the extension of a portion which is configured for attachment to the belt material. The frame of the belt buckle comprises a proximal end 1772, a top portion 1774, a bottom portion 1776, and a distal end 1778 configured with a notch for receiving a rotatable hasp 1781. The frame of buckle 1770 is configured with slots 1782*a*, 1782*b* and extendable compliant members 1784*a*, 1784*b*, such as springs. A belt attachment member 1786 is slidably engaged into slots 1782*a*, 1782*b* and connects to the extendable compliant members 1784*a*, 1784*b*. When subject to circumferential forces 1728*a*, 1728*b*, in opposition with force 1730, the belt attachment member 1786 urges the extension of compliant members 1784*a*, 1784*b* and moves to increase the circumference of the belt/buckle combination.

FIG. 40 is a belt buckle 1790 shown from a top view having a frame 1792, being attached to a belt with either a peg style retainer 1794, or a conventional hasp 1796. It should be appreciated that the previously illustrated buckles may be configured with various forms of retention mechanisms such as pegs, hasps, and so forth without departing from the present invention. A rotationally compliant belt attachment bar member 1798 is urged toward a position in opposition of force 1728 with a compliant member 1800, such as a spring. Under circumferential tension the attachment bar member 1798 swings 1802 to increase the circumference of the belt/buckle combination.

FIG. 41 is a top view of a belt buckle 1810 having either peg 1814, or hasp 1816 attachment and utilizes a rearside sliding belt attachment member 1818 attached to a an interior extendable member 1820, such as a spring. The force of belt tension on belt attachment member 1818 extends the extendable member 1820 to increase the circumference of the belt/buckle combination.

FIG. 42 is a compliant belt buckle 1830 showing only the cross section of a distal end 1616 of the belt buckle frame being retained within a loop of belt material 1834 whose sides are fastened 1836 to one another, such as by stitching. A compliant member 1832, such as high density foam, is retained between the distal end 1616 of the buckle and the interior of the loop of belt material. Circumferential belt tension causes compliant member 1832 to compress and the circumference of the belt to increase. It will be appreciated that the amount of compliance provided by this embodiment is substantially limited, however, it should be recognized that this embodiment may be implemented at minimal cost.

Accordingly, it will be seen that this invention may be implemented in various ways utilizing various sorts of compliant members such as compressible, extendable, rotationally compliant, and so forth.

The use of conventional neckties as shown in FIG. 43 poses a danger to the wearer as the user may be strangled, or pulled into machinery if the loose ends of the garment are caught within the machinery or grasped, such as by an assailant.

FIG. 44 is a necktie embodiment 1900 according to the present invention shown in two parts, a first part 1902 with distal end 1903, and a second part 1904 with proximal end 1905 which are joined with a tension-controlled fastening means 1906. The tension-controlled fastening means 1906 may comprise any of a number of joining members which allow the halves of the tie 1902, 1904 to separate when a tension that exceeds a predetermined level is applied to the material of the tie. The joining member may comprise any form of fastening mechanism, such as selected from material having a predetermined breaking strength, snaps, hook-n-loop fasteners, and so forth. The tie may be configured with more than tension-controlled joint 1908, to assure that the tie can separate at a suitable location under a tension that exceeds the predetermined breaking strength.

FIG. 45 depicts a tension-controlled joint 1910 wherein a first portion 1912 of the tie having a hook fastener portion 1914, is configured to attach to a second portion 1916 adapted with loop fastener portion 1918 for attaching to the first portion 1912. It will be appreciated that the two portions thus joined provide a tie that appears conventional yet separates when subjected to a predetermined tension.

FIG. 46A through FIG. 46C depict another form of tension-controlled joint 1930 which appears more conventional and does not allow for the separated sections of the tie to be reassembled without stitching the pieces back together with the appropriate material and technique to restore the safety-separation feature of the tie. Two halves of a tie 1932, 1934, shown with a generally "tubular" construction having one or more layers of cloth providing a facing layer and a rearward layer (generally including a longitudinal seam) a hidden line 1936 illustrates the interface between the facing and rearward material sections. A break somewhere in the mid-section of the ties length divides the tie into two sections having completed ends 1938, such as stitched closed to prevent unraveling. The two portions are joined together with a fixed number of threads 1940 having a predetermined breaking strength so that the portions of the tie can separate when dangerous levels of tension are applied to the tie. In the figure, six portions of thread are visible, however, the connecting threads across the backside must be taken into account which in this case raises the number of connecting threads to twelve. A thread with a predetermined breaking strength, is utilized to join the two sections into a tension-controlled fastening. For example, six-pound test monofilament line may be used in the joint shown.

It will be appreciated that a determination of the tension that must be applied prior to separation of the sections within the tie is not a simple matter of calculating the number of strands times the break strength. Such a calculation for the embodiment shown in FIGS. 46A–46C would yield a separation strength of 12 strands×6 lbs.=72 lbs. However, under tension the short edge portions of thread break first and the remaining threads may be subject to sequential breakage or may disengage from the material as a result of the original thread breakage. In addition, the method of applying the threads and the material used will often have some slight effect on the predetermined tension induced breaking strength of the tie. Therefore, different arrangements should be tested for proper separation in response to an applied tension force, wherein the number of threads, type of thread, and stitch style may be altered to render an appropriate separation threshold. In general, the separation threshold should be configured to be within a range which is sufficiently low to prevent injuries to the wearer, and definitely less than 100 pounds. For example, a separation threshold of between 20 pounds up to about 40 pounds is presently a preferred range. It will be appreciated that a tradeoff must be made when selecting a separation threshold. A separation threshold that is too high may not prevent certain forms of injury, while a threshold that is set to low could cause the tie to separate when being applied or at other times that do not pose a threat to the safety of the wearer. Therefore, although the invention may be practiced with separation thresholds less than 20 pounds, such as 5 or 10 pounds, the tie can become separated if the wearer applied too much tension during application which may not make the wearer especially happy with purchasing another safety tie to replace the one he broke when tying the previous one. On the other hand, thresholds above 40 pounds, in particular on a slight individual, could allow the individual to become strangulated, or suffer other injury without the tie separating to relieve the tension. Neckties of a conventional construction have breaking strengths which exceed 100 pounds, and often far exceed that value, wherein the wearer is subject to very high tension levels and can be easily injured or killed if the tie becomes entangled in machinery or is subject to grasping by a hostile individual.

FIG. 47 illustrates by way of example another way of joining the two portions of the tie 1950 to provide a more esthetic appearance. A first portion 1952 is configured with an underside layer which extends beyond the length of its upper side layer, while the second portion 1954 is configured in a complementary shape. Each portion is shown with a hidden line 1956 which indicates that two layers of material (upper and lower) comprise the tie. The two portions are joined at seams 1958, 1960, which are configured to provide a predetermined separation threshold, such as fabricated with a predetermined number of threads of a predetermined breaking strength as determined for the given structure and material for the tie.

FIG. 48 depicts a tie 1970 configured with nondestructively separating portions 1972, 1974, wherein fasteners, such as hook and loop, snaps, or similar, are incorporated within the ends to be manually joined after separation. The ability to manually rejoin the ends facilitate an additional feature of allowing the user to insert one or more sections 1976 of material into the length of the tie to extend its length. It will be appreciated that the correct length of a tie depends on the height of the wearer, therefore this mechanism allows ties to be made to correctly fit any sized individual by the insertion of one or more additional sections of material. The section 1976 joined within the be fabricated with offset upper and lower sections of material which overlap with their complementary sections on the other portion of the tie being joined. The over-and-under arrangement improves the look and feel of the resultant tie formed from the joined sections. Section 1976 is shown with an upper set of seams 1978*a*, 1980*a*, and hidden seams 1978*b*, 1980*b*.

Accordingly, the present invention provides an apparatus and method for reducing the safety hazard posed by conventional neckties by providing for separation of portions of the tie when a predetermined separation threshold is exceeded. It will appreciated that a tie according to the present invention, which separates under a given tension force, may be implemented in a large number of alternate construction forms and material choice without departing from the teachings of the present invention. It will further be appreciated that bow-ties, scarves, and other dress garments designed as neckwear may be implemented according to the present invention.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A clock for tracking the time accumulation according to a single task as selected from a plurality of tasks, comprising:

a housing;

a clock face within said housing, capable of displaying hours and minutes;

means for selecting one task from a plurality of tasks;

means for counting accumulated time according to said selecting means for a given selected task and displaying the accumulated time on said clock face, while retaining the value of accumulated time on each remaining task, until user directs that the accumulated time for a task be reset;

wherein said means of selecting one task from a plurality of tasks comprises a sensor responsive to the orientation of the clock, wherein the user rotates the position of the clock housing, or portion thereof, to select one task from a choice of at least three tasks.

2. A clock as recited in claim 1, wherein said means of selecting one task from a plurality of tasks requires only a single action to be performed to select one task from a choice of at least three tasks.

3. A clock as recited in claim 1, wherein said means of selecting one task from a plurality of tasks comprises a single selector control input.

4. A clock as recited in claim 3, wherein said single selector control input is selected for use within the clock from the group of available electronic selector inputs consisting of rotary switches, slide switches, and push button switches.

5. A clock as recited in claim 1, wherein said means of counting accumulated time is selected from the group of electronic circuit elements consisting of microcontrollers, microcomputers, digital logic elements, custom circuit elements, programmable logic elements, and combinations thereof;

wherein said selected electronic circuit elements are adapted to store multiple time values and upon selection of a particular time value perform incrementing of that time value according to the elapsing of time; and wherein said selected electronic circuit elements are adapted to generated signal for controlling an electronic display upon which one or more of the time values may be displayed.

6. A clock as recited in claim 1, wherein the housing is configured for receiving the name of said task name adjacent to said means for selecting one task from a plurality of tasks to facilitate correct user task selection.

7. A clock as recited in claim 6, wherein the housing is configured to incorporate a writable surface area upon which the task name may be written.

8. A clock as recited in claim 7, wherein said writable surface area is selected from the group of writable surfaces consisting writing paper, and electronic ink written upon by a stylus.

9. A clock as recited in claim 1, wherein the clock has a self-contained power supply and is of a size which occupies less than approximately one hundred cubic inches.

10. An apparatus for tracking time accumulated to one of a plurality of tasks, comprising:

a housing which is adapted for receiving written task names;

a power source retained within said housing;

a display within said housing adapted for the display of at least one time value;

a sensor retained within said housing which adapted to generate a task selection signal in response to the orientation of the housing;

time setting selectors on housing of said apparatus which are adapted to generate time setting signals in response to user time selection inputs; and a controller circuit within said housing and powered from said power source;

wherein said controller circuit is adapted to maintain a plurality of time values;

wherein said controller circuit is adapted to increment one selected time value from said time values in response to said task selection signal;

wherein said controller circuit is adapted to generate signals corresponding to said selected time value to control the output of said display;

wherein said controller circuit is adapted to receive input from the time setting selectors to modify one or more of said time values.

* * * * *